United States Patent [19]

Kahan et al.

[11] 4,015,445

[45] Apr. 5, 1977

[54] AUTOMATED HOME KNITTING MACHINE WITH MEANS FOR CONTROLLING THE KNITTING OF DESIGN ROWS

[75] Inventors: William Kahan, New York, N.Y.; Thomas Richard Peer, Glenwood, N.J.

[73] Assignee: The Singer Company, New York, N.Y.

[22] Filed: Oct. 30, 1975

[21] Appl. No.: 627,178

[52] U.S. Cl. ..... 66/75.2; 66/154 A

[51] Int. Cl.[2] ..... D04B 15/66

[58] Field of Search ..... 66/154 A, 60, 64 A, 66/75 A; 340/172.5, 250; 235/151.11

[56] References Cited

UNITED STATES PATENTS

| | | | |
|---|---|---|---|
| 3,035,426 | 5/1962 | MacQueen | 66/75 A |
| 3,141,316 | 7/1964 | McCarthy et al. | 66/154 A |
| 3,783,642 | 1/1974 | Hadam | 66/75 A |
| 3,786,655 | 1/1974 | Krause | 66/154 A |
| 3,805,558 | 4/1974 | Protti | 66/154 A |
| 3,885,405 | 5/1975 | Bartels | 66/154 A |
| 3,896,297 | 7/1975 | Ploppa | 66/154 A |
| 3,896,638 | 7/1975 | Morat et al. | 66/50 R |
| 3,913,353 | 10/1975 | Spencer | 66/75 A |
| 3,913,354 | 10/1975 | Kohler et al. | 66/75 A |
| 3,924,244 | 12/1975 | Morat | 66/154 A |

*Primary Examiner*—Ronald Feldbaum
*Attorney, Agent, or Firm*—Edward L. Bell; Robert E. Smith; William V. Ebs

[57] ABSTRACT

A home knitting machine is provided with electronic control means which function pursuant to patterning instructions on a program card and in response to the operation of row controlling switch means by an operator causing needle actuators on the carriage of the machine to be selectively operated and fabric knitted in a prescribed manner on the machine.

12 Claims, 58 Drawing Figures

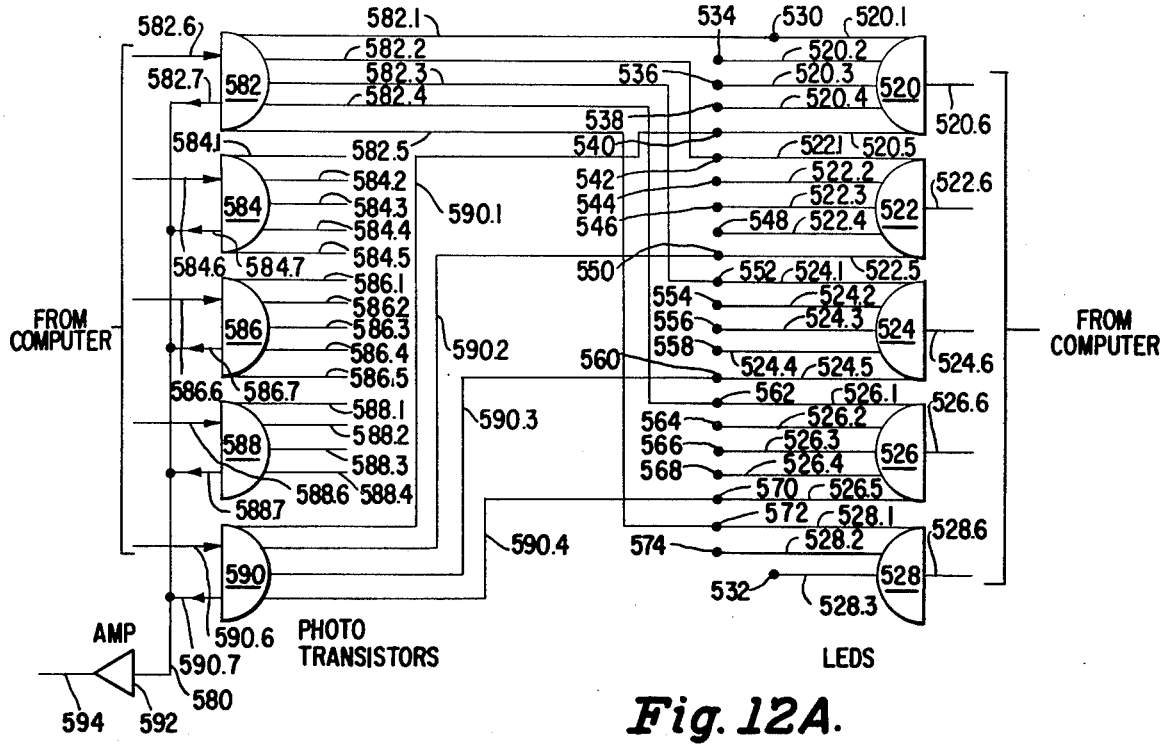
Fig. 12A.
Fig. 12B.
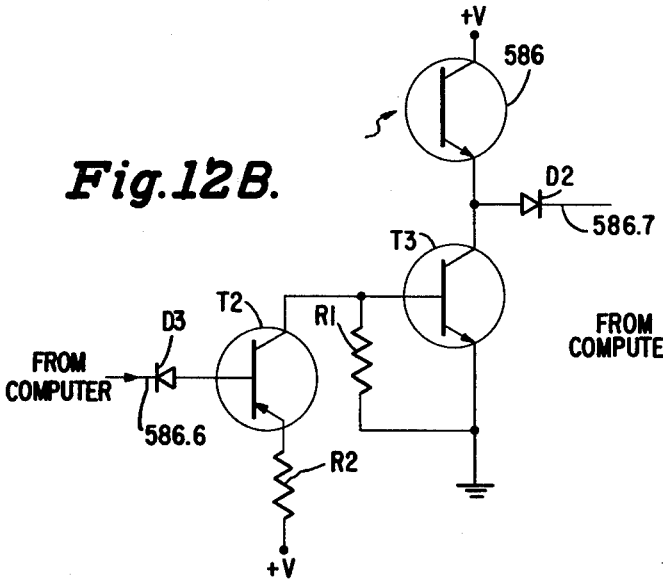
Fig. 12C.
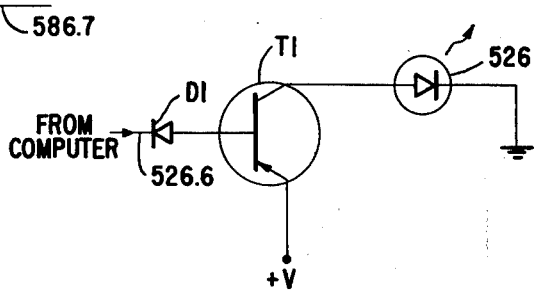
Fig. 12D.
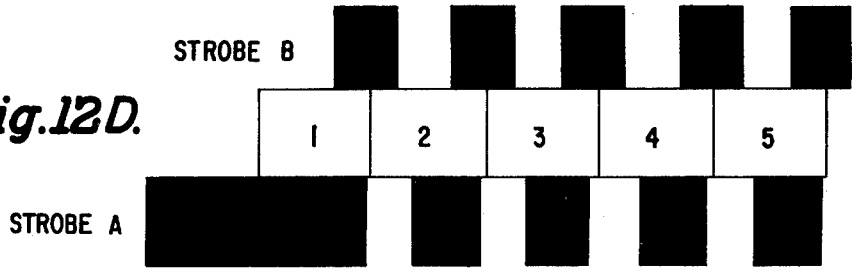

| MODE \ SW. | KNIT | OFF |
|---|---|---|
| OFF | 0 | 0 |
| PROG. | 0 | +5V |
| KNIT | +5V | +5V |

FLOWCHARTING ORGANIZATION

| TYPE | NAME | REF | FIG. NO'S. |
|---|---|---|---|
| SUBPROGRAM | INITIALIZATION | I | 20 |
| SUBPROGRAM | PROGRAM MODE | P | 20–25 |
| SUBPROGRAM | KNIT MODE | K | 26–31 |
| SUBROUTINE | PROGRAM PIP CHECK (PPIPCK) | PP | 32–37 |
| SUBROUTINE | KNIT PIP CHECK (KPIPCK) | KP | 38–40 |
| SUBROUTINE | ROW ADVANCE FORWARD (RADVF) | RF | 41 |
| SUBROUTINE | ROW ADVANCE REVERSE (RADVR) | RR | 42 |
| SUBROUTINE | READ | RE | 43 |
| SUBROUTINE | COLINC/COLDEC | CC | 44–45 |
| SUBROUTINE | ADAPT | AD | 46–47 |
| TABLE | MNEMONICS DEFINITIONS | MD | 48–49 |
| | SUBROUTINE CALL | | |
| | SUBROUTINE ENTRY | | |

*Fig. 19.*

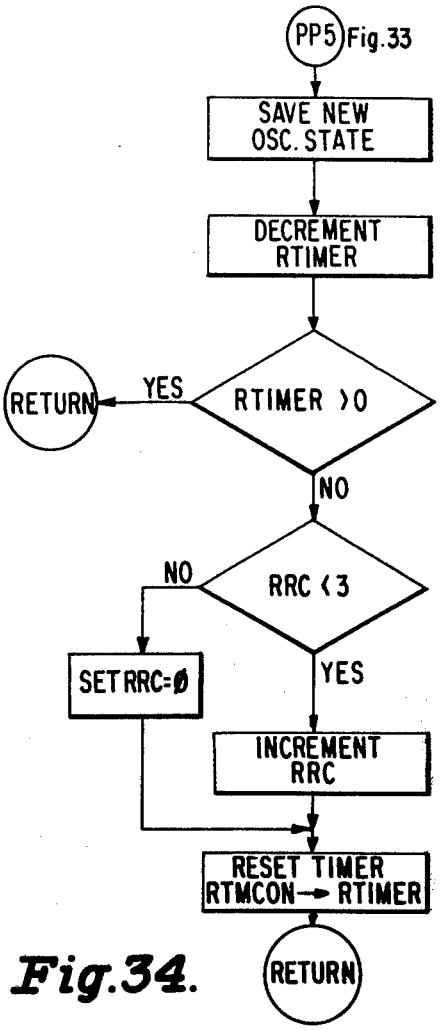
Fig.34.
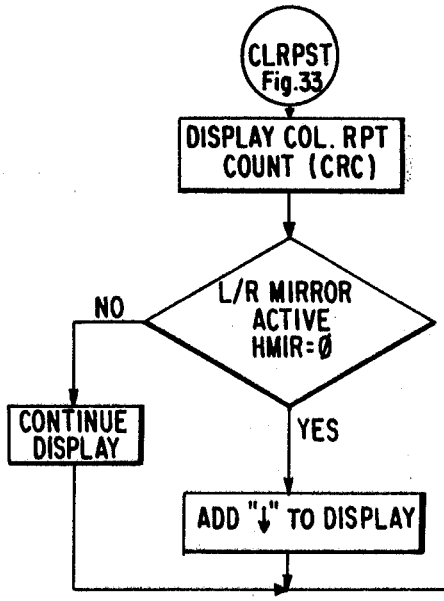
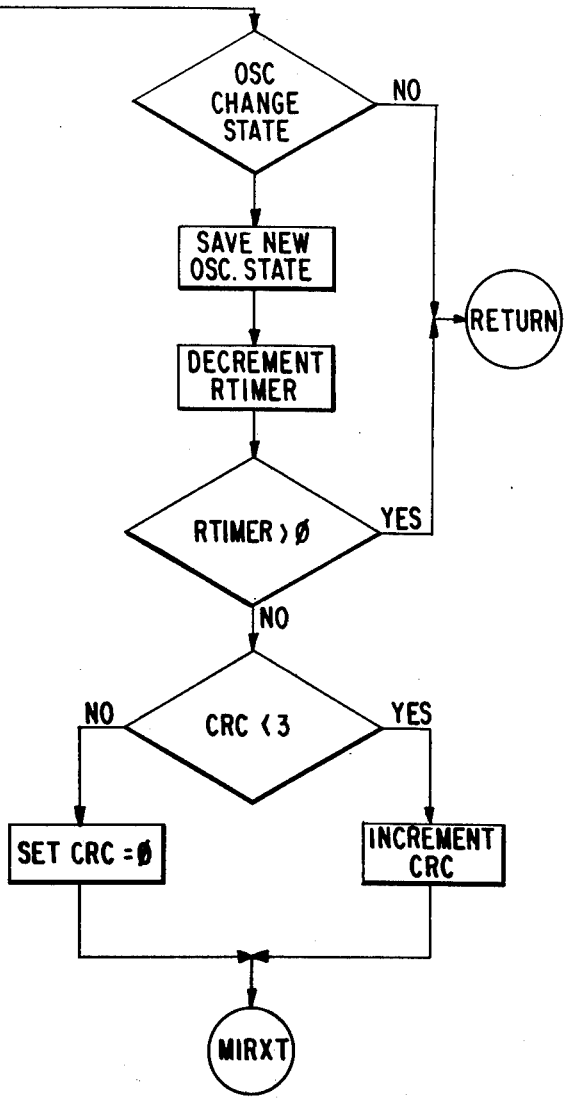
Fig.36
Fig. 35.

BRIEF DESCRIPTION OF
FLAGS, COUNTERS, AND BUFFERS (ALL INITIALIZED TO ZERO)

| | |
|---|---|
| VMIR | VERTICAL MIRROR FLAG |
| HMIR | HORIZONTAL MIRROR FLAG |
| COLEND | COLUMN END (0-35) |
| CRC | COLUMN REPEAT COUNT (0-3) |
| TROWC | TOP ROW COUNT (0-19) |
| RRC | ROW REPEAT COUNT (0-3) |
| SELVC | SELVAGE COUNT (0-5) |
| DIRNOW | CURRENT DIRECTION LEFT=0 |
| DIRFIX | ACTUATING DIRECTION |
| DONFLG | DISPLAY ON FLAG |
| LAST80 | OSC LEVEL (FLASH) |
| CARDOK | VALID CARD READ FLAG |
| NIFLAG | NEEDLE 1 ENTERED FLAG |
| COLPOS | CARD COLUMN (0-37) |
| SALEV | STROBE "A" LEVEL |
| CRCNOW | CURRENT CRC (0-3) |
| COLUMN | KNIT COLUMN (0-35) |
| ALEVEL | PIPA LEVEL (DARK=FFFF) |
| ARROW | UP=1, DOWN=0 |
| RRCNOW | CURRENT RCC (0-3) |
| CROWN | CURRENT ROW NUMBER (0-19) |
| FTIMER | FLASH TIMER |
| RTIMER | TIME BUFFER |
| DBUF1 | 000000D21GFEDCBA (ACTIVE DISPLAY SEGMENT) |
| DBUF2 | 000000000000R1R2R3UP (ACTIVE DISPLAY SEG.) |
| CADJR | COLUMN ADJUST RIGHT |
| CADJL | COLUMN ADJUST LEFT |
| MTIMER | MAN ROW ADV TIMER |
| LAST81 | OSC LEVEL (MAN ADV) |
| LRREV | LRREV FLAG |
| OFF3C | OFF 3 COUNT (-3 TO +82) |
| JAMCHK | JAMCHK FLAG |
| ENBACT | ENABLE ACTUATOR FLAG |
| OFF3F | OFF 3 TIMES FLAG |
| NEWPOS | NEW CAR POSITION FLAG |
| SELVZ | SELVEDGE ZONE (SHIFT ZONE) |
| KBIT | KNIT BIT (ACTUATE=1) |
| MIRNOW | MIRRORING NOW FLAG |
| ATABLE | ADAPT # TABLE |
| DOPTN | FLAG FOR AMBIGUOUS CARD OPTIONS |
| SAFLAG | FLAG FOR FAST CARD READ |
| CHKSUM | DESIGN CHECK SUM |
| REMNUM | DESIGN NO. MODIO |
| PFIRST | PREVIOUS PROG MODE ENTRY |
| CI1 | INITIAL CI SW |
| AR1 | INITIAL AR SW |
| AR00 | ORIGINAL LR MIRROR |
| CRC00 | ORIGINAL CRC |
| STIMER | SELVEDGE UPDATE TIMER |
| LAST82 | SELVEDGE UPDATE OSC LEVEL |
| CIPOS | MOTIF COUNTER AT NI POS |
| SLOWC | NUMBER OF SLOW COUNTS |
| UDBUSY | UP/DOWN IN PROGRESS |
| CSFLAG | CHECKSUM PREVIOUSLY TESTED FLAG |
| ATLAST | LAST ADDRESS IN VARIABLE REGION |

*Fig. 48.*

BRIEF DESCRIPTION OF DATA CONSTANTS

| | | | |
|---|---|---|---|
| ROFFST | DATA | -27 | RIGHT OFFSET |
| LOFFST | DATA | -27 | LEFT OFFSET |
| RMFST | DATA | +27 | RIGHT MOTIF OFFSET |
| LMFST | DATA | -27 | LEFT MOTIF OFFSET |
| CARSIZ | DATA | 66 | CARRIAGE SIZE |
| SLOWN | DATA | X'00C0' | SLOW UPDATE COUNT |
| FASTN | DATA | X'0050' | FAST UPDATE COUNT |

*Fig. 49.*

AUTOMATED HOME KNITTING MACHINE WITH MEANS FOR CONTROLLING THE KNITTING OF DESIGN ROWS

BACKGROUND OF THE INVENTION

1. Field of the Invention

The invention relates to automatic knitting machinery and has particular application to home knitting machines which can be programmed to produce prescribed patterns on a fabric.

2. Description of the Prior Art

Automated home knitting machines are now well known and are exemplified by the machines of the following patents and applications:

U.S. Pat. No. 3,885,405 — issued May 27, 1975

French Pat. No. 2,212,830 — Reg. July 23, 1972

Japanese Application No. 85953, laid open Nov. 13, 1973

Although such machines can be programmed to produce various patterns in knitted fabric, there are a variety of desirable control functions pertaining to the formation of patterned fabric which the existing machines can not be programmed to perform automatically. Furthermore, existing machines do not permit the operator to exercise a large measure of control over the knitting of the fabric after the initial programming. In particular, such machines are deficient with respect to the control which an operator is able to exercise over the knitting of courses of a fabric.

SUMMARY OF THE INVENTION

In accordance with the invention, a programmable home knitting machine is provided with electronic control means, with switch means, and with a display which is rendered responsive to the operation of the electronic control means and/or the switch means in such a manner as to enable an operator to better control the knitting of rows of fabric on the machine. With the switch means, the operator can reverse the direction in which design rows on a program card are knit on the machine, select particular design rows to be knit out of the sequence depicted on the design card and cause a particular design row to be knit repeatedly in successive courses of a fabric. The display informs the operator what is happening with respect to the knitting of design rows as the carriage is moved back and forth on the machine bed and it reflects instructions prescribed by the operation of the switch means.

DESCRIPTION OF THE DRAWINGS

FIG. 12 (A, B and C) are circuit diagrams showing electronic components of the card reader of the machine;

FIG. 12D is a schematic representation indicating the location on the program card of strobe signals with respect to ruled columns in the design area of the card;

FIG. 19 is a listing of computer subprograms and subroutines;

FIGS. 20 through 47 are flow diagrams; and

FIGS. 48 and 49 is a glossary of terms used in the flow charts of FIGS. 20 through 47.

DESCRIPTION OF THE PREFERRED EMBODIMENT

Figures 1, 4:
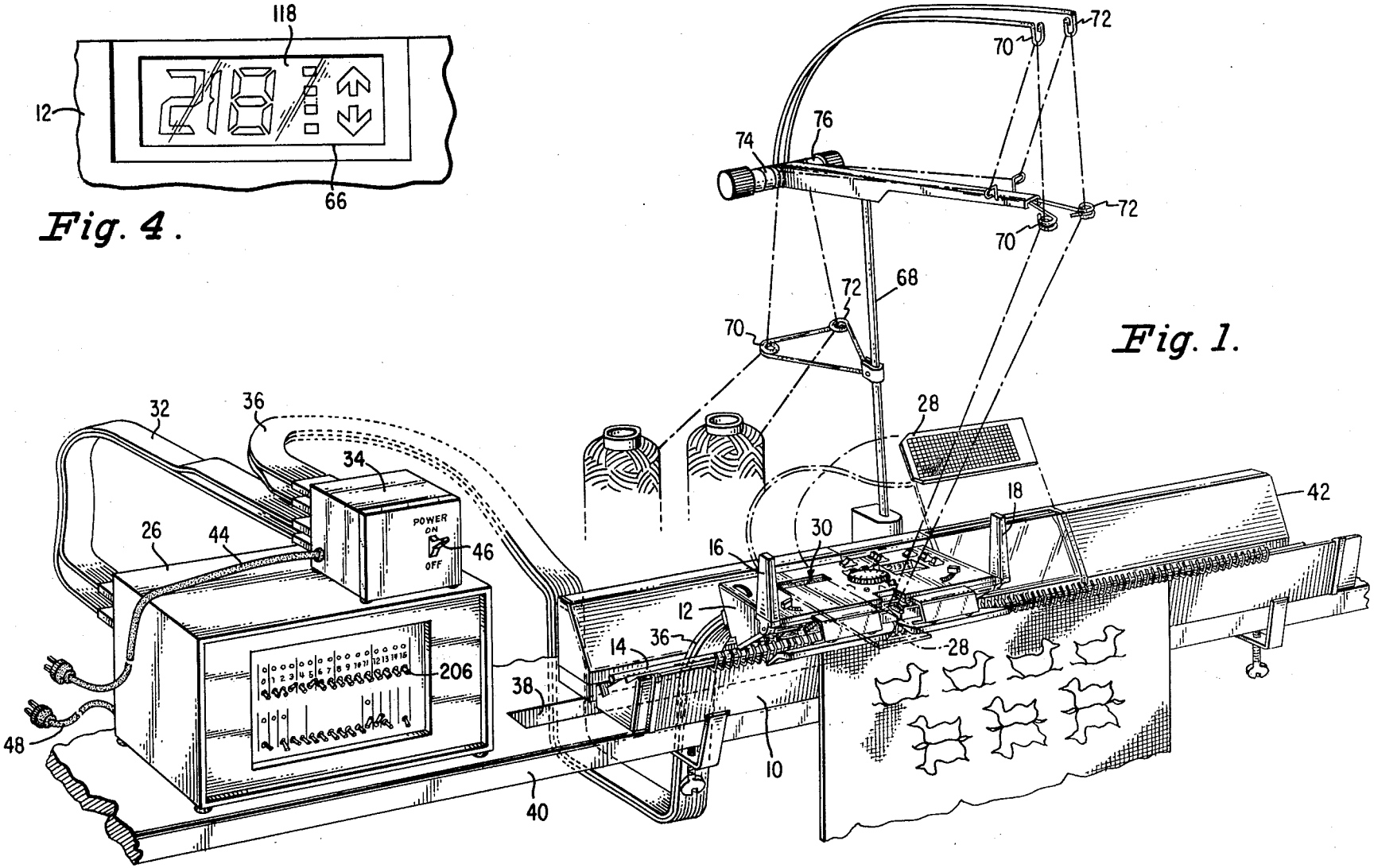
FIG. 1 is a perspective view of an automated home knitting machine embodying the present invention.
FIG. 4 is a face view of a display provided on the carriage of the machine.
Figure 2:
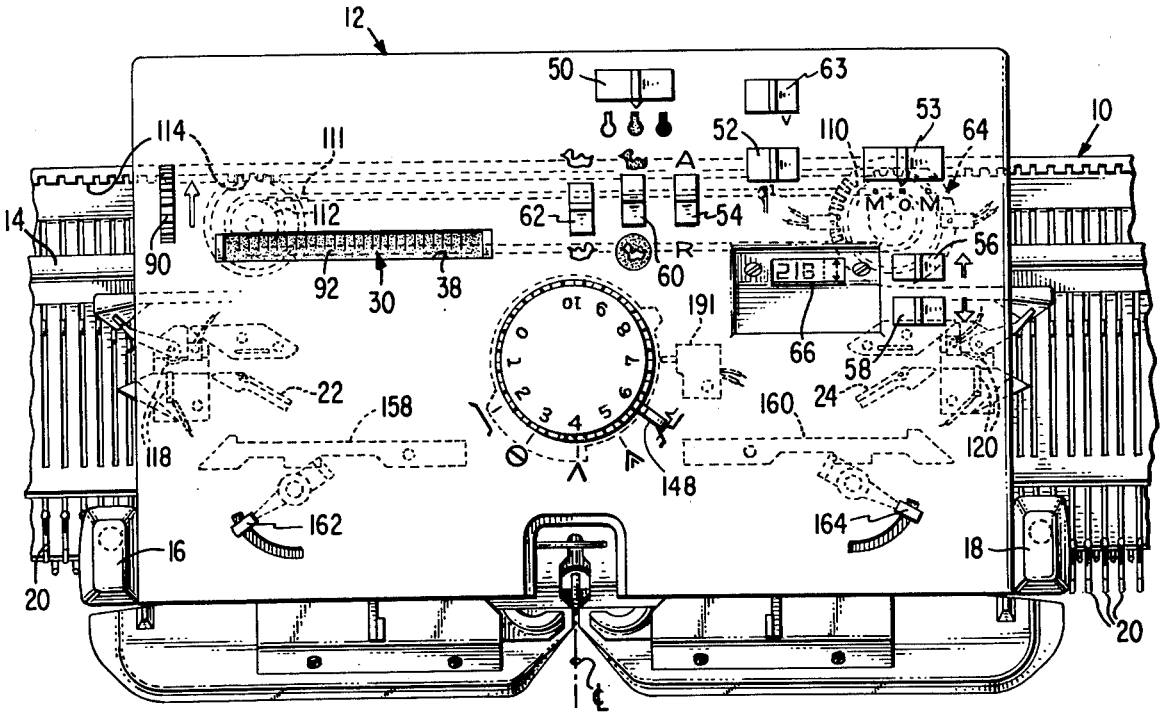
FIG. 2 is a top plan view of the carriage of the machine.

The present invention is embodied in preferred form in the machine of the drawings and is on integral part thereof along with other inventions which are the subject of copending applications bearing Ser. Nos. 627,431 and 627,466 respectively, all filed on Oct. 30, 1975. Referring to FIGS. 1 and 2 of the drawings, reference characters 10 and 12 designate the bed and carriage respectively of such home knitting machine. The carriage is slidably mounted on a guide rail 14 affixed to the bed, and includes handles 16 and 18 which an operator may grasp and utilize to move the carriage back and forth on the bed. Knitting needles 20 are slidably supported in side by side relation in the bed 10 as shown. The carriage includes needle actuating camming hereinafter described and includes left and right electromagnetic actuators 22 and 24 respectively by means of which the needles may be caused to enter one or another of alternate cam paths and knit a single yarn, two different yarns, or a yarn and thread into fabric in a prescribed manner.

A general purpose minicomputer 26, of Texas Instrument Co. P/N Model 960A, programmed as hereinafter indicated, is provided for controlling the needle actuators 22 and 24 pursuant to instructions on a program card 28 as detected by a reader 30 located on the carriage and/or the condition of various electrical switches also located on the carriage. As shown, the computer 26 connects by a multi-wired cable 32 with an input-output box 34 and the input-output box connects by another such cable 36 with the carriage 12. Cable 36 extends through a slot 38 in a table 40 which supports the bed 10 on one side of the slot 38 and a compartmentalized housing 42 for accessories on the other side. The cable 36 is of such length as to permit it to move freely with the carriage 12 as the carriage is moved along the bed. The input-out box includes an input power line 44 and a switch 46 by means of which power supplied over line 44 may be connected to or disconnected from the carriage. Power is supplied to the computer 26 over line 48.

Electrical switches located on the carriage and operatively connected to the computer 26 via input output box 34 include an O.P.K. switch 50, needle one switch 52, motifing switch 53, automatic and row repeat switch 54, row advance 56, row descent switch 58, design inversion switch 60, left-right reverse switch 62 and check-digit switch 63. A pulse generator 64 mounted on the carriage for rotation in timed relation to movement of the carriage and a liquid crystal display 66 on the carriage also operatively connect with the computer 26 via the input-output box 34.

The O.P.K. switch 50 is a three position switch which an operator of the machine may move into one position (O) to turn the machine off, another position (P) to put the machine in a PROGRAM MODE, and still another position (K) to place the machine in a KNIT MODE. The switch remains in whatever position it is place until moved again. Motifing switch 53 is a three position switch similar to switch 50 and has an off position (O) as well as two motifing positions (M+) and (M−). The automatic and row repeat switch 54 is movable into either of two positions (A or R). Design inversion switch 60 and left-right reverse switch 62 are also two position switches. Each of the switches 54, 60 and 62 remains in whatever position it is placed until moved again. The other switches, that is, needle one switch 52, row advance switch 56, row descent switch 58 and check digit switch 63 are on-off switches which remain on only so long as they are depressed. The motifing switch 53, automatic and row repeat switch 54, design inversion switch 60, row advance switch 56, row descent switch 58 and left-right reverse switch 62 are dual function switches in that each serves one purpose when the machine is in the KNIT MODE and another purpose when the machine is in the PROGRAM MODE.

A stand 68, centrally located with respect to ends of the needle bed 10 is provided with yarn guides 70 and 72, and with tension devices 74 and 76 enabling one yarn, two yarns or a yarn and thread to be fed in a controlled fashion to the needles of the machine and to be knit into fabric.

Figure 3:
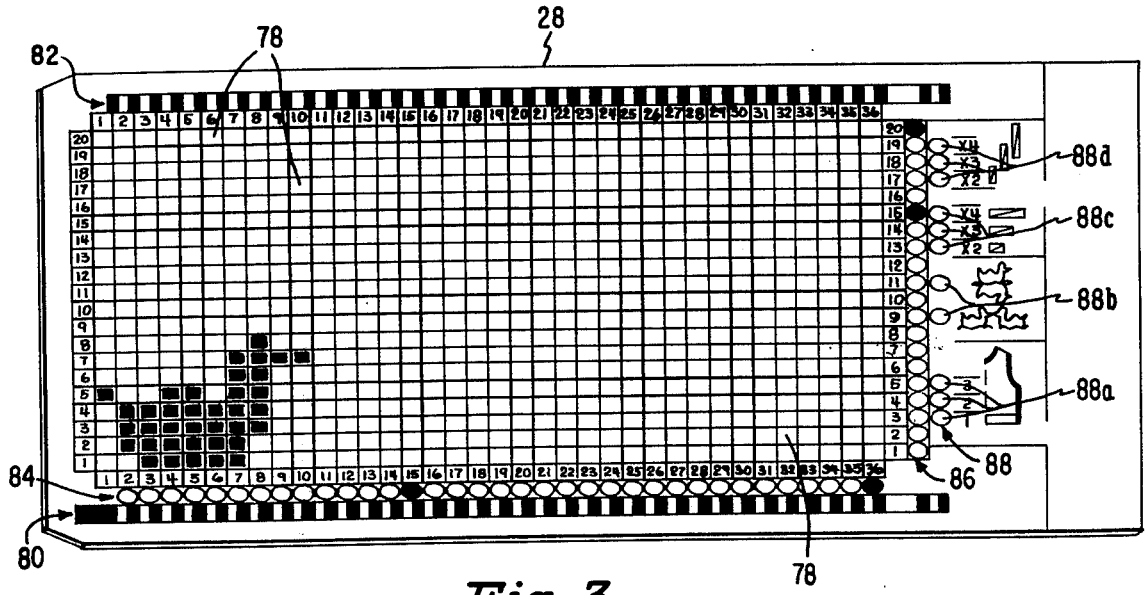
FIG. 3 is a face view of a program card for the machine.

Program card 28 which may be best seen in FIG. 3, is used to instruct the computer concerning the manner in which fabric is to knit on the machine. As shown, the card includes mutually perpendicular lines which define a design area of rectangles 78 that extend in numbered columns (1 through 36) and numbered rows (1 through 20). The rectangles 78 correspond to stitches and the numbered columns and numbered rows to wales and courses respectively which may be knit in a fabric pursuant to instructions on the card. Preferably the width and height of each rectangle 78 are such as to substantially correspond to the width and height of a typical stitch. The card includes two rows of strobe markings 80 (strobe A) and 82 (strobe B), a row of size delineating ellipses 84 aligned with the numbered columns 2 through 36, and a column of size delineating ellipses 86 aligned with the numbered rows all as shown in the drawing. In addition the card includes a column of ellipses 88 in associated with symbolically expressed textless instructions, that is, the ellipses 88*a*, 88*b*, 88*c* and 88*d* having to do with selvedge, mirror imaging, horizontal multiplication and vertical multiplication, respectively.

The reader 30 includes a thumb wheel 90 by means of which the program card may be easily moved through the device after having been inserted in the entrance slot 92 on the carriage. As will be explained hereinafter in more detail, the reader is adapted to detect, as the card moves through it, the strobe marks on the card and any marks made on it by an operator in particular rectangles in the design area or in particular ellipses outside the design area.

As previously noted, the pulse generator rotates in timed relation to movement of the carriage 12. The device (FIG. 9) includes photo-interrupter modules 94 and 96 in association with a toothed disc 98 affixed on one end of a shaft 100. Each module includes a light emitting diode (LED) on one side of the disc 98 and a phototransistor on the other side as shown for the module 94 at 102 and 104 respectively and for module 96 at 106 and 108 respectively. A toothed pulley 110 is affixed to the shaft 100 and a timing belt 111 connects the toothed pulley with a pinion 112 which is rotatable in the carriage and meshes with a rack 114 on the bed 10 of the machine (FIG. 2). As the carriage 12 is moved on the bed, pinion 112 is rotated by reason of its engagement with the rack 114 and the timing belt 111 is caused to drive pulley 110 and shaft 100. Disc 98 is rotated by shaft 100 in synchronism with the carriage and equally spaced teeth 116 on the wheel intermittently interrupt light between the LED and phototransistor in each of the photointerrupter modules causing the modules to produce output pulses. Modules 94 and 96 are so located and the number of teeth 116 on disc 98 is such as to cause module 94 to produce a pulse (FIG. 10A) each time the carriage passes from one needle area of the bed to the next, and module 96 to produce pulses (FIG. 10B) which lead the pulses from module 94 by 90° when the carriage is moved in one direction (to the right) and which lag the pulses from module 94 by 90° when the carriage is moved in the other direction (to the left).

The liquid crystal display 66 (FIG. 4) is comprised of a background plane 118 and fourteen segments which may be turned on selectively to provide meaningful indications to an operator of the knitting machine. One such segment in the shape of the numeral two is located at the left end of the display, and another of the segments, formed as the unit integer is located next to it. Two segments, one in the shape of an arrow pointing upward and the other also in the shape of an arrow but pointing downward, are located at the right end of the end of the display. Four vertically aligned rectangularly shaped elements which define three of the segments (the two centrally located elements being electrically connected to constitute one segment) are located next to the arrows, and seven segments, selected combinations of which can represent any number from zero to nine, are disposed between the three segments formed by the four vertically aligned rectangular elements and the single segment formed as the unit integer.

Figure 5:
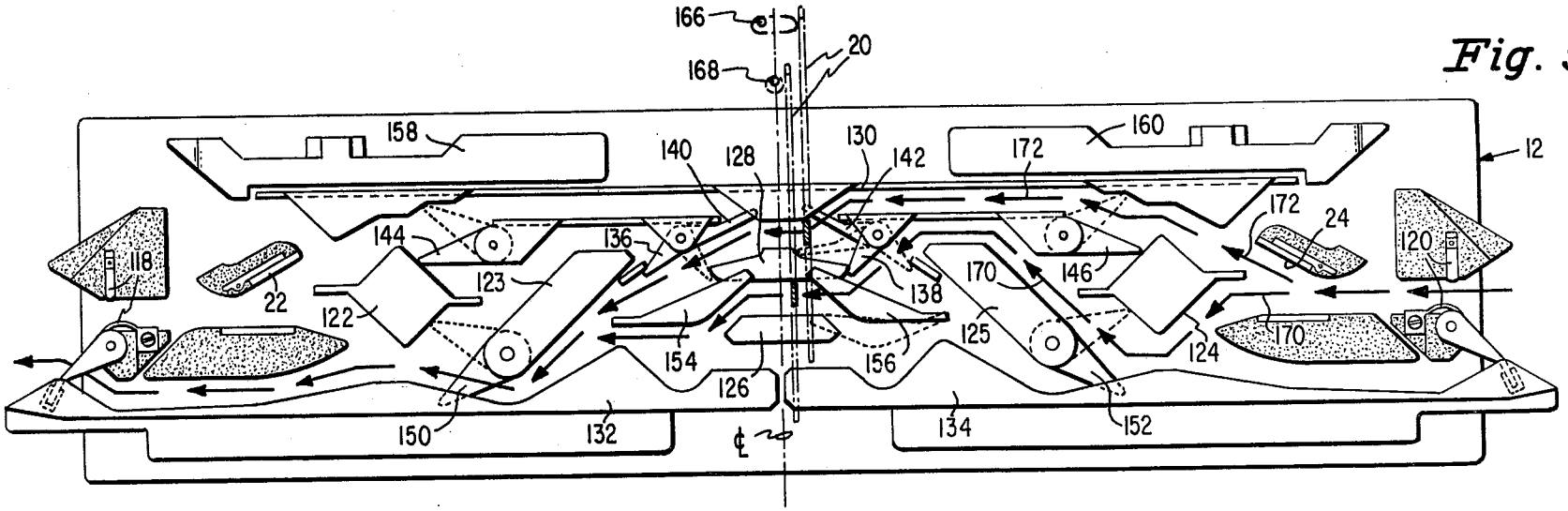
FIG. 5 is a somewhat diagrammatic bottom plan view of the carriage showing needle actuating cams arranged for fair-isle knitting.
Figure 6:
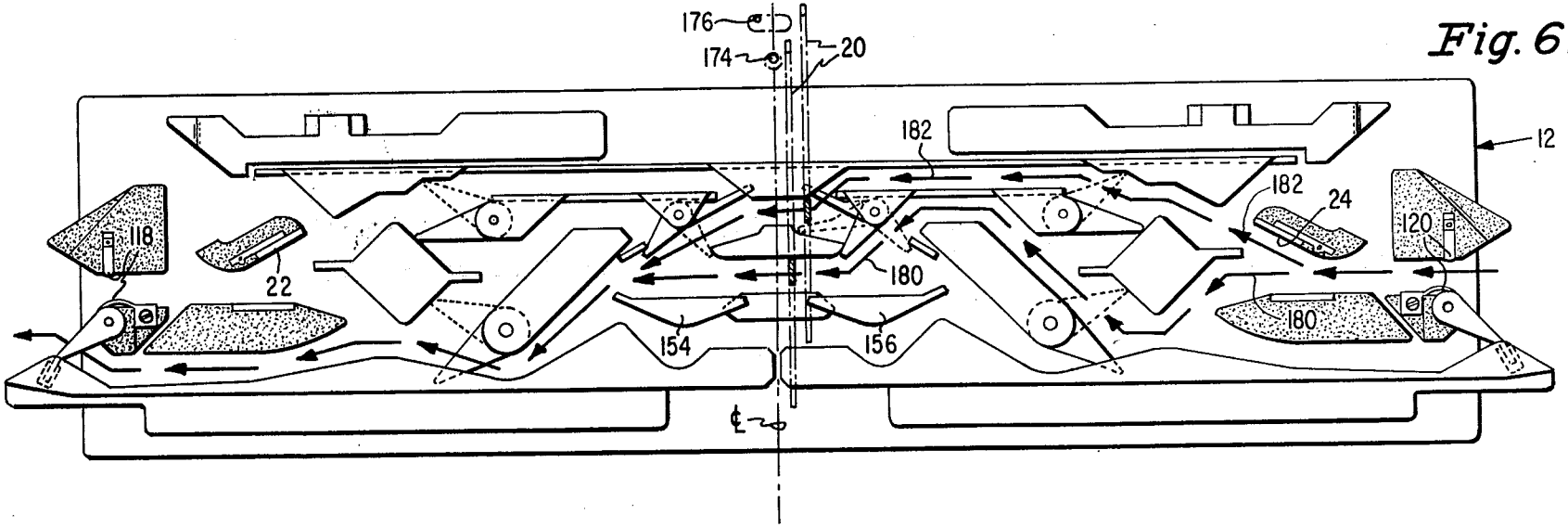
FIG. 6 is a view similar to FIG. 5 showing the camming arranged for punch-lace knitting.

Needle actuating camming is provided in conjunction with the left and right needle actuators 22 and 24, and left and right butt detectors 118 and 120 on the underside of the carriage 12 (FIGS. 5, 6 and 2). Such camming which is symmetrical about the transverse center line of the carriage includes fixed left and right separator cams 122 and 124, knit cams 123 and 125, fixed center cams 126 and 128, fixed upper elongated guide cam 130, fixed left and right elongated lower guide cams 132 and 134, free floating left and right check cams 136 and 138, spring biased left and right gate cams 140 and 142, left and right fair-isle gate cams 144 and 146 adjustable by cam lever 148, left and right knit-tuck gate cams 150 and 152 adjustable by the cam lever 148, left and right knit-in cams 154 and 156 also adjustable by cam lever 148, and russel cams 158 and 160 adjustable by cam levers 162 and 164 all as embodied on Model 321 of a home knitting machine sold by The Singer Co. under its registered trademark "Memo-Matic".

The camming is shown in FIG. 5 with the adjustable cams in positions enabling the camming in conjunction with suitably controlled actuators 22 and 24 to cause the needles 20 as the carriage traverses the bed of the machine to move in a well known manner suited to Fair-Isle knitting wherein two yarns 166 and 168 of different colors are knitted into a pattern. Alternate paths as selectively determined for the needles by the actuators pursuant to instructions specified by an operator of the machine prescribe the particular form of the pattern. The alternate paths for movement of the carriage 12 in the direction indicated as determinable by the one actuator 24 appear at 170 and 172.

In FIG. 6 the camming is shown with the adjustable cams disposed to enable the camming in conjunction with suitably controlled actuators 22 and 24 to cause the needles, as the carriage is moved back and forth on the bed, to knit Punch Lace, in a well known manner, into a pattern prescribed by the operator of the machine with a wool or synthetic yarn 174 and nylon thread 176. Alternate paths for needles through the camming in FIG. 6 as selectively determinable by actuator 24 during movement in one direction is shown at 180 and 182.

With the adjustable cams disposed for either Fair-Isle Knitting or Punch Lace knitting and with the actuators 22 and 24 out of action (i.e. in the absence of control signals to these devices) all needles are caused to follow one path through the camming as the carriage 12 is moved in one direction or another along the bed 10 (in FIG. 5, path 170 for the direction indicated; and in FIG. 6, path 180 which is the same as path 170). The needles in both instances are caused to move in the bed in the same way and Stockinet knitting is performed in a manner well known.

Figure 7:
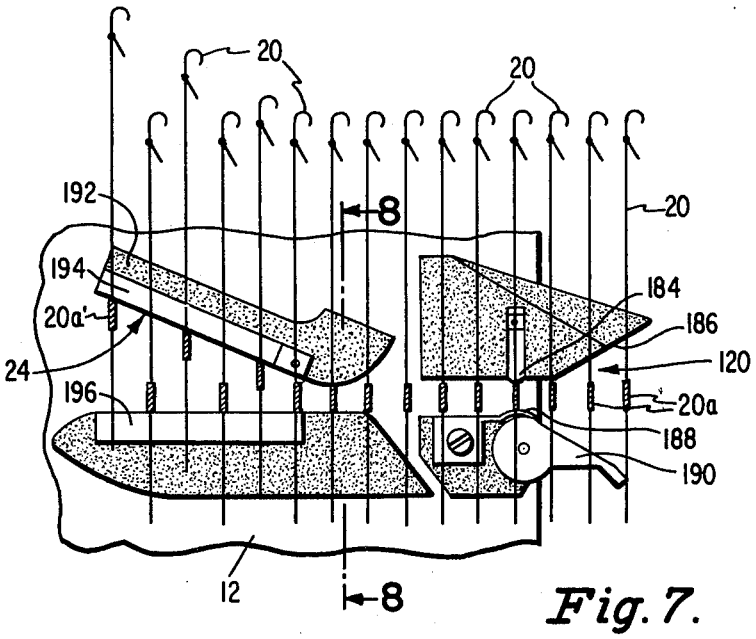
FIG. 7 is an enlarged somewhat schematic fragmentary bottom plan view of the carriage showing an electromagnetic needle actuator and associated needle-butt detector.

Butt detector 120 as may be best seen in FIG. 7 includes a contact element 184 mounted in a fixed cam 186 and another contact element 188 in the form of a spring which in addition to serving as a contact, functions as a biasing means for a side cam 190. The butts 20a of needles 20 passing between cams 186 and 190 successively bridge the gap between contact elements 184 and 188 thereby closing an open circuit between them and causing a signal to be transmitted to the computer 26. Butt detector 118 is similar to and functions in the same manner as butt detector 120.

The width of a fabric to be knitted is defined prior to knitting by an operator positioning those needles which are to be on the fabric in one or more positions on the bed as required for the knitting of the particular cloth such that they can be influenced by the camming in the carriage as it is moved back and forth across the bed, and positioning those needles at opposite ends portions of the bed which are to be off the fabric in positions such that can not be acted upon by the camming in the carrige. For automatic pattern knitting the way in which the needles to be on the fabric are preliminarily disposed is always such that as the carriage is moved on the bed no more than two such needles in succession can pass by the leading butt detector before a needle butt enters the device and is detected. Therefore, regardless of the type of pattern knitting no more than three needle spaces can be traversed by the carriage without a signal from a butt detector before it is certain that the butt detector has reached the end of the fabric. The computer 26 takes note of the absence of three butt detector signals during automatic pattern knitting and causes the actuator to operate so as to cuase needles, beginning with the first of a number of needles to enter the actuator 24 in advance of the first of the three needles missing the butt detector, to knit a plurality of like stitches as selvedge. Cam lever 148 (FIG. 2) which is used in adjusting the carriage camming for Punch Lace Knittig closes a switch 191 when moved into its Punch lace position and causes a signal to be transmitted to the computer 26 effective to provide for the formation of selvedge with both the wool or synthetic yarn and thread (174 and 176 respectively in FIG. 6) used in this type of knitting rather than with the thread alone. One, two or three selvedge stitches as prescribed by the operator may be knit at each edge of the fabric with the machine as shown and described herein.

Figure 8:
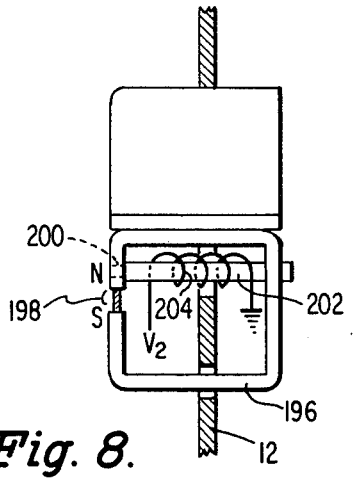
FIG. 8 is a view taken on the plane of the line 8—8 of FIG. 7.

Needle selector 24 (FIGS. 7 and 8) includes a permanent magnet 192 fastened against the upper limb 194 of a C-shaped channel of magnetic material having a lower limb 196. The upper and lower limbs 194 and 196 of the channel define a gap 198 which diverges toward the left as viewed in FIG. 7 and presents north and south magnetic poles as indicated. A hole 200 formed in the upper limb 194 adjacent to the narrowest portion of the gap 198 reduces the strength of the upper or north pole of the opposed magnetic poles as developed by the permanent magnet 192. A magnetizable core 202 is attached to limb 194 and a coil 204 is provided about the core.

Needle butts **20*a* moving through the selector 24 are attracted in the narrowest part of gap 198 to the north pole on the upper limb 194 or the south pole on lower limb 196 depending upon whether or not coil 204 is energized. A deenergized coil causes a needle butt to be drawn to the lower or south pole against limb 196 and to thereafter continue along the limb because of the divergence of the poles. However an energized coil produces a strong electromagnetic pole on the core 202 at the upper limb 194 of the same polarity as that produced by the permanent magnet on such limb and causes a needle butt in the gap 198 to be drawn to the north pole against limb 194. The needle butt thereafter travels along limb 194 because of the divergence of the poles. Needle selector 22 is constructed and functions in the same manner as needle selector 24**.

The knitting machine of the invention is programmed for pattern knitting with the OPK switch 50 in the P position. The card 28 may be used to instruct the machine concerning the pattern to be knit or instructions may be obtained from a pattern preprogrammed into computer 26 by the operator flipping a switch 206 on the computer. The computer may, if desired, be preprogrammed to include a plurality of different patterns each of which may be specified for reproduction upon the operation of an appropriate switch.

Marks in the design area of the card and in ellipses outside the design area define a pattern to be knitted. A preprinted card defining the pattern could be used to instruct the machine but if the operator wishes to prescribe a pattern not preprinted on a card or not stored in the computer he must mark the card 30 with a pencil or other marker (preferably one leaving an erasable mark) as required for the pattern desired.

An operator marks out a design configuration of his own for reproduction in a fabric, as for example the duck on the card in FIG. 3, by selectively darkening rectangles in the design area as shown. Boundaries for a unit design area to be repetitively reproduced each with the design configuration is specified by the operator darkening one of the size delineating ellipses 84 adajcent to a selected numbered column and another one of the size delineating ellipses 86 adjacent a selected numbered row as in FIG. 3. If he inadvertently darkens more than one column aligned ellipse or more than one row aligned ellipse, only the one aligned with the lowest numbered column or row is given effect by the control electronics when the card is read. If no size delineating ellipse is darkened the ellipses adjacent column 36 and row 20 which are preprinted black serve to prescribe the boundaries of the unit design.

In addition to specifying a design configuration on the card and selecting size delineators, an operator may prescribe one, two or three wales to be knit as selvedge with like stitches by darkening one of the ellipses 88*a*, call for mirror imaging of the unit design horizontally or vertically or both by darkening one or both of the ellipses 88*b*, specify a two, three or four fold increase in the unit design horizontally by darkening one of the ellipses 88*c*, specify a two, three or four fold increase in the unit design vertically by darkening one of the ellipses 88*d*. The machine is capable of executing any combination of the instructions pertaining to mirror imaging, multiplication, or selvedge which are not inconsistent due to more than one of the ellipses 88*a*, 88*c* or 88*d* having been darkened.

Instructions on the card are imparted to the machine by feeding the card through the reader 30 with thumb wheel 90. The reader includes various light emitting diodes and phototransistors which are multiplexed into paired relationship as the card passes through the reader, and they serve to detect the presence of marks within the design area defining the design configuration and marks outside the design area whether imprinted on the card as in the case of strobe marks and the delineator marks adjacent row 21 and column 36, or marks added for the purpose of selecting one of the design options (selvedge, mirror imaging, multiplications).

Signals representing the instructions on the card pertaining to the pattern to be knitted as denoted by the marks in the rectangles and ellipses and detected by the reader in conjunction with associated circuitry are transmitted to the computer and retained in memory until recalled to control operation of the actuators 22 and 24 during the knitting of fabric. The manner in which the reader functions to detect markings reliably on the card and the manner in which the computer functions concerning such instruction and others is discussed in detail hereinafter. It is here merely noted that the reader is adapted to recognize reverse movements of the card and control the recording of signals in the computer accordingly so that it is not essential for an operator to painstakingly avoid all reverse movements while feeding a card through the reader, that the reader is further adapted to detect when a skewed card is fed into the reader, that the reader and computer are adapted to determine when a card is fed too fast through the reader for the accurate reading of instructions on the card, that the strobe markings on the card are arranged to maximize the permissable speed of the card, and that the reader and computer are adapted to determine the total number of dark marks on the card.

After the card has been read and while the machine is in the PROGRAM MODE an operator can:

1. Designate a particular needle (needle one) to form column 1 of the unit design on the program card;
2. Specify a motifing sequence;
3. Call for a reversal in the fabric of the left - right orientation of the unit design on the program card.

Such instructions can be prescribed singly or in combination in varying order. Also, the operations specified in 2 and 3 above can, if desired, be performed prior to the reading of a card.

The overall position of the pattern in fabric to be knit on the machine is determined by the needle one selection. The designation is made by the operator moving the carriage 12 to a position wherein its transverse center line is in alignment with a needle to be selected and then momentarily depressing the needle on switch 52. A motifing sequencing is prescribed by the operator moving the carriage across portions of the needle bed with motifing switch 53 in its M− position, the effect of which is to schedule those needles traversed while the switch is so positioned to knit background only and nothing of the design configuration on the program card. By traversing needles with switch 53 in the M+ position, the operator may at any time void any of the selections made with the switch in the M− position. A reversal in the fabric of the left - right orientation of the unit design as it appears on the card is prescribed by the operator setting the left - right reversing switch in its reversing position.

While the machine is in the PROGRAM MODE, the operator can utilize switches on the carriage to prescribe mirror imaging and/or multiplication not called for on the program card, or to override and change such option or options specified on the card. Switch 54 may be so used for horizontal mirror imaging, switch 60 for vertical mirror imaging, switch 58 for horizontal multiplication and switch 56 for vertical multiplication. Switches 54 and 60 which may have been left in the option selecting position prior to the time the O.P.K. switch was moved to the P position must be moved out of that position and returned to it to effect a selection.

A momentary depression of switch 58 causes the display 66 to show, with an appropriate number of its rectangular elements, the horizontal multiplication factor in the computer at that time and continued depression of the switch causes the display to cycle through the multiplication factors. When the switch is released, the multiplication factor in view at the time is retained on the display and that factor is programmed into the computer. A momentary depression of switch 56 causes the display to show an up arrow, and with it rectangular elements the vertical multiplication factor then in effect. Continued depression of the switch causes cycling on the display of the vertical multiplication factors any one of which may be selected for the computer and retained on the display by the operator releasing the switch when the factor appears.

After the machine has been programmed the operator must before proceeding to knit fabric move the O.P.K. switch 50 into the K position to place the machine in the KNIT MODE. Assuming the machine was properly programmed the display 66 will be caused to show at least a 1 standing for row 1 on the design card and either the up or down arrow when the switch is moved to the K position. If the machine was programmed for vertical mirror imaging the down arrow will show, otherwise the up arrow will be displayed. If the machine was programmed for vertical multiplication in a single rectangle will also come into view, otherwise none appear.

Fabric is knit with the machine in the KNIT MODE by the operator moving the carriage back and forth across the bed to actuate the needles. The first course of fabric is knit pursuant to the instructions read from row 1 of the program card, and while the row is being knit the display shows the numeral 1 brought into view when the O.P.K. switch was moved in the K position. Thereafter, higher numbered rows on the card are knit sequentially without repetition up through the highest numbered row of the unit design as delineated on the card (row 15 in FIG. 3), provided the automatic and row repeat switch 54 is in its A position (normal position) and vertical multiplication was not prescribed. After the highest numbered row of the unit design has been knit the rows of the unit design are knit again beginning with row 1 unless vertical mirror imaging was programmed into the computer in which case the rows are knit downward from the highest numbered row of the unit design. After each new row is completed and the carriage has been reversed, as determined by the computer 26 in response to signals from the butt detectors 118 and 120, the display is updated to show the row being knit. The display shows a 1 C during movement of the carriage passes over the needle one position.

The operator can knit a design row out of sequence if he first selects the particular row he wishes to knit with the row advance switch 56 or row descent switch 58. These switches are so operable anytime the carriage is in the KNIT MODE provided the carriage is not in the midst of knitting a course of fabric. With the row advance switch depressed the display steps upwardly from the row showing, slowly at first and then more rapidly, and cycles through the unit design rows on the card. With the row descent switch depressed the display steps downwardly, initially at a slow pace, and then rapidly from the row showing, and cycles through the unit design rows. The operator selects the row he wishes to knit by releasing the row advance or row desent switch when the number of the row he wishes to knit appears. he can then knit the selected row by moving the carriage across the bed of the machine after which the unit design rows will again be knit sequentially as the operator continues to move the carriage on the machine reversing its direction at each end of the fabric, and the display will be updated accordingly to show the row being knit. A momentary depression of switch 56 or 58 causes the display to immediately step up or down one design course row.

The operator can cause a particular row to be knit repeatedly any number of times and the number of the row to be displayed during this process. This is accomplished by the operator moving the automatic and row repeat switch 54 into its R position and leaving it there until he has knit that row the desired number of times.

If vertical multiplication was perscribed, the machine knits each unit design row two, three or four times (as was specified for the multiplication factor) as the carriage 12 is moved back and forth across the bed 10, and the display is caused to show whether a row is being knit for the first, second, third or fourth time with a corresponding number of rectangles. The number of the particular design row being knit at any time is also in evidence on the display.

An operator can, by placing the design inversion switch 60 in the inverting position, reverse the design configuration and background of a unit design being knitted on the machine. He can, for example, change from knitting a black duck on a white background to knitting a white duck on a black background.

With the motifing switch 53 in an off position the unit design is knitted all across the fabric as the carriage is moved on the bed of the machine. However the operator may at any time, by placing the switch in the M+ or M− position, cause the motifing instructions (if any) prescibed in the PROGRAM MODE to be executed as the carriage is moved to knit fabric. With switch 53 placed in the M+ position switch 60 in its inverting position design inversion is effected during knitting only in wales of the unit design. Design inversion if effected in all wales of the fabric with switch 53 in the M− position and switch 60 in its inverting position.

If selvedge stitches were prescribed on the program card, the number of wales designated for selvedge with no pattern are formed in fabric being knitted. If no selvedge was specified on the card and the operator wishes selvedge he may provide for it with switch 62, or if he wishes to change the number of wales of selvedge previously specified he may do so with this switch. Depression of switch 62 causes the number of wales (0, 1, 2 or 3) of selvedge in effect to appear on the display along with the up and the down arrow, and continued depression of the switch causes the display to slowly cycle through all the possible number of wales of selvedge. The operator selects a desired number of wales merely by moving the switch down until that number appears and then reversing it.

Various indications which may be caused to appear on the display 66 have already been mentioned. In addition the display is capable of indicating to the operator the occurrence of certain errors. If the check digit switch 63 is depressed at any time after a program card has been read either while the machine is in the PROGRAM MODE or in the KNIT MODE the display will show only the last digit of the total number of marks within the rectangles and ellipses which were detected by the reader as the card passed through it. A discrepancy between the number of such marks detected and the number on the card suggests to the operator that the card was misread, that he should make any corrections required, as for example, by erasing smudges or darkening some of the marks, and once again (with the machine in the PROGRAM MODE) feed the card through the reader.

When the operator switches the machine from the PROGRAM MODE to the KNIT MODE the letter E for error appears on the display if the program card was read too fast or moved through the reader in a skewed fashion. If the operator failed to make a needle one selection in the PROGRAM MODE, 1 E appears on the display when the O.P.K. switch is moved to the K position. Assuming the card was read properly, the display is caused to show 2 E when the machine is switch to the KNIT MODE if during the PROGRAM MODE an excessive number of design options for horizontal multiplication, vertical multiplication or for selvedge were prescribed. The actuators 22 and 24 will not operate and the machine can not knit patterns while any one of the error indications E, 1 E, or 2E is in evidence on the display. Pattern knitting is possible only after the error is corrected by reprogramming.

While the machine is in the KNIT MODE the display is caused to flash if the power supply drops below a predetermined value somewhat greater than that required to operate the needle actuators 22 and 24 pursuant to programmed instructions. If the power drops further to a value no longer sufficient to operate the needle actuators the display shows a 0.

The operator may switch the machine from the KNIT MODE into the PROGRAM MODE at any time and prescribe some or all new instructions for the knitting of fabric. A new card may be fed into the reader, and/or one or more of the switches effective in the PROGRAM MODE may be operated to prescribe new instructions. Feeding a new card through the reader has the effect of prescribing anew all of the kinds of instructions which may be specified on a card. Instructions previously prescribed by the left - right reverse switch 62 or motifing switch 53 are not affected by the reading of a new card. However, if the operator desires he may use these switches as hereinbefore described to change such instructions. If a new card if fed through the reader or the operator changes the left - right multiplication instructions, left - right reverse instructions or left - right mirror imaging instructions, the old needle one selection is voided and needle one must be reselected. To reselect the old needle one, the operator need only move the transverse center line of the carriage across that needle while in the PROGRAM MODE. To select a new needle 1 he must align the transverse center line of the carriage with the needle to be selected and momentarily depress the needle one switch 52.

Figure 11:
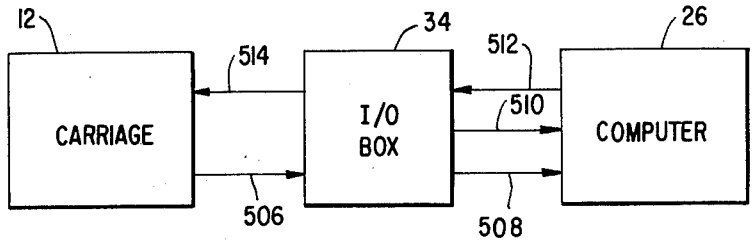
FIG. 11 is a block diagram showing the principal components of the machine and indicating their interrelationship.

A simplified system block diagram of the electrical control portion of the subject knitting machine is shown in FIG. 11 wherein the carriage 12, described hereinabove in conjunction with FIG. 3 is shown in block diagram form. The programmed minicomputer 26, which is described hereinbelow in detail, interacts with the carriage 12 by means of an input-output box 34 (hereinafter referred to as the I/O box 34), bus 506, bus 508, bus 510, bus 512 and bus 514.

Signals generated at the carriage 12, such as by manipulation of the various switches, operation of the card reader 30 and/or by movement of the carriage 12 as described supra, are applied to the programmed minicomputer 26 by way of the bus 506, I/O box 34 and bus 508. As is described hereinbelow in detail, one or more of these signals may be modified within the I/O box 34 before being applied to the programmed coumpter 26. Not all inputs to the minicomputer 26 originate on the carriage. For example, an oscillator (not shown) located within the I/O box 34 provides a real time clock signal for the computer 26 on the bus 510 as will be apparent to those skilled in the art. However, the oscillator can just as well be located in the carriage 12. The signals generated by the computer 26 for controlling the subject knitting machine are applied to the various components of the carriage 12, such as the display 66, card reader 30, actuators 22 and 24 and the like, by way of the bus 512, I/O box 34 and bus 514. As is described hereinbelow in detail, various ones of these signals are acted upon or modified within the I/O box 34.

Before considering the programmed computer 26 in more detail, it will be beneficial to consider the various signals supplied to and provided by the computer 26.

Figure 9:
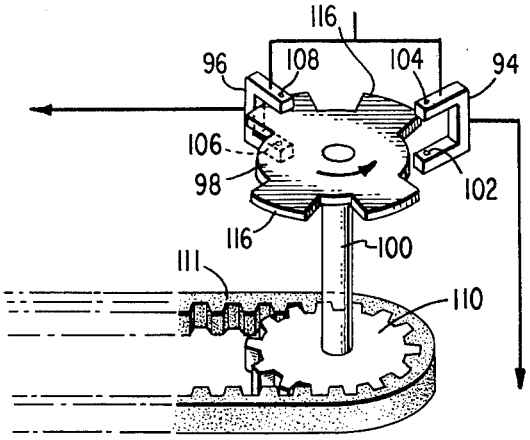
FIG. 9 is a schematic view in perspective of the pulse generator of the machine.
Figure 10:
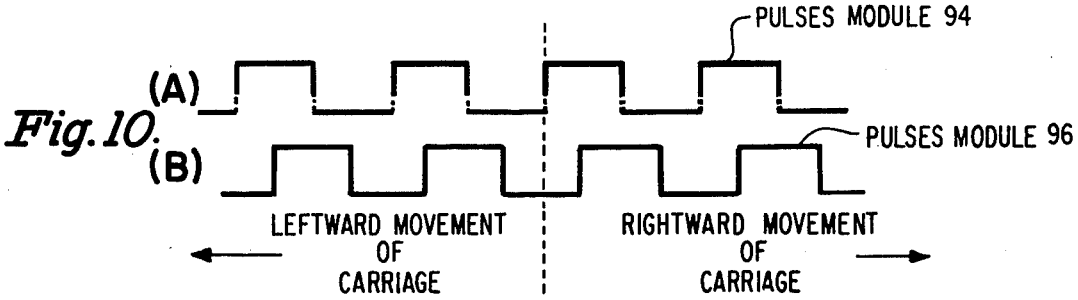
FIG. 10 (A and B) are diagrams showing the signal outputs of components of the pulse generator.

As described supra in conjunction with FIGS. 9 and 10 photointerrupter modules 94 and 96 provide two carriage position indicating signals in quadrature. Hereinafter the signal provided by module 94 will be referred to as PIP A and the signal provided by module 96 will be referred to as PIP B. As discussed above, these signals go through a complete cycle as the carriage 12 traverses each needle position 20. The programmed computer 26 in conjunction with circuits in the I/O box 34 utilizes these PIPer signals A and B to monitor the carriage 12 position on the needle bed 10 and to time the firing of the actuators 22 and 24 (FIG. 2). For example, as the carriage 12 is moved from left to right PIP A will go low while PIP B is high (FIG. 10). The programmed computer 26 senses these conditions to increment an up down counter or register (not shown) located therein to keep track of the carriage 12 location on the needle bed 10. Conversely, when the carriage is moved from right to left PIP A will go high while PIP B is high as shown by a perusal of FIG. 10. The programmed computer 26 will sense these conditions to decrement the counter or register (not shown) within the computer 26. When the subject knitting apparatus is first turned on, the computer 26 will assign the number zero to the then current carriage position and then increment or decrement this count as the carriage is moved to the right or left to keep track of the location of the carriage 12 on the needle bed 10 at all times. Incrementing or decrementing, i.e., updating of the carriage 12 position counter (not shown) within the computer 26 takes place with PIP A undergoes a transition and PIP B is low. Once the carriage 12 position counter (not shown) has been updated, the programmed computer 26 will determine if an actuator 22 or 24 is to be fired when the carriage 12 is in the current position on the needle bed 10. An actuator 22 or 24 is fired only when PIP B is high and PIP A undergoes a transition from high to low or low to high. To insure proper operation when patterning data is entered and when needle one is designated, it is necessary to adjust the position of the photo-interrupter modules 94 and 96 so that the carriage position counter (not shown) updates occur when the carriage 12 center is over a sinker; i.e., when the carriage 12 center is halfway between needle positions.

As described above, knitting design information is entered into the computer 26 by means of the card reader 30. As described above in conjunction with FIG. 3 strobe channels A and B are located at opposite sides of the program card 28. For purposes of clarity, those strobe channels are illustrated in FIG. 12D as being adjacent a single information row on the program card 28 in order to show their phase relationship and their location with respect to the various columns of information on the program card 28. As shown by FIG. 12D the strobe channels A and B comprise alternating black and white (card background) protions with the first black segment in strobe channel A being of extended length. Like the PIPer signals A and B discussed above, the strobe channels A and B are in quadrature; i.e., 90° out of phase. Additionally, one complete strobe cycle is associated with each of the columns on the program card 28.

When moving from right to left as seen in FIG. 12D, strobe A will go from black to white while strobe B is black. Conversely, when moving from left to right, strobe A will go from white to black while strobe B is black. The programmed computer 26 can sense these changes to determine whether the program card 28 is passing through the card reader 30 or being withdrawn therefrom. In accordance with the present invention, as strobe A goes from black to white while strobe B is black the program card 28 information in the associated information column is read and a column count register (not shown) or a column up-down counter (not shown) within the computer 26 is incremented. Conversely, when strobe A goes from white to black while strobe B is black, the column count is decremented and no column information is read. The program card 28 information read time occurs during the white portion of strobe A. As illustrated in FIG. 12D, strobe A goes white over the far right hand portion of column one and extends over the left portion of column two. Because the strobe A and B sensing devices are located to the right of the card information sensing devices, as is described below in conjunction with FIG. 12A, the information sensing device will be located in the left portion of column one when strobe A first goes from black to white and will be located in the right portion of column one when strobe A subsequently goes from white to black. The same it true of the remaining columns of the program card.

The electrical portion of the card reader 30 is illustrated in FIG. 12A as including twenty-one design information reading stations 534–574 corresponding to the twenty-one rows on the program card 28. As will be apparent, more or less than the twenty-one design information reading stations 534–575 can be utilized depending upon the layout of the program card 28. Located above and offset to the right of the design information reading stations 534–574 is a strobe B reading station 530, while located below the information reading stations and offset to the right is a strobe A reading station 532. The twenty-three illustrated reading stations 530–574 are activated by means of five light emitting diodes 520, 522, 524, 526 and 528 and five phototransistors 582, 584, 586, 588 and 590 which are interconnected by means of a plurality of light pipes to form a matrix.

Any one of the light emitting diodes (LED's) 520, 522, 524, 526 and 528 can be enabled by means of a signal supplied by the computer 26 appearing on leads 520.6, 522.6; 526.6 or 528.6, respectively. Each of the first four of the light emitting diodes 520, 522, 524 and 526 are coupled to five consecutive reading stations by means of light pipes. For example, light emitting diode 520 is coupled to the first five reading stations 530 (strobe B), 534, 536, 538 and 540 by means of the light pipes 520.1, 520.2, 520.4 and 520.5. The next light emitting diode 522 is coupled to the next five reading stations 542, 544 546, 548 and 550 by means of the light pipes 522.1, 522.2, 522.3, 522.4 and 522.5, respectively. The next two light emitting diodes 524 and 526 are connected to five consecutive reading stations in a like manner. Since a total of 23 reading stations are utilized, only three reading stations 572, 574 and 532 (stobe A) are associated with the fifth light emitting diode 528.

Any one of the phototransistors 582, 584, 586, 588 and 590 can be enabled by means of a signal supplied by the computer 26 appearing on leads 582.6, 584.6, 586.6, 588.6, or 590.6, respectively. The output signal from each phototransistor 582, 584, 586, 588 and 590 appearing on leads 582.7, 584.7, 588.7, and 590.7 respectively, is connected to a common output lead 580, amplified by an amplifier 592 and applied to a comparator 596 (FIG. 13) by way of lead 594. Each of the phototransistors is coupled to a corresponding one of the five reading stations associated with each of the first four light emitting diodes 520, 522, 524 and 526 by means of a plurality of light pipes. For example, the first phototransistor 582 is coupled to the first reading station 530 (strobe B) associated with the light emitting diode 520, the first reading station 542 associated with the light emitting diode 522, the first reading station 552 associated with the light emitting diode 524, the first reading station 562 associated with the light emitting diode 526 and the first reading station 572 associated with the light emitting diode 528 by means of the light pipes 582.1, 582.2, 582.3, 582.4, and 582.5 respectively. In a like manner the second phototransistor 584 is coupled to the second reading station 534, 544, 554, 564, and 574 of each of the light emitting diodes 520, 522, 524, 526, and 528 respectively; with the third phototransistor 586 being coupled to the third reading station 536, 546, 556, 566 and 532 (strobe B) associated with each light emitting diode; the fourth phototransistor 588 being coupled to the fourth reading station 538, 548, 558 and 568 of the first four light emitting diodes and the fifth phototransistor 590 being coupled to the fifth reading station 540, 550, 560, 570 associated with the first four light emitting diodes. Since light emitting diode 528 has only three reading stations associated therewith, phototransistors 588 and 590 are not coupled thereto. For purposes of clarity in the drawing, the coupling of the light pipes to the appropriate reading stations for the second, third and fourth phototransistors 584, 586 and 588 is not illustrated.

As will now be apparent, enabling one of the phototransistors 582, 584, 586, 588 or 590 and enabling one of the light emitting diodes 520, 522, 524, 526 and 528 will result in only one of the reading stations 530–574 being read out. For example, enabling phototransistor 590 and light emitting diode 522 will cause a read out from reading station 550 while enabling phototransistor 590 and light emitting diode 526 will cause a read out from reading station 570. In accordance with the present invention, the strobe channels B and A on the program card will be sequentially sampled under control of the computer 26 by sequentially enabling phototransistor 582 — light emitting diode 520 and phototransistor 586 — light emitting diode 528. When design information is read out, the information reading stations 534–574 will be enabled in sequence under control of the computer 26 during the time that strobe A is white. As will now be apparent, operation of the reader causes a serial data train to appear on the output lead 594.

Figure 13:
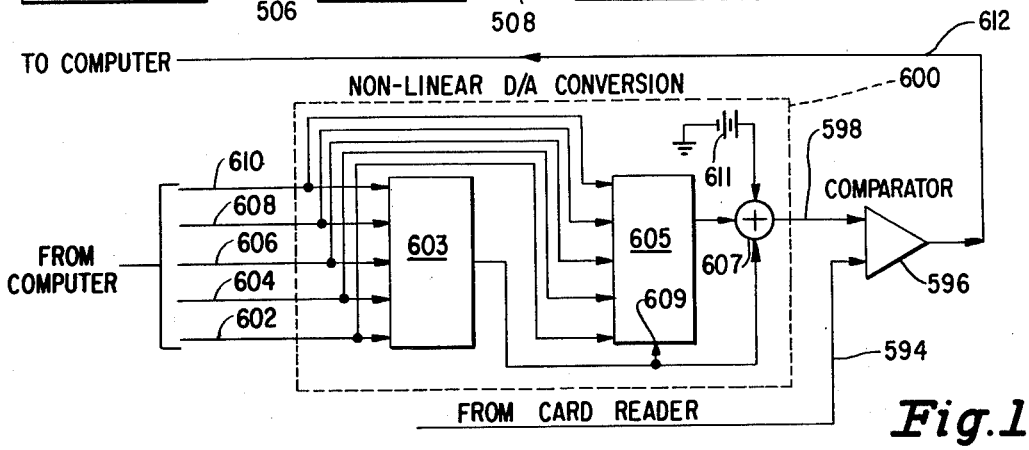
FIG. 13 is a circuit diagram showing a digital adapter and thresholding circuit components associated with the reader.

Before describing the computer 26 controlled card reader 30 in more detail, the digital adapter shown in FIG. 13 will be considered. The adapter includes a comparator 596 the output of which is coupled to the computer 26 by way of a lead 612. One input to the comparator 596 appears on the lead 598 as the output of a non-linear digital to analog conversion unit 600. The other input to the comparator 596 is the serial output from the phototransistors 582, 584, 586, 588 and 590 of FIG. 12A appearing on lead 594. The input to the digital to analog conversion unit 600 is a five bit binary number supplied by the computer 26 on leads 602, 604, 606, 608 and 610. In one embodiment of the present invention the digital to analog conversion unit 600 used a first digital to analog converter 603, the output of which was fed to the multiplying or scaling input 609 of a second analog converter 605 to produce a quadratic output input dependence. Furthermore, the original linear output of the first converter 603, the quadratic output of the second converter 605, and a constant voltage 611 were then summed in a suitable device 607 to give a parabolic approximation to the desired exponential dependence of the analog output to the digital input. In accordance with one embodiment of the present invention which was constructed, the digital to analog converters 603 and 605 were Motorola MC 1408 digital to analog converters.

The operation of the comparator 596 is such that a voltage level on lead 594 which is greater than that appearing on lead 598 causes the output on lead 612 to be low. However, as the voltage level appearing on lead 598 increases, such as by increasing the value of the binary number applied to the digital to analog conversion unit 600, the output on output lead 612 will go high when the voltage level on the lead 598 exceeds that appearing on lead 594. When this occurs, the computer 26 will store the current binary number. Any potential level thereafter appearing on lead 594 can be compared to this digitized value by applying this stored binary number produced by the previous level to the digital to analog conversion unit 600 and monitoring the output level on lead 612 which will indicate whether the current voltage level on lead 594 is greater or less than the previous level. The function of the digital adapter shown in FIG. 13 will become apparent from the description of the program card reader hereinbelow.

As is known to those skilled in the art, the input-output function of a digital to analog converter is linear. In one embodiment of the present invention, as described above, the input-output function was caused to be parabolic as a simple approximation to a preferable exponential function.

Briefly described, the opposite strobe channels A and B of the program card 28 are utilized by the card reader 30, under control of the computer 26, to determine the position of the program card within the card reader. Initially, however, when the program card is first entered into the card reader 30, two of the information channel reading stations are used to detect the presence of the program card edge. Two spaced apart reading stations are utilized to insure that the program card is properly located within the card reader before the card is adapted. Once the card edge is sensed, the computer 26, by means of the digital adapter of FIG. 13, will measure and record the signal level at the strobe A reading station 532, which is over the white border of the program card due to the strobe A reading station 532 being located to the right of the information reading stations 534–574 (FIG. 12A), i.e., located closer to the card entry location of the card reader than the information reading stations. The program card is printed such that when the extended length black portion (FIG. 12D) of strobe channel A is detected, the information channel reading stations 534–574 and strobe channel B reading station 530 are located over the white border of the program card (FIG. 3). The computer 26 by means of the digital adapter of FIG. 13, will measure and record the signal level for each information channel 534–574 and strobe B at the white border of the program card. Before being stored, each digital value is appropriately decreased to prevent smudges and erasures from being read as black marks. As the program card advances into the card reader 30, the computer 26 keeps track of the number of columns on the program card passing the information reading stations 534–574. Each time strobe A changes from black to white (FIG. 12D) the column count is incremented by the computer 26 and the information in each information row is read out in sequence and applied to the digital adapter of FIG. 13. If the reading from an information channel is sufficiently lower than the border reading previously recorded, the reading is recorded within the computer 26 as black; if not, it is recorded as white. Light smudges are thus read as white. The program card 28 is considered to have been read without error if all columns of information are read and stored in the computer 26 before the program card 28 is withdrawn from the card reader.

More specifically, when the subject knitting apparatus is placed into the PROGRAM MODE, a computer 26 selected reading station 574 (FIG. 12A) corresponding to row zero on the program card is enabled to read the "black" platen of the card reader 30. The platen is fabricated with depressions and/or coated to minimize the signals produced. The computer 26 will vary the binary number applied to the digital to analog conversion unit 600 (FIG. 13) until the voltage level on lead 598 to the comparator 596 equals that appearing on lead 594 supplied by information reading station 574. To insure that false background noise does not provide an erroneous indication, this binary number is increased by two. For example, if a binary number of twenty is equivalent to the voltage level appearing on lead 594, the binary 20 is increased to binary 22 by the computer 26 to decrease the threshold sensitivity and binary 22 is stored within the computer 26. This process is repeated at information reading station 534 corresponding to row twenty on the program card 28. The computer 26 will then maintain reading station 574 enabled and the input to the digital to analog conversion unit 600 at the digitized value, i.e. a binary 22. Referring now to FIG. 12A, a program card 28 placed into the card reader will approach the reading stations 530–574 moving from right to left. When the edge of the card reaches the reading station 574 corresponding to information row zero on the program card the voltage level appearing on lead 594 to the comparator will greatly increase, due to the white background of the program card 28, thereby changing the output level appearing on the lead 612 to the computer 26. This level change is recognized by the computer 26 as the program card 28 edge at the information reading station 574. The computer 26 then enables reading station 534 and applies its adapted digitized number to the digital to analog conversion unit 600. Detection of the edge of the program card 28 at reading station 534 is interpreted by the computer 26 as meaning that the program card 28 is properly located within the card reader 30 and the next step in reading of the program card can commence.

Since the strobe A and B reading stations 532 and 530, respectively, are offset to the right, as shown in FIG. 12A, they are now well over the white border portion of the program card. The computer 26 will now enable the strobe A reading station 532 by enabling light emitting diode 528 and phototransistor 586. The white background of the program card 28 adjacent to strobe A produces a corresponding voltage level on lead 594. The digital equivalent of this analog voltage level is determined as described above. The resulting digital number is decreased by two to make it slightly more difficult to see black; i.e., decreasing the threshold sensitivity of strobe channel A. The resulting binary number is stored in the computer 26. Strobe channel A has now been adapted. When monitoring strobe channel A, the stored binary number is recalled and applied to the comparator 596 lead 598 after conversion by the digital to analog conversion unit 600. A voltage level on lead 594 to the comparator 596 from strobe A reading station 532 produces a level output on lead 612 recognized by the computer 26 as "white" if the voltage level on lead 594 is greater than the level appearing on lead 598 and is recognized by the computer 26 as "black" if it is less due to the resulting different level output on lead 612 (FIG. 13). The Strobe A reading station 532 remains active under control of the computer 26 until strobe A becomes black and this is sensed as described above. This corresponds to the left portion of the extended length black portion of strobe A (FIG. 12D) appearing at the reading station 532. At this time the computer 26 will check reading station 574 corresponding to row zero of the program card. If the reading is black, the program card 28 has been pulled out of the card reader 30 and the whole process will begin again. However, if the reading is white, the card is moving into the card reader and all the remaining reading stations 532–574 are well over the white border portion of the program card. The computer 26 will now sequentially adapt each information row on the program card, and strobe channel B in a manner as described above. Once this has been completed, the computer 26 will have stored therein the threshold adjusted adapted binary numbers for each strobe and information channel on the program card 28 which were obtained as discussed above. As described, these stored numbers are recalled by the computer 26 and applied to the adapter apparatus shown in FIG. 13 to read a particular row information as black or white.

The computer 26 will now monitor strobe channels A and B by sequentially enabling strobe reading stations 532 and 530 and determining whether they are black or white. When strobe A goes white (see FIG. 12D) the computer 26 will check if strobe B is also white. If it is, the computer 502 will recognize that the program card 28 is being pulled out of the card reader 30. If strobe B is black, however, the program card 28 is continuing through the card reader 30 and the computer 26 will increment the column count therein by one and begin to read the rows of information contained in the first column. This is done by the computer sequentially enabling the information reading stations 534–574 by enabling the appropriate light emitting diodes 520–528 and phototransistors 582–590. The stored adapted binary number for each channel is sequentially recalled to the ditital to analog conversion unit 600 and compared with the voltage level on lead 594 to determine whether the information is white or black. The data from each row in each column is stored in a memory (not shown) contained within the computer 26. The locations of each row being read in the column is controlled by the computer 26 maintaining a row count therein.

After all the rows in the first column have been read and stored in the computer 26, the computer 26 will check strobe A; if it is white the column read is considered valid. If column A is black, however, the card 28 may have been traveling too fast through the card reader 30 (see FIG. 12D) and a flag is set by the computer 26 to abort the column read. This results in an error indication appearing on the display 66 at the conclusion of the card read operation as described above when appropriate switches are depressed. If the column read is successful, the computer 26 will continue to monitor strobe channels A and B. When strobe A goes white while strobe B is black, the column count will be incremented and the rows of information read and stored as described above. This process will continue until all of the columns of the program card 28 have been read. This will be recognized by the computer 26 by the column count therein being equal to the number of columns on the program card 28. During the reading of the last column on the program card 28, the computer 26 will check for any ambiguities that may be present in the design options selected. For example, only one of the horizontal magnification options can be selected at one time. Additionally, should an operator attempt to place the subject knitting apparatus into the knitting mode while a program card is being read, the computer 26 will recognize this error and cause an error indication to appear on the display 66 as well as turning off the left and right actuators 22 and 24.

A typical circuit for the light emitting diodes 520, 522, 524, 526 and 528 of FIG. 12A is shown in FIG. 12C wherein light emitting diode 526 is illustrated as being coupled between ground potential and the collector of a PNP transistor T1. Transistor T1 has its emitter coupled to a positive source of potential and its base coupled to the computer 26 controlled input lead 526.6 by means of a diode D1. In the absence of a negative potential on lead 526.6 from the computer 26, transistor T1 is nonconducting and light emitting diode 526 is disabled. The presence of a negative potential on lead 526.6 from the computer 26, however, causes transistor T1 to conduct which in turn enables the light emitting diode 526.

A typical circuit for the photo transistors 582, 584, 586, 588 and 590 of FIG. 12A is shown in FIG. 12B wherein phototransistor 586 is illustrated as having its collector coupled to a source of positive potential and its emitter coupled to ground potential by way of the collector-emitter of NPN transistor T3. The output of phototransistor 586 is coupled to the output lead 586.7 by means of a diode D2. The base of transistor T3 is coupled to ground by means of a resistor R1 and to the collector of a PNP transistor T2 which has its emitter coupled to a source of positive potential by way of a resistor R2 and its base coupled to the computer 26 controlled input lead 586.6 by way of a diode D3. In the presence of a negative potential on lead 586.6 from the computer 26, transistor T2 is conducting, which causes transistor T3 to be conducting, thereby back biasing diode D2 and passing any output from phototransistor 586 to ground. Accordingly, no signal will appear on output lead 586.7. In the absence of a negative potential on input lead 586.6 from the computer 26, however, transistor T2 will not conduct thereby rendering transistor T3 nonconducting such that diode D2 is no longer back biased and any output from the phototransistor 586 now appears on output lead 586.7 by way of the diode D2.

Figure 14A:
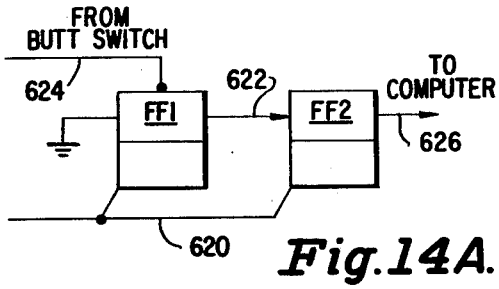
FIG. 14A is a circuit diagram showing the electronic components of needle butt circuitry.
Figure 14B:
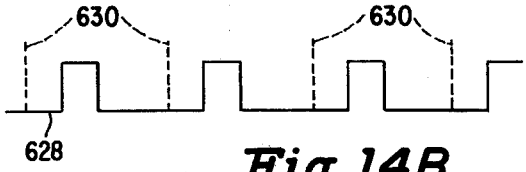
FIG. 14B is a wave shape diagram illustrating the operation of the circuitry of FIG. 14A.

As described hereinabove, the location of each edge of a garment in the subject knitting apparatus is detected by means of butt detectors 118 and 120 (FIGS. 2,5,6, and 7). Electric circuitry located in the I/O box 34 and associated with the butt detector 120 is illustrated in FIG. 14A as including a first flip-flop FF1 which is coupled to the butt switch contacts by means of a lead 624. The input of a second flip-flop FF2 is coupled to the output of the first flip-flop FF1 by way of a lead 622 and the output of the second flip-flop FF2 is coupled to the programmed computer 26 by way of a lead 626. A clock signal is applied to each of the flip-flops FF1 and FF2 by means of a lead 620. Each of the flip-flops FF1 and FF2 may be a well known D type flip-flop. The clock signal on lead 620 is illustrated in FIG. 14B as the waveshape 628 and is obtained by AND gating the PIP B signal and an inverted PIp A signal when going from left to right. The time occurence of signals resulting from actuation of the butt switch 120 is illustrated in FIG. 14B by the vertical dashed lines 630. As shown the clock signal becomes high sometime after the butt switch 120 actuation position is passed and will become low before a needle 20 can again contact the butt switch 120 at the next position.

Referring now to FIGS. 14A and 14B and assuming that the carriage 12 is moving from left to right, prior to detecting the edge of a garment in the knitting apparatus no signals appear on lead 624 so that both flip-flops FF1 and FF2 are reset by the first positive occurring clock signal 628. The resulting low output on lead 626 from the second flip-flop FF2 is recognized by the computer 26 as indicating that the edge of the garment has not yet been reached. When the edge of the garment is reached, a needle 20 butt will actuate the butt switch 120 causing a signal to appear on lead 624 that sets flip-flop FF1. The next positive occurring clock signal 628 will reset flip-flop FF1 which results in flip-flop FF2 being set thereby changing the output level on lead 626 from low to high. The computer 26 recognizes this level change as the edge of the garment being reached. A needle 20 in the next position will again cause the flip-flop FF1 to be set. The next positive clock signal 628 will again reset flip-flop FF1 and keep flip-flop FF2 set. The occurrence of a vacant needle position will result in flip-flop FF1 being reset when the next positive clock signal occurs which results in flip-flop FF2 being reset thereby changing the level on output lead 626 from high to low. The computer 26, however, will recognize the other edge of the garment as having been reached only upon three consecutive vacant needle positions being passed.

The circuitry for the other butt switch 118 for carriage travel from right to left is identical to that shown in FIGS. 14A and 14B with the exception that the reset signal is obtained by AND gating the PIP A and PIP B signals.

Figure 18:
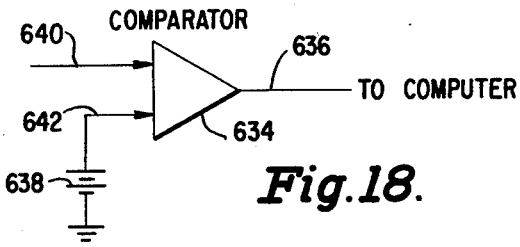
FIG. 18 is a circuit diagram showing a voltage level comparator.

In order to give an indication to the computer 26 that electrical power is low or that electrical power is about to fail so that the computer 26 can take the necessary shut down steps or procedure, voltage level detecting circuits are located within the I/O box 34. One such circuit is illustrated in FIG. 18 as including a comparator 634 the output of which is coupled to the computer 26 by way of a lead 636. One input to the comparator on lead 642 is provided by a voltage reference 638, which may comprise a battery. The other input to the comparator 634 on lead 640 comprises an operating D.C. voltage the level of which is to be monitored by the comparator 634. As long as the potential on lead 640 is greater than the reference source 638, the potential on the output lead 636 is high which the computer 26 interprets as meaning that the operating potential on lead 640 is satisfactory. If the potential on lead 640 falls below that of the reference 638, output lead 636 goes low which is interpreted by the computer 26 as meaning that the monitored operating potential is unsatisfactory. For example, in one circuit the reference 638 magnitude is such that a lesser magnitude on lead 640 is interpreted by the computer 26 as meaning the monitored voltage level is low; in another circuit, however, the reference magnitude is even less such that a lesser magnitude on lead 640 is interpreted by the computer 26 as meaning that the monitored voltage source is about to fail. As will now be apparent, a separate comparator circuit is utilized for each operating voltage that is to be monitored, and the magnitude of the reference source 638 with respect to the desired magnitude of the monitored source is such as to indicate a low voltage condition or an impending power failure condition.

Figure 15A:
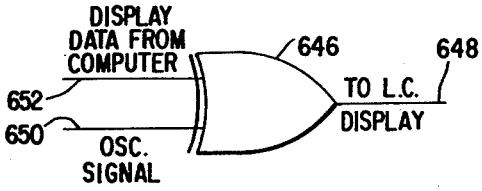
FIGS. 15A and 15B are diagrams showing electronic drive components for the liquid crystal display on the machine.
Figure 15C:
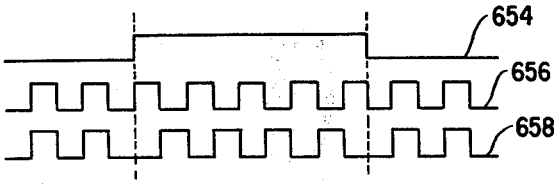
FIG. 15C is a wave shape diagram illustrating the operation of the circuitry of FIG. 15A.
Figure 15B:
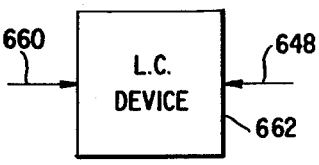

In accordance with one embodiment of the present invention which was constructed, the display 66 described hereinabove utilized liquid crystal elements. When a particular character or segment is to be displayed, the computer 26 will provide an enabling D.C. potential on an appropriate lead to the selected character or segment. As is apparent to those skilled in the art, a D.C. operating potential will ruin a liquid crystal display device in a relatively short time. In order to overcome this shortcoming, each liquid crystal display enabling signal provided by the computer 26 is converted into an AC signal. This is accomplished by the Exclusive OR circuit shown in FIG. 15A. There is an equivalent Exclusive OR circuit for each segment or character of the display and the circuits are located in the I/O box 34. One input to the Exclusive OR gate 646 appearing on input lead 652 is the liquid crystal enable signal supplied by the computer 26. This signal is shown in FIG. 15C by waveshape 654. The other input to the Exclusive OR gate 646 on lead 650 is the oscillator (not shown) signal supplied to the computer 26 as a real time clock. This signal is shown in FIG. 15C by waveshape 656 and is also supplied to one side of each liquid crystal character, or segment. This is shown in FIG. 15B wherein the oscillator signal 656 is applied to one side of a liquid crystal device 662 by way of lead 660. The output of the Exclusive OR gate 646 appears on lead 648 and is applied to the other side of the selected character or segment of the display 66 as shown in FIG. 15B. The output of the Exclusive OR gate 646 is shown as waveshape 658 in FIG. 15C. Referring now to FIGS. 15A, 15C and 15B, when the output 654 on lead 652 from the computer 26 is low, the oscillator signal 656 provides the only high input to the Exclusive OR gate 646. The output signal 658 on lead 648 for this condition is identical to the input signal 656 on lead 650 so that the signals on each input lead 660 and 648 to the liquid crystal device 662 are the same and the liquid crystal 662 is not turned on. When the computer 26 supplied signal 654 goes high, however, the Exclusive OR gate output 658 will go high only when the oscillator signal 656 is low. Accordingly, for this condition, the output signal 658 is 180° out of phase with the oscillator signal 656 such than an AC signal now appears across the liquid crystal device 662 for the duration of time that signal 654 is high thereby turning the liquid crystal device on for this time period.

Figure 16A:
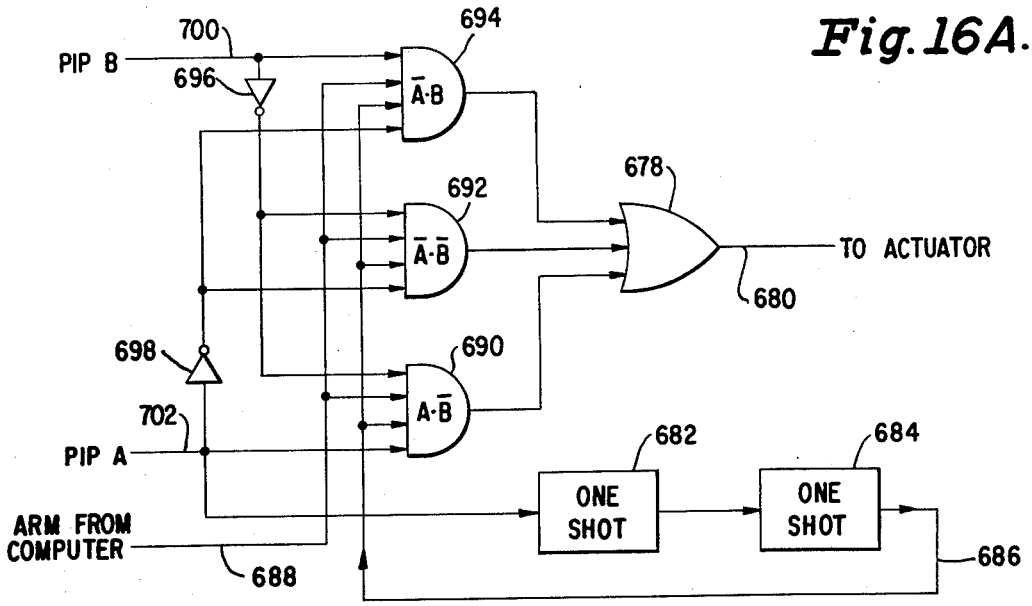
FIG. 16A is a diagram showing actuator duty cycle and time-out circuitry.
Figure 16B:
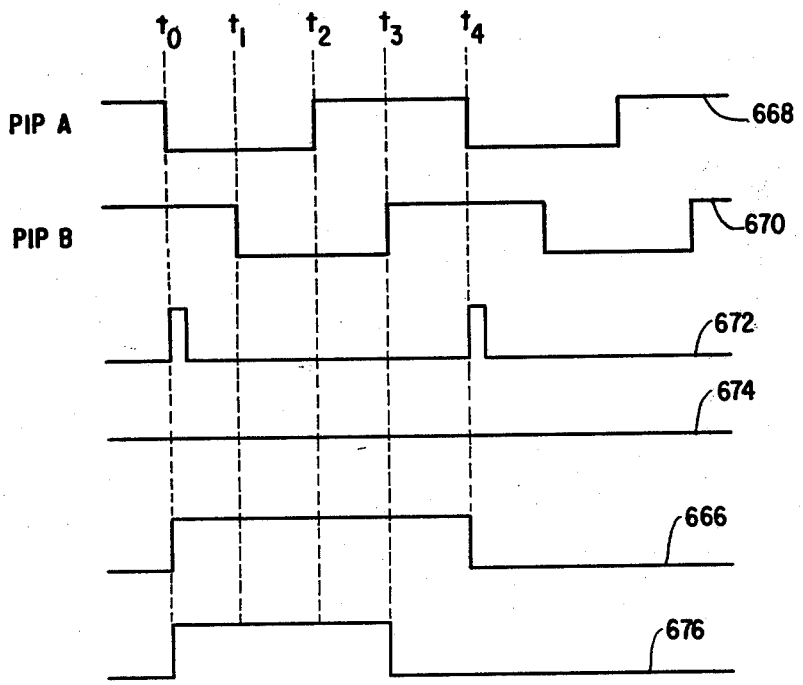
FIG. 16B is wave shape diagram illustrating the operation of the circuitry of FIG. 16A.

When appropriate, the computer 26 will supply an arm signal for the actuator 22 or 24. Such an arm signal is illustrated as waveshape 666 in FIG. 16B. This signal 666 normally has a time duration equal to the time the carriage takes to traverse a needle position shown as time t0 through t4 FIG. 16B. In accordance with the present invention, however, the signal applied to the actuator 22 or 24 has a duty cycle of about 75% and will turn off if the carriage 12 is left in the same needle position greater than a predetermined time, such as ten seconds, to prevent damage to the actuators. The circuit for accomplishing this for the right actuator 24 is shown in FIG. 16A as including an OR gate 678, three AND gates 690, 692 and 694 and two retrigerable one shot multivibrators 682 and 684 and is located in the I/O box 34. The output from the OR gate 678 is applied to the right actuator 24 by way of lead 680 and is illustrated in FIG. 16B as waveshape 676. The inputs to the OR gate 678 comprise the outputs of the three AND gates 690, 692 and 694. Each of the AND gates has four inputs. On input applied to each AND gate 690, 692 and 694 is the arm signal 666 supplied by the computer 26. Another input applied to each of the AND gates is the output of the second one shot 684 which is illustrated in FIG. 16B as waveshape 674. The input to the second one shot 684 is the output form the first one shot 682 which is illustrated in FIG. 16B as waveshape 672. PIP A signal, shown in FIG. 16B as waveshape 668, is applied to the input of the first one shot 682 and to the AND gate 690. The PIP A signal after being inverted by the inverter 698 is applied to AND gate 692 and 694. The PIP B signal, shown in FIG. 16B as waveshape 670, is applied to AND gate 694 and after inversion by the inverter 696 to AND gates 692 and 690.

Referring now to FIG. 16A and 16B, the operation of the circuit of FIG. 16A is such that at time *t*0, the arm signal 666 occurs as PIP A 668 goes low, causing the output 672 of the first one shot 682 to go high for a short period of time. This in turn causes the output 674 of the second one shot 684 to go high. Since the second one shot 684 has a time out period of about ten seconds, the output 674 of the second one shot 684 remains high. During the time period *t*0 to *t*1, PIP A 668 is low and PIP B 670 is high which results in only AND gate 694 being enabled for this time period and producing an input to the OR gate 678. During the time period *t*1 to *t*2, PIP A 668 remains low and PIP B 670 is also low, which results in only AND gate 672 being enabled for this time period and producing an input to the OR gate 678. During the time period t2 to t3, PIP A 668 is high and PIP B 670 is low, which results in only AND gate 690 being enabled for this time period and producing an input to the OR gate 678. During time period *t*3 to *t*4 both PIP A 668 and PIP B 670 are high. However, this will not enable any of the AND gates 690, 692 or 694. Accordingly, there is no input to the OR gate during this time period. As will now be apparent, the signal to the right actuator 24 will be present on lead 680 from the OR gate 678 only during the time period t0 through t3 or for three fourths of a needle position. The analysis set forth above assumes that the carriage 12 did not remain in the needle position for more than ten seconds. If this were the case, the second one shot 684 would have timed out causing its output 674 on lead 686 to become low, thereby disabling each of the AND gates 690, 692 and 694 which in turn would prevent any output 676 from the OR gate 678 to the right actuator 24.

A circuit virtually identical to that shown in FIG. 16A is provided for the left actuator 22 and is also located within the I/0 box 34. The left actuator circuit, however, replaces AND gate 694 which is enabled by PIP A 668 being low and PIP B 670 being high by an AND gate (not shown) which is enabled by PIP A being high and PIP B being high corresponding to time period *t*3 to *t*4. A person skilled in the art can readily arrange such a circuit in view of the description of the right actuator circuit described above.

Figures 17A, 17B:
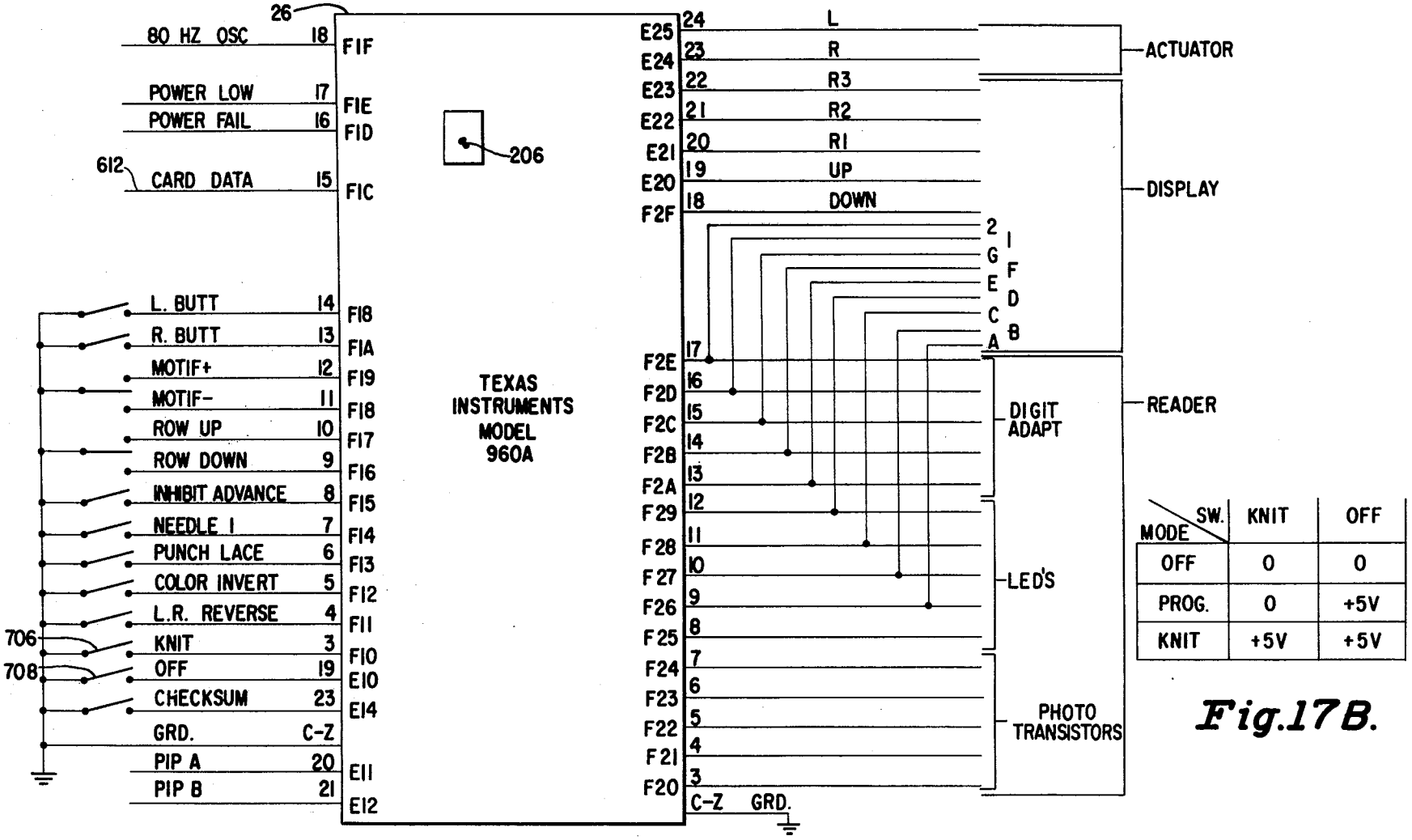
FIG. 17A is a circuit diagram showing the interface between the computer and input/output circuitry.
FIG. 17B is a truth table for the Off-Program-Knit switch of the machine.

The programmed computer 26 and the signal connections thereto are clearly illustrated in FIG. 17A. In accordance with the present invention, the computer 26 utilized was Texas Instruments Inc. Model 960A (Part No. 226881-2) modified by having the following Texas Instruments Inc. printed circuit boards added thereto: Internal CRU Expander (Texas Instruments Inc. part No. 226722-1), Date Input Module (Texas Instruments Inc. part No. 217382-1) and Data Output Module (Texas Instruments Inc. part 217380-1). The inputs to the Data 26 are shown on the left side of FIG. 17A while the outputs from the computer 26 are shown on the right side. The input and output pin numbers of the computer 26 are shown on the outside of the rectangle which represents the computer 26 while the communications registers which these pin numbers address are shown within the rectangle and adjacent their corresponding pin numbers. For example, input pin number nineteen is coupled to communications register E10 while output pin number nineteen is coupled to communications register E20.

As shown in FIG. 17A, the output of the eighty Hertz clock oscillator (not shown) within the I/0 box 34 is applied to input pin eighteen. The circuit, such as that described in conjunction with FIG. 18, that will provide an indication that a monitored voltage level is low is coupled to input pin 17 while a similar circuit that provides an indication that a monitored voltage source is aboaut to fail is coupled to input pin 16. The output from the card reader 30 appearing on the output lead 612 of the comparator 596 (FIG. 13) is coupled to input lead fifteen. The various operating switches associated with the knitting apparatus are coupled to input leads 3 through 14, 19 and 23 as shown. With the exception of the left 22 and right 24 butt switches, these operating switches are directly coupled to the input pins by way of the I/0 box 34. The output from the butt switches 118 and 120 as described above, however, are applied to a butt detection circuit, such as that shown in FIGS. 14A and 14B, with the output from such a circuit for each butt switch 118 and 120 being coupled to input pins fourteen and thirteen. Although the OPK switch 50 described above has three positions, it comprises only two switch contacts 706 and 708 which are coupled to input pins three and nineteen respectively.

A truth table shown in FIG. 17B shows that when both switches 706 and 708 are closed, the knitting apparatus is off. When switch 706 is closed and switch 708 is open, the knitting apparatus is in the PROGRAM MODE and when both switches 706 and 708 are open the knitting apparatus is in the KNIT MODE. When closed, the switches 706 and 708 will provide ground potential on their input pins three and nineteen, respectively; while when open a 5 volt positive potential will appear on their associated input pins. This potential is generated by a "pull up" circuit (not shown) associated with each pin and located within the computer 26. The PIP A signal is coupled to input pin 20 and the PIP B signal is coupled to the input pin twenty one. Naturally, the computer 26 is also coupled to system ground through pins C–Z.

Referring now to the output signals of the computer 26, the left and right actuator arm signals are provided on output pins twenty four and twenty three, respectively. As discussed above, these signals are not applied directly to left and right actuators 22 and 24, respectively, but are first coupled to a circuit, such as that shown in FIGS. 16A and 16B. Output pin numbers nine through twenty two provide the various output signals needed to drive the display 66. The signals for actuating the four rectangles on the display appear on output pins 20, 21 and 22. The signal for actuating the up arrow on the display 66 appears on output pin 19 while the signal for actuating the down arrow appears on output pin 18. The number 2 on the display 66 is actuated by a signal on output pin seventeen while the number 1 on the display 66 is actuated by a signal on the output pin sixteen. The various segments of the seven sigment portion of the display 66 are actuated by signals appearing on output pin 9, 10, 11, 12, 13, 14 and 15, respectively. As discussed above, these signals are not directly coupled to the display devices. Rather, each signal output is coupled to a circuit such as that shown in FIGS. 15A, 15C and 15B to convert the DC signal from the computer 26 into an AC signal. The five bit binary number supplied to the digital to analog converter 600 of FIG. 13 from the computer 26 appears on output pins 13, 14, 15, 16 and 17. The computer 26 supplied signals for enabling a selected one of the five light emitting diodes 520, 522, 524, 526 and 528 of the card reader 30 (FIG. 12A) appear on output pins 8, 9, 10, 11, and 12 while the computer 26 supplied signals for enabling a selected one of the five photo transistors 582, 584, 586, 588 and 590 appear on output pins 3, 4, 5, 6 and 7. As will now be apparent, output pins nine through seventeen are time shared by the display 66 and the card reader.

As will now be apparent, the objects features and advantages of the present invention are obtained by the combination of the mechanical knitting apparatus described, the programmed computer 26 and the electrical interface coupled between the protrammed computer 26 and the mechanical knitting apparatus. Attached hereto as an appendix is the detailed program listing used in the computer 26 to implement the present invention. As listed, the left most column shows program card numbers, the next column lists addresses located within the computer 26 followed in the next column by the contents of the addresses listed. Following columns list the operator neumonic followed by the operand neumonic. For a detailed explanation of the items of the program listing appended hereto, together with a system description of the internal organization of the computer 26, the programming system used, machine instructions and the like, reference is made to "Model 960 A Computer Programmer's Reference Manual" revised June 1, 1973, Manual No. 958360-9701 by Texas Instruments, Inc. the contents of which are incorporated herein by reference.

As an aid in understanding the appended program listing, FIGS. 19 through 49 relate to a detailed flow chart of the appended program listing. As shown by FIG. 19. the appended program listing includes three sub programs; i.e., Initialization, PROGRAM MODE and KNIT MODE; and at least eight sub-routines that are used in one or more of the three sub programs. The eight sub-routines include Program Pip Check, Knit Pip Check, Row Advance Forward, Row Advance Reverse, Read, Column Increment, Column Decrement and Adapt. As an aid in understanding and interpreting the various flow charts, FIGS. 48 and 49 contain a glossary of terms used in the flow charts.

It is to be well understood that the program flow charts shown in FIGS. 20 through 47, and much of the operational description contained hereinabove in conjunction with FIGS. 1 through 18, has been culled from the program as defined by the appended detailed program listing. Any deviation in the drawings or description contained herein from the system defined by the appended detailed program listing is inadvertent. Any such deviation or ambiguity is to be resolved by reference to the appended detailed program listing which is controlling as regards the operation of the knitting apparatus of this invention.

Figure 20:
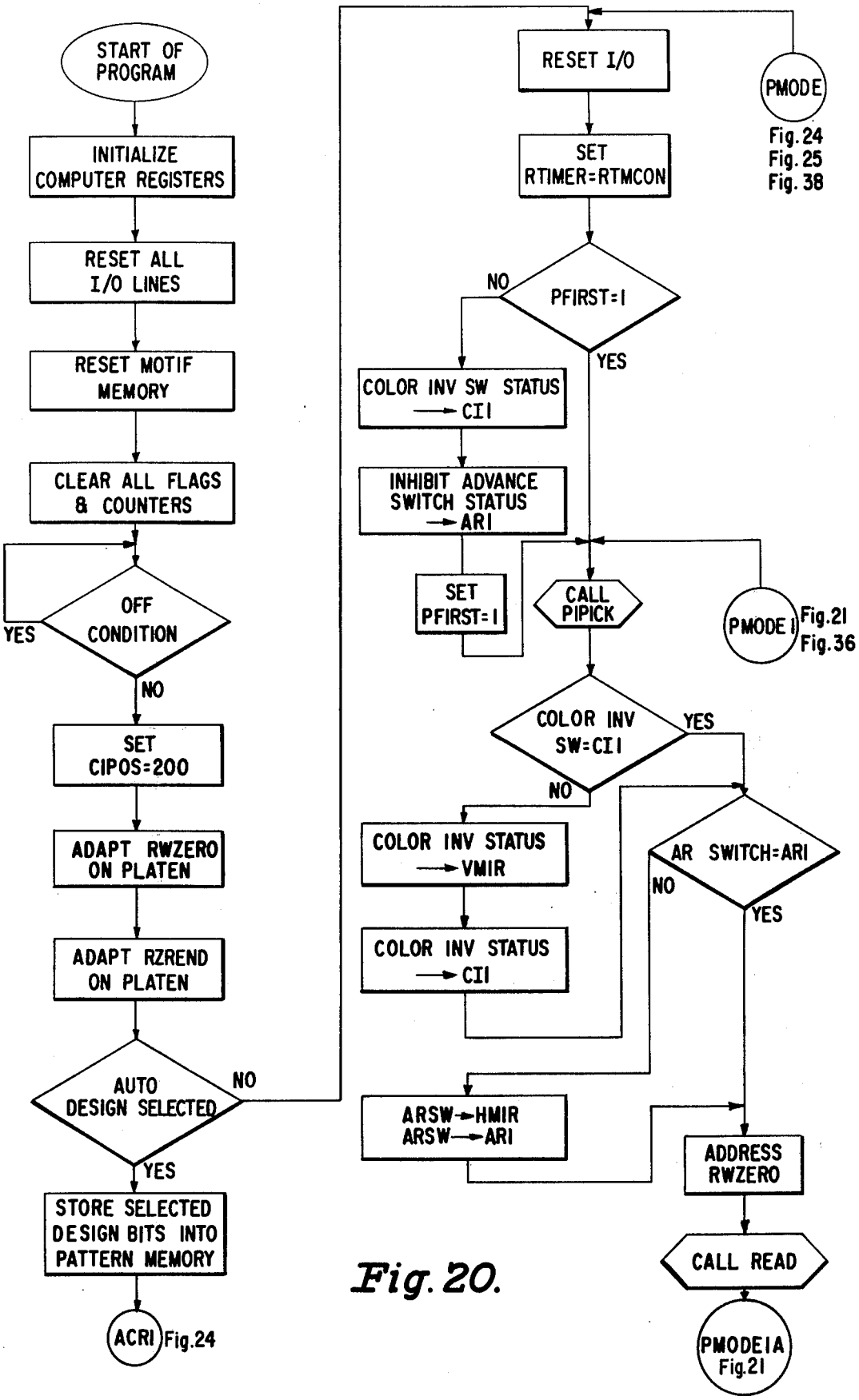
Figure 21:
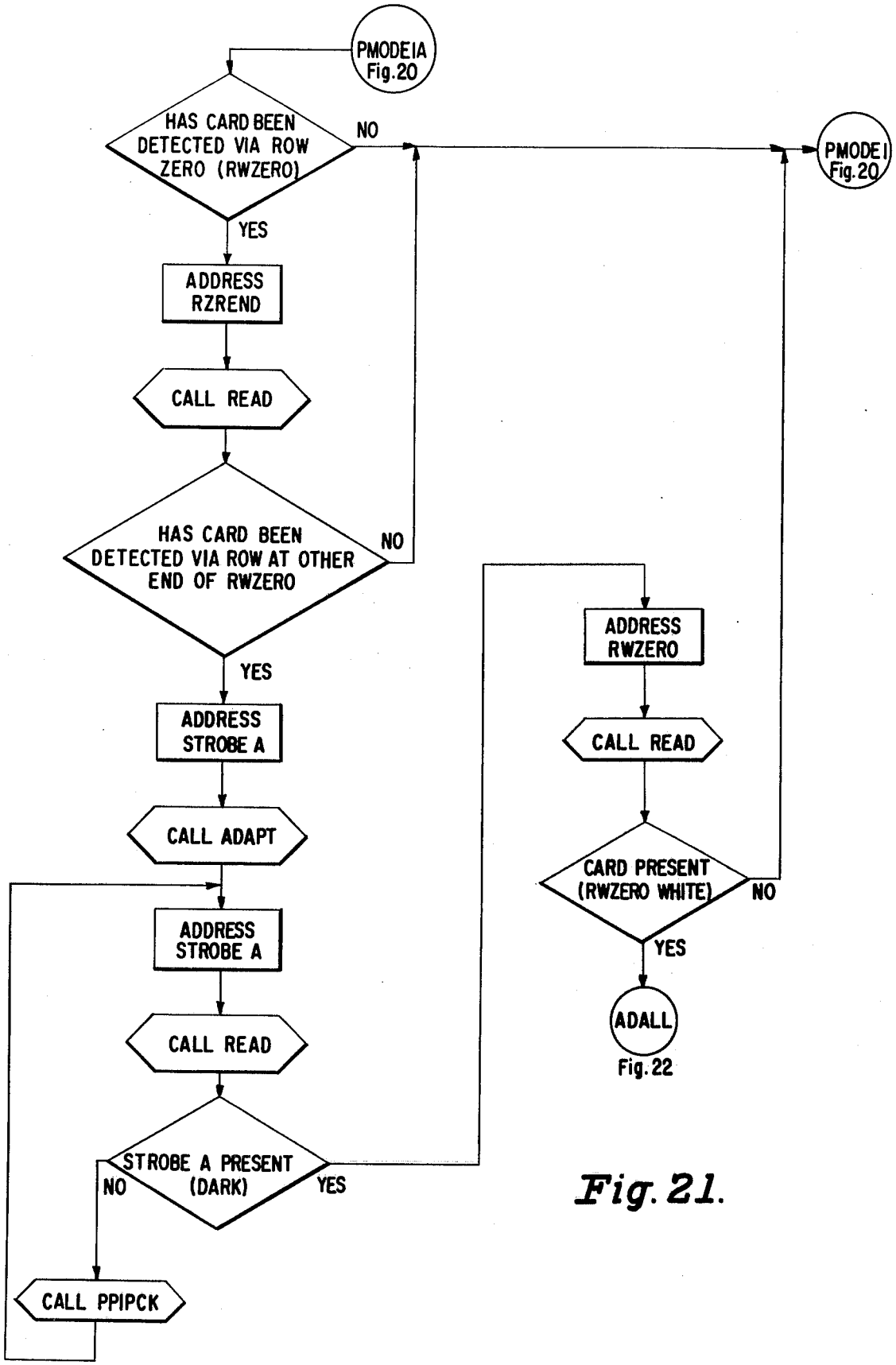
Figure 22:
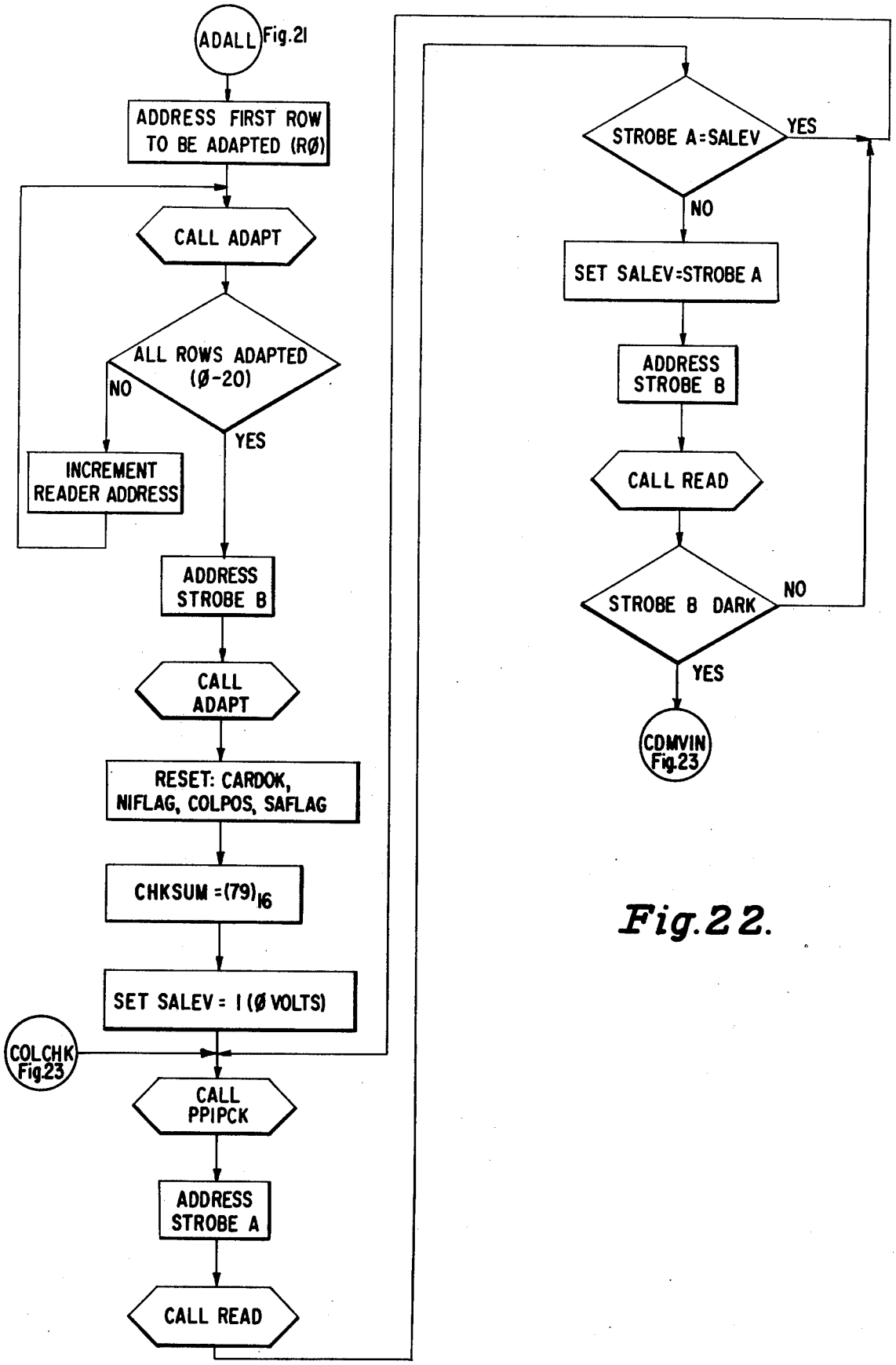
Figure 23:
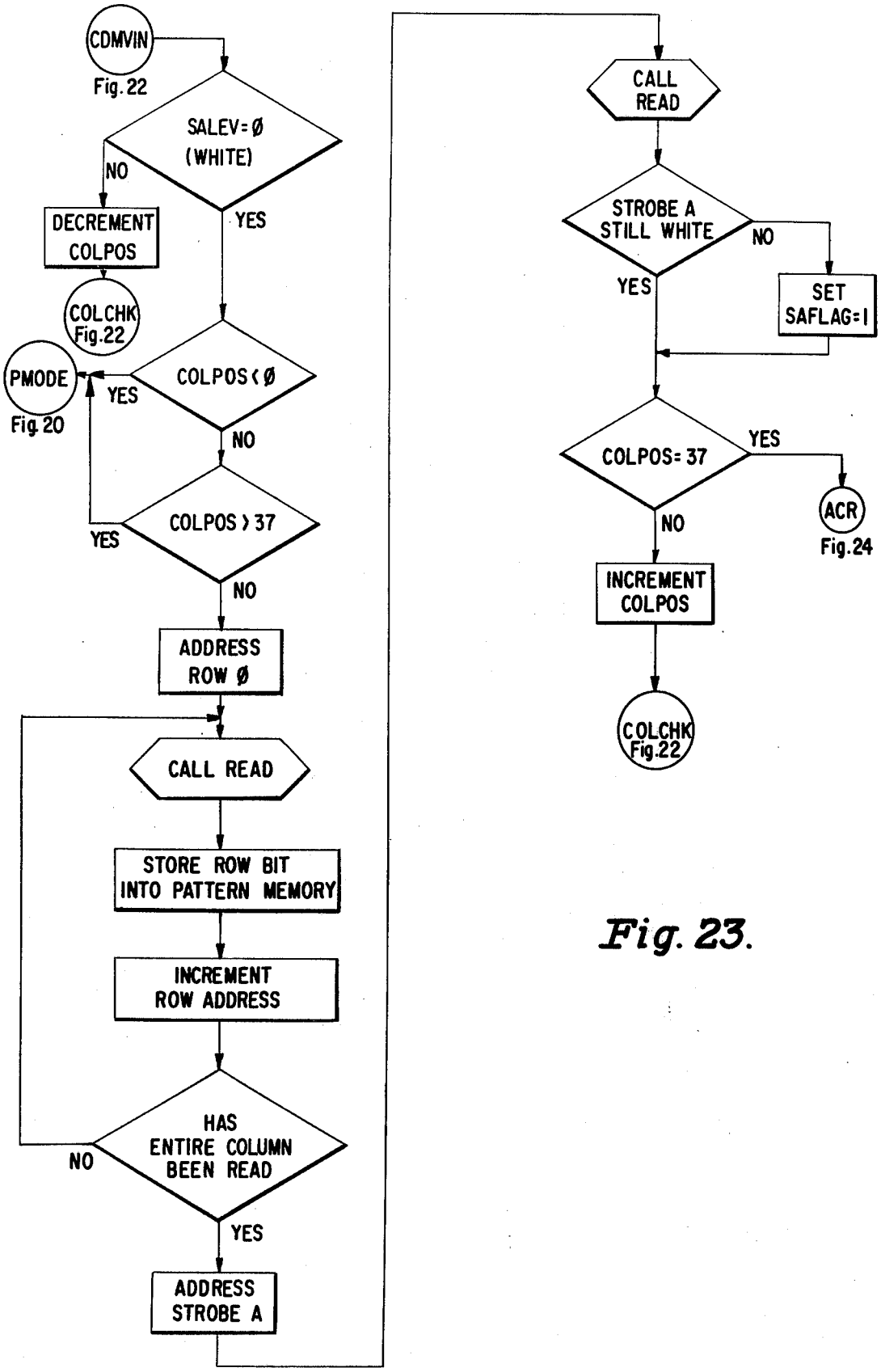
Figure 24:
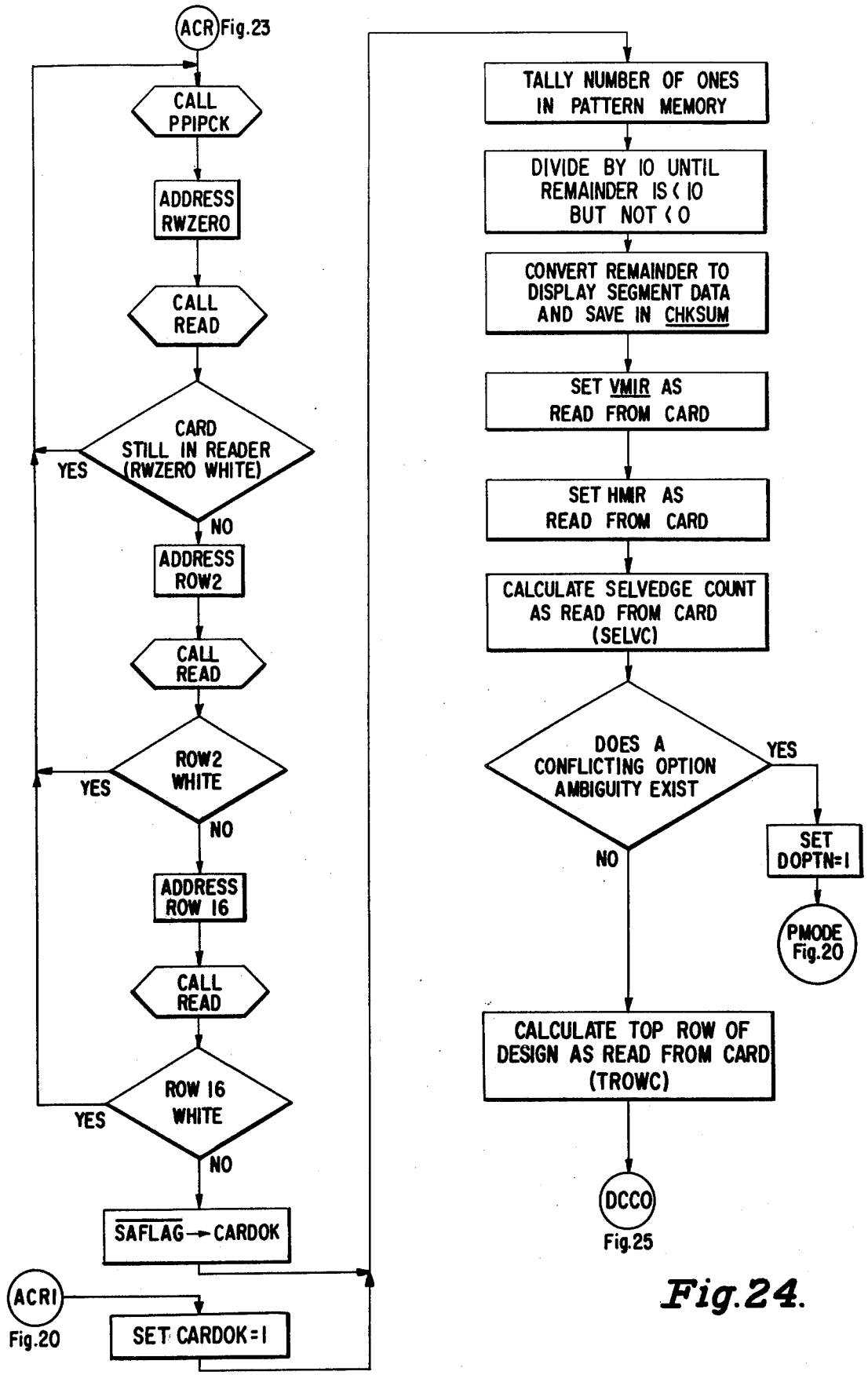
Figure 25:
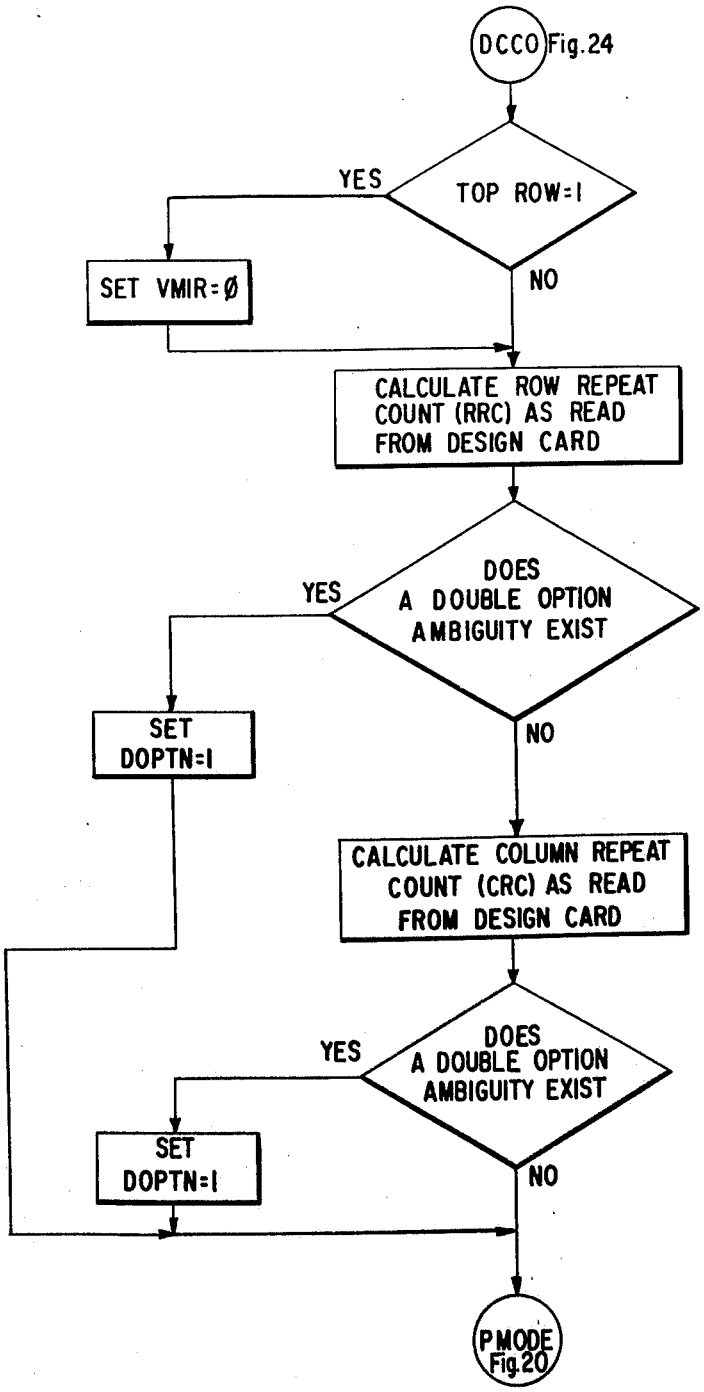
Figure 26:
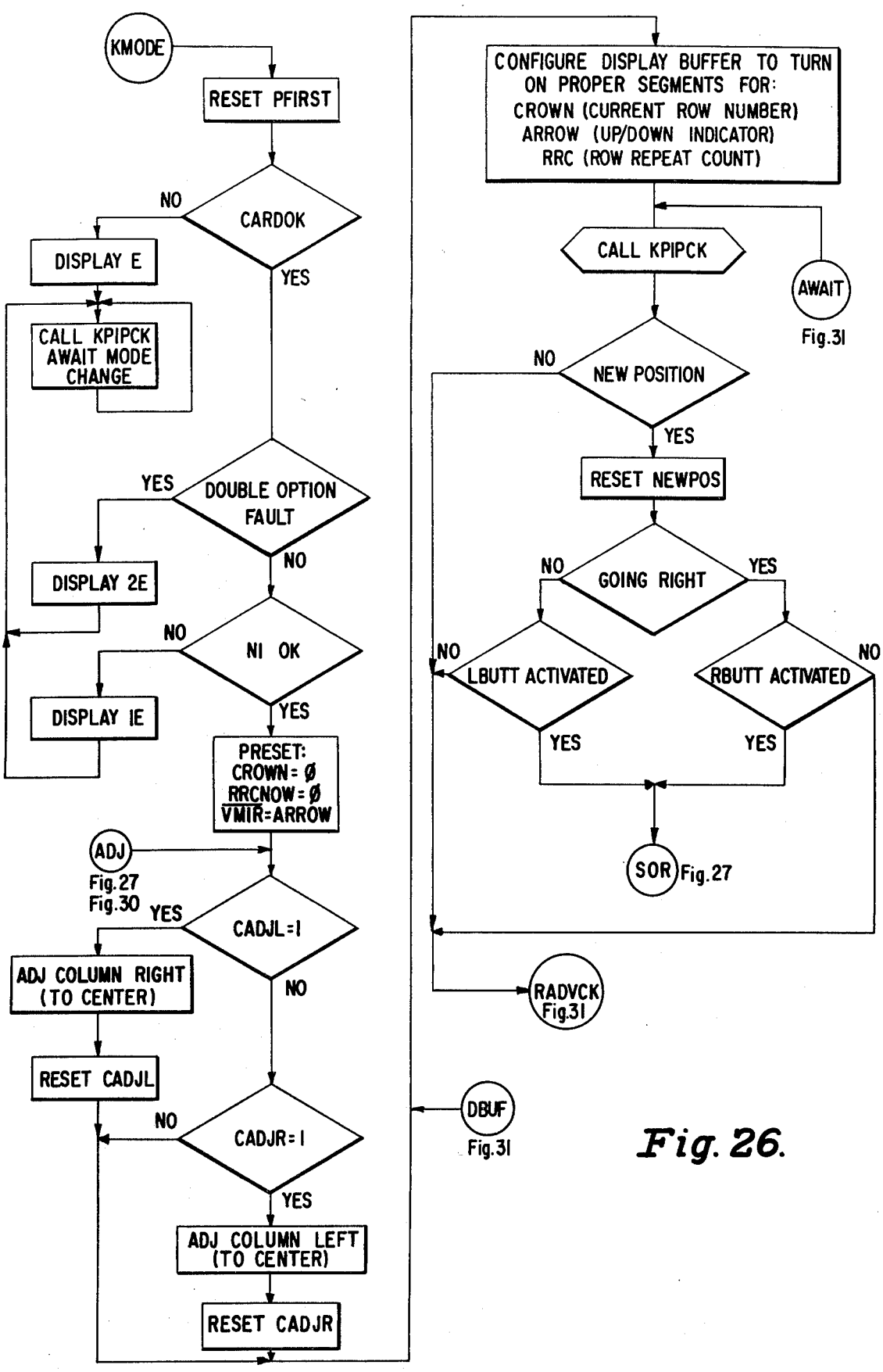
Figure 27:
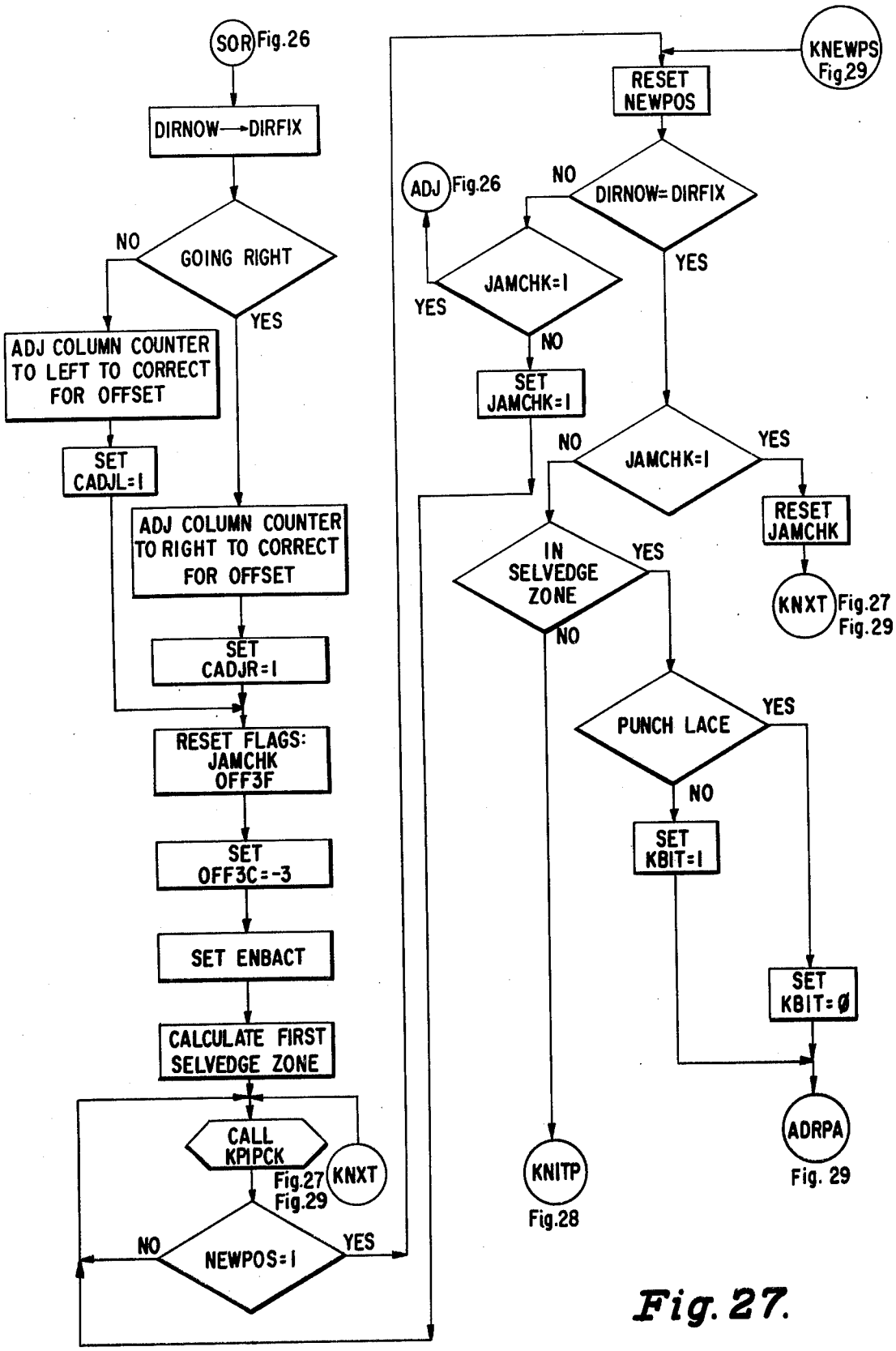
Figure 28:
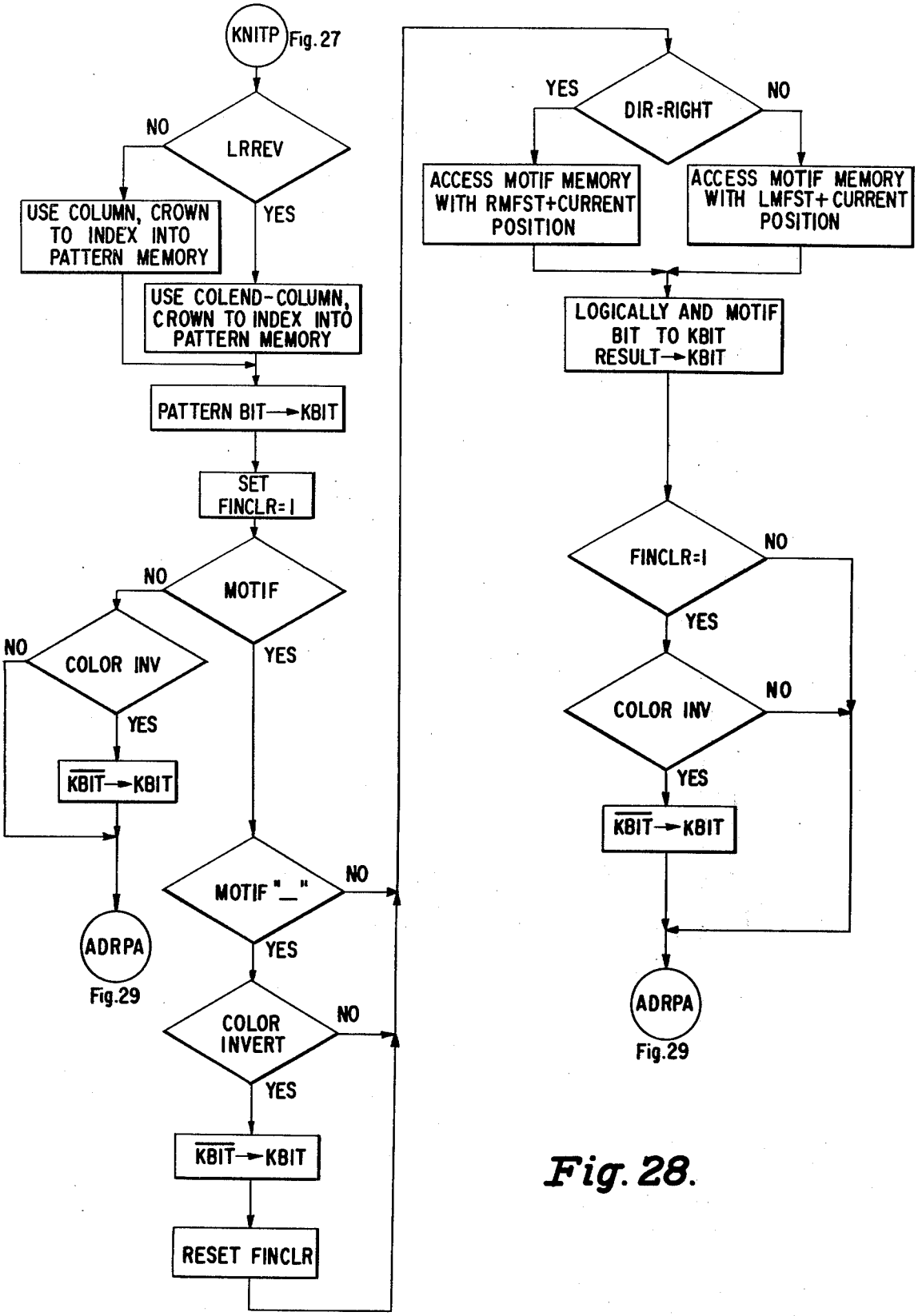
Figure 29:
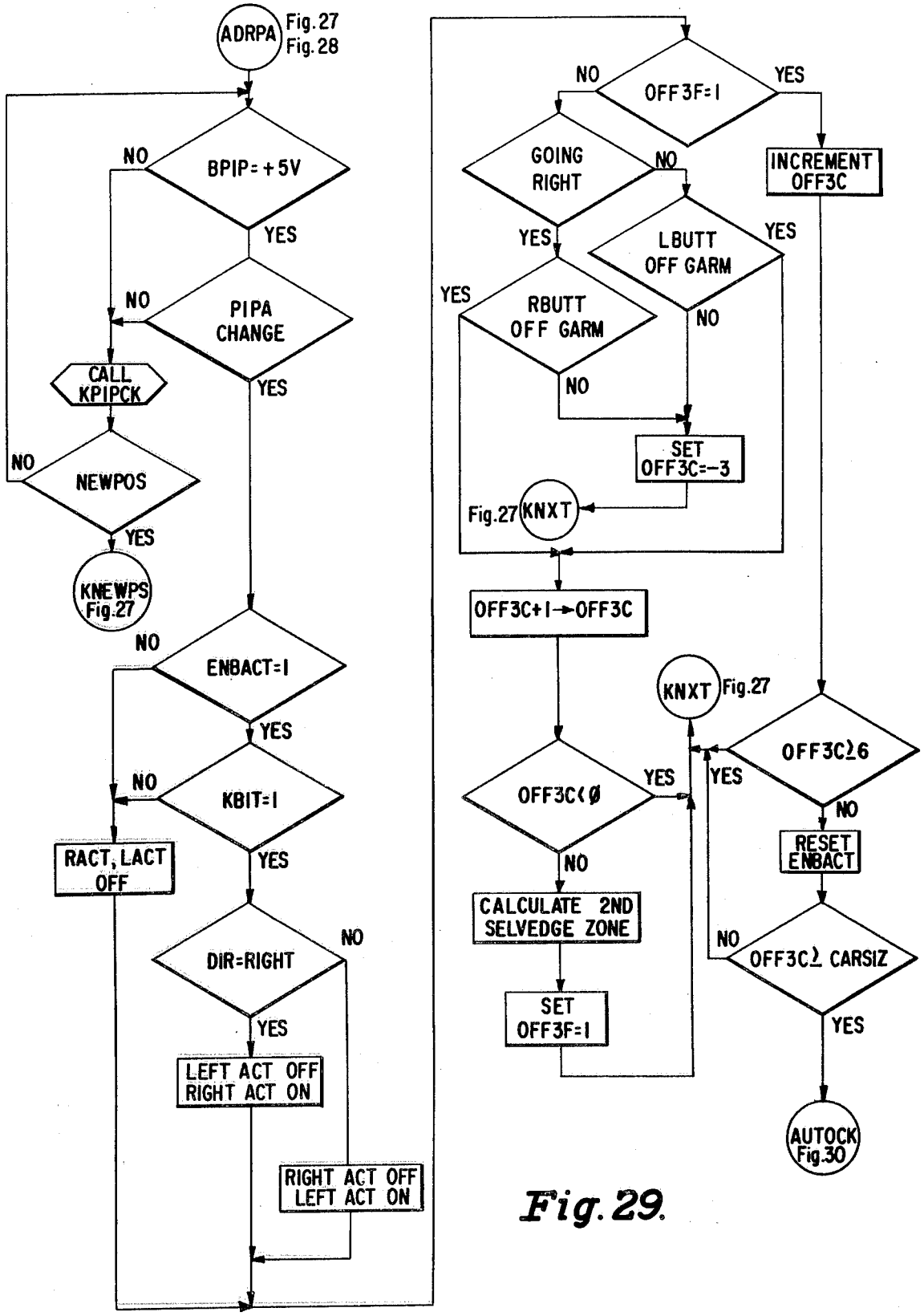
Figures 30, 31:
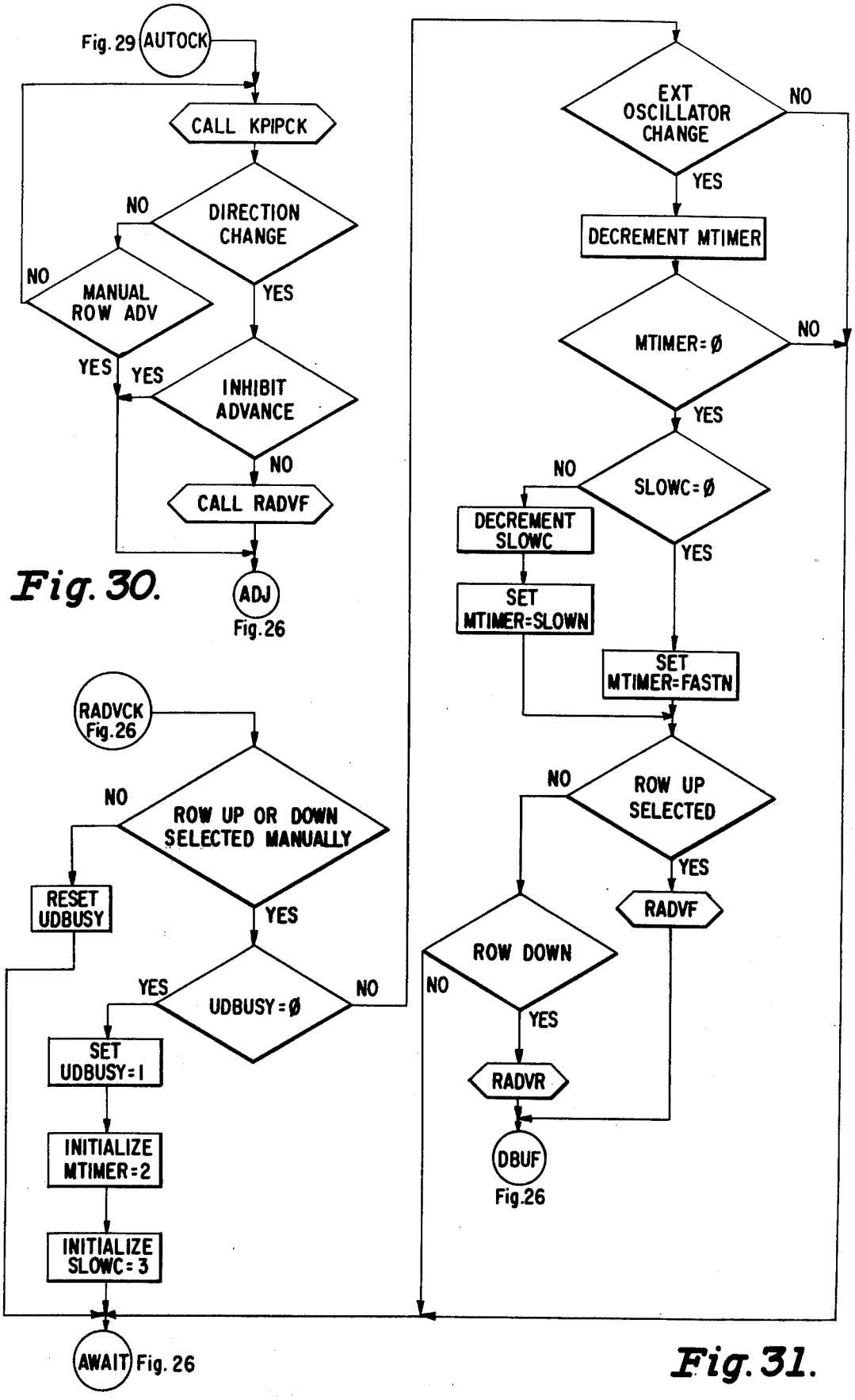
Figure 32:
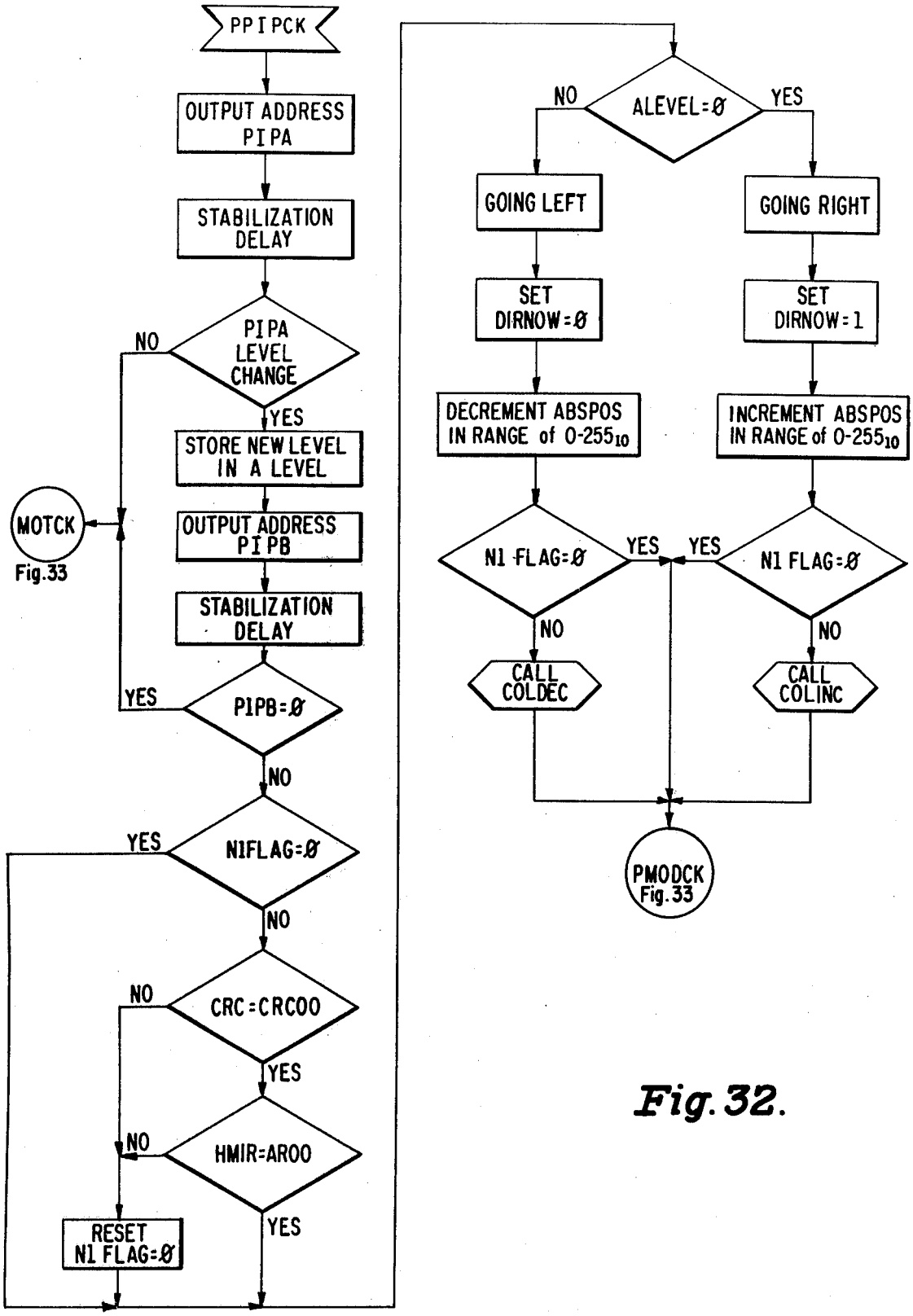
Figure 33:
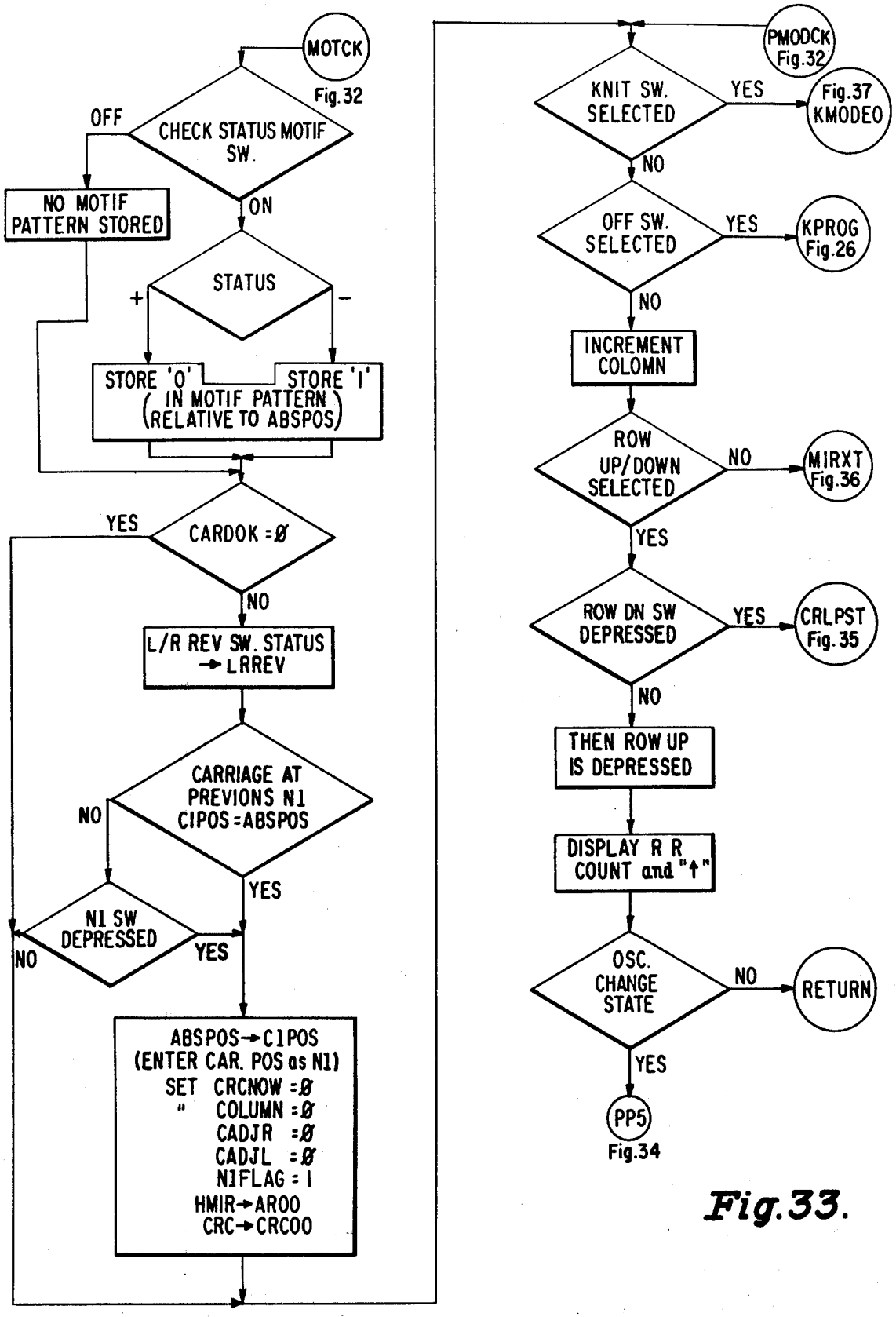
Figure 36:
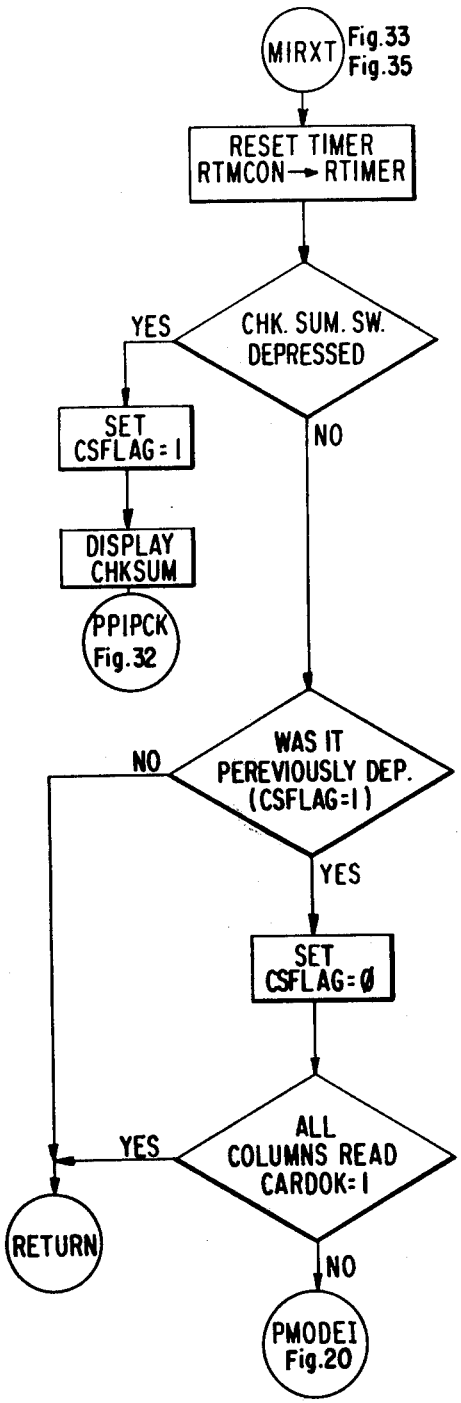
Figure 37:
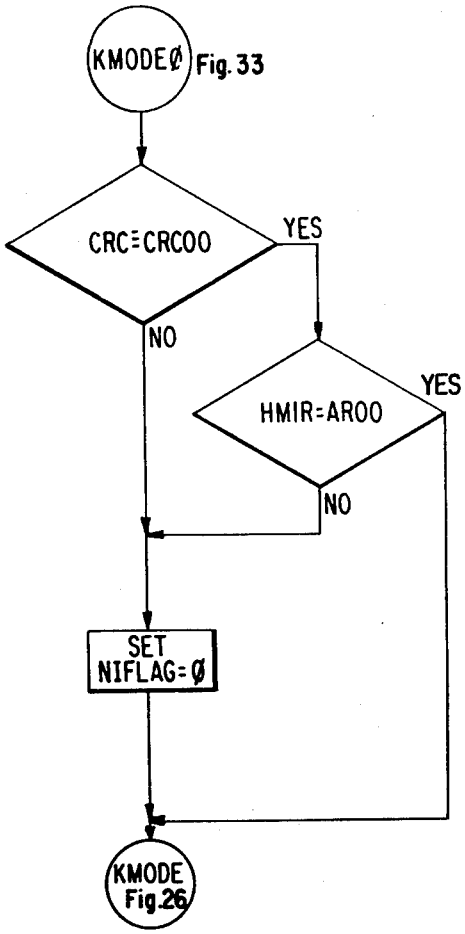
Figure 38:
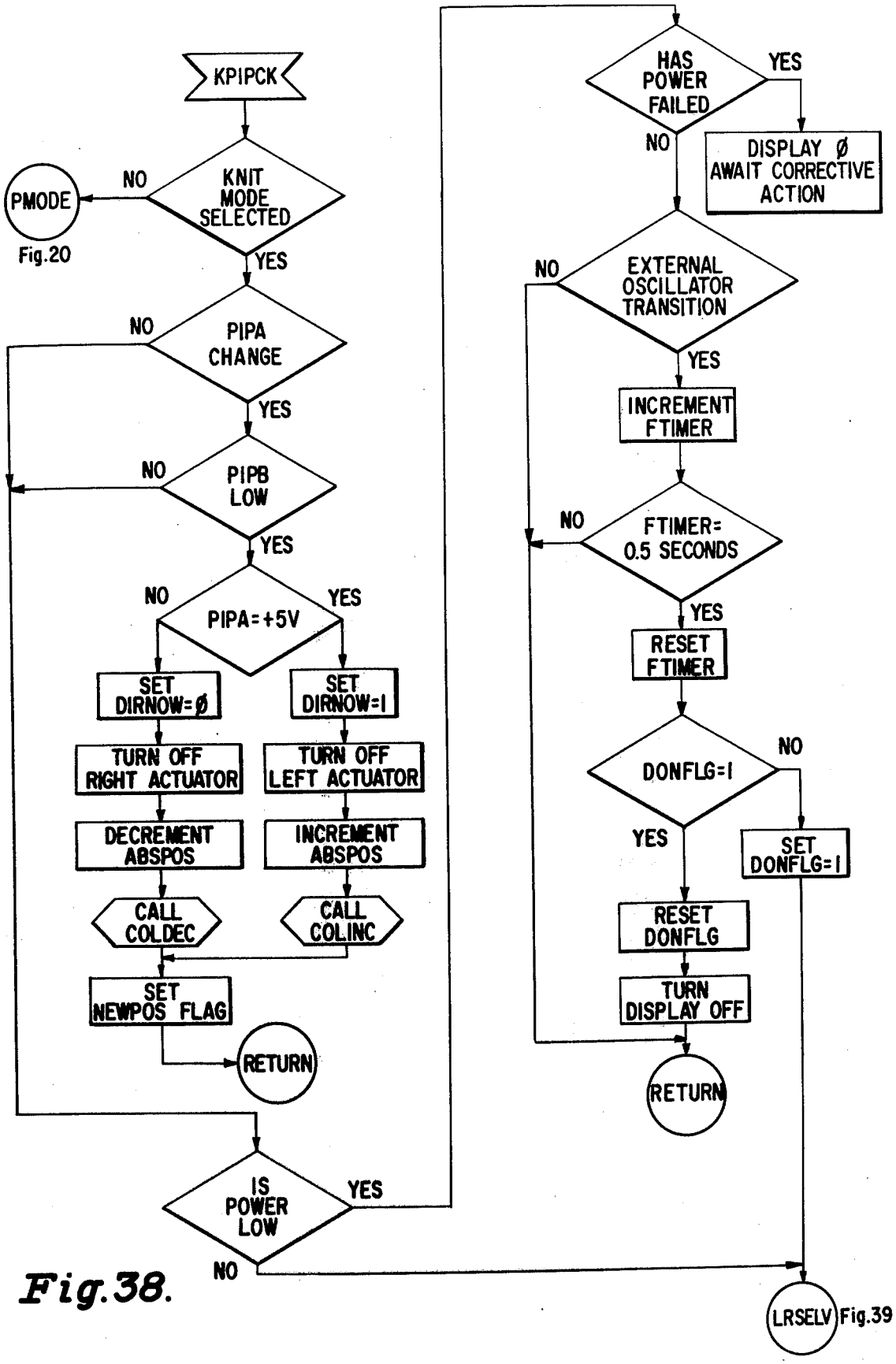
Figure 39:
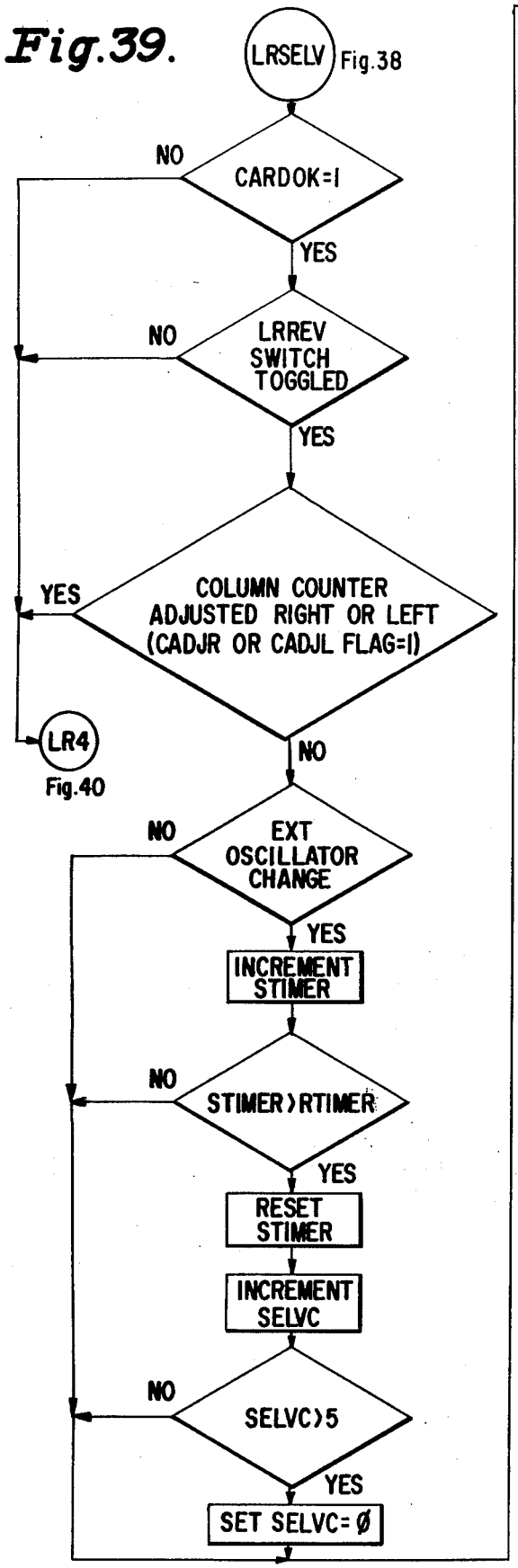
Figure 40:
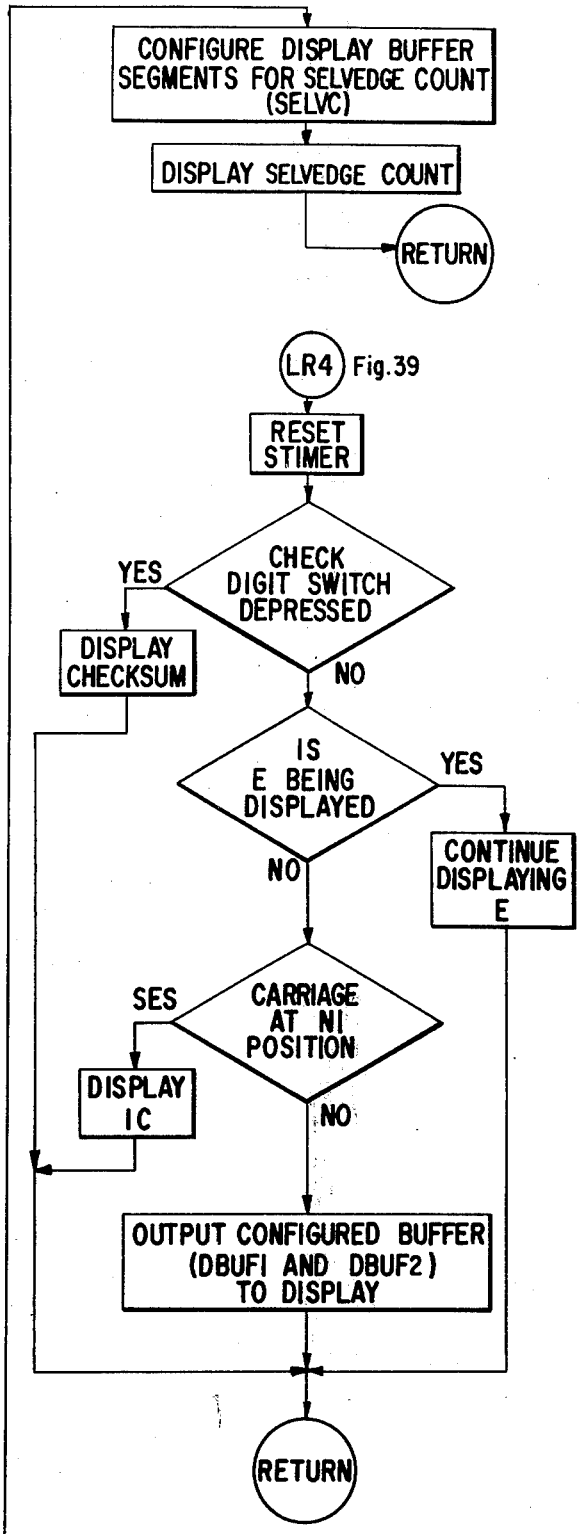
Figure 41:
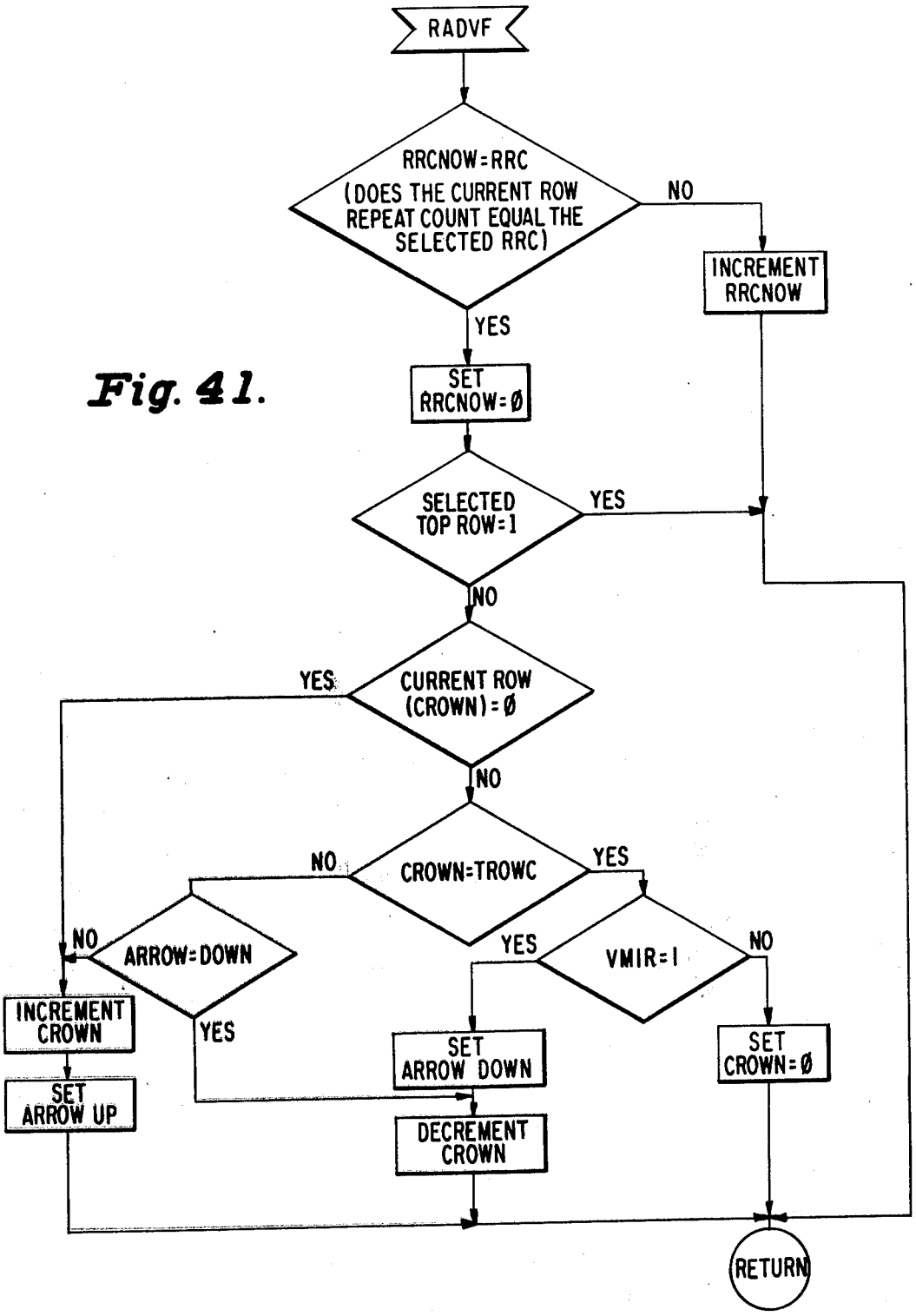
Figure 42:
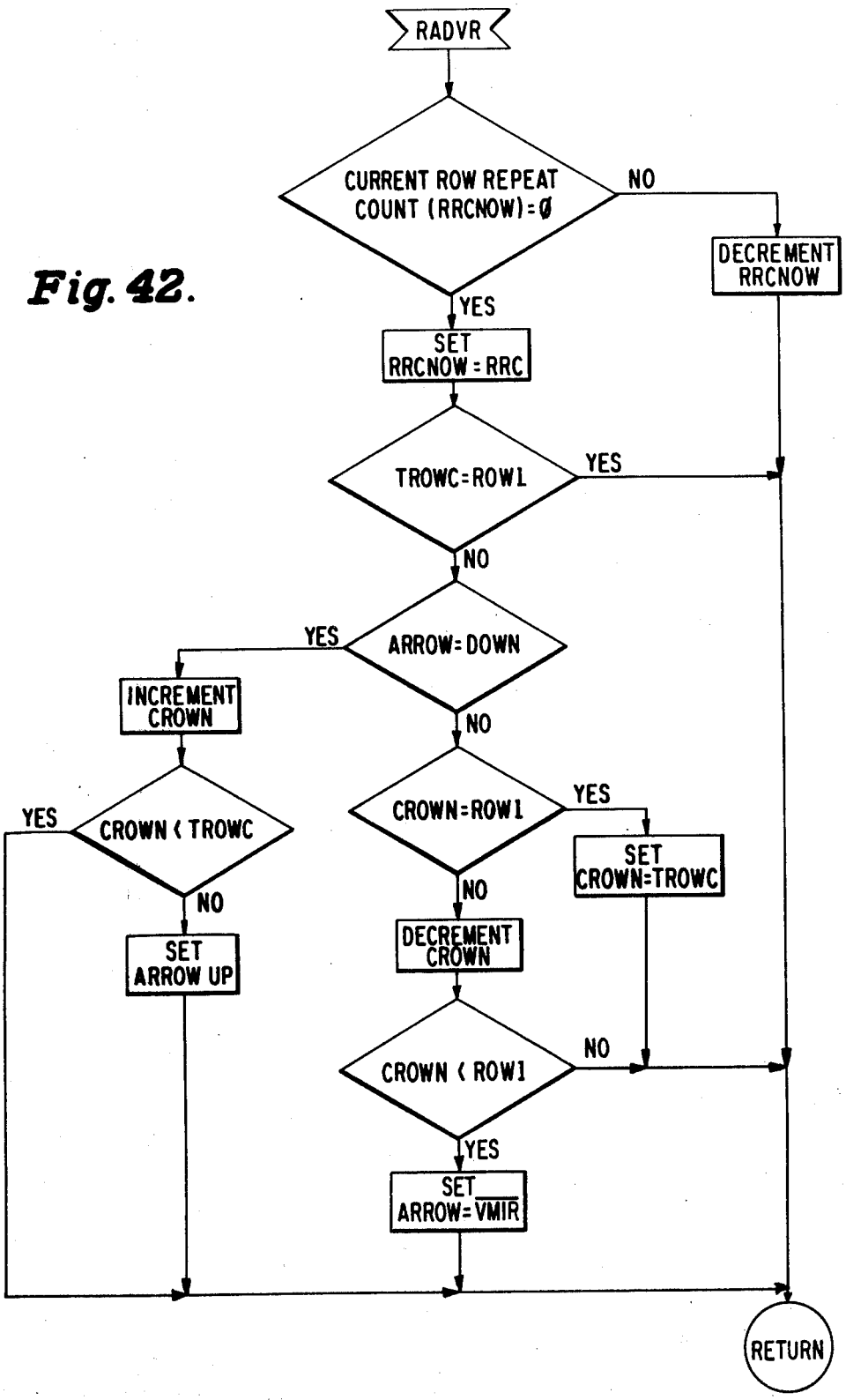
Figure 43:
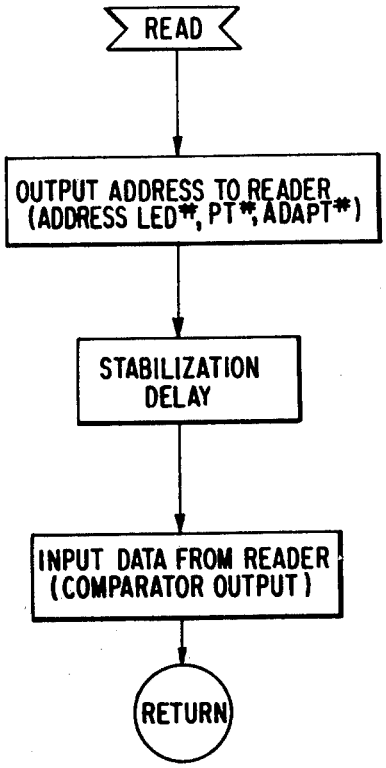
Figure 44:
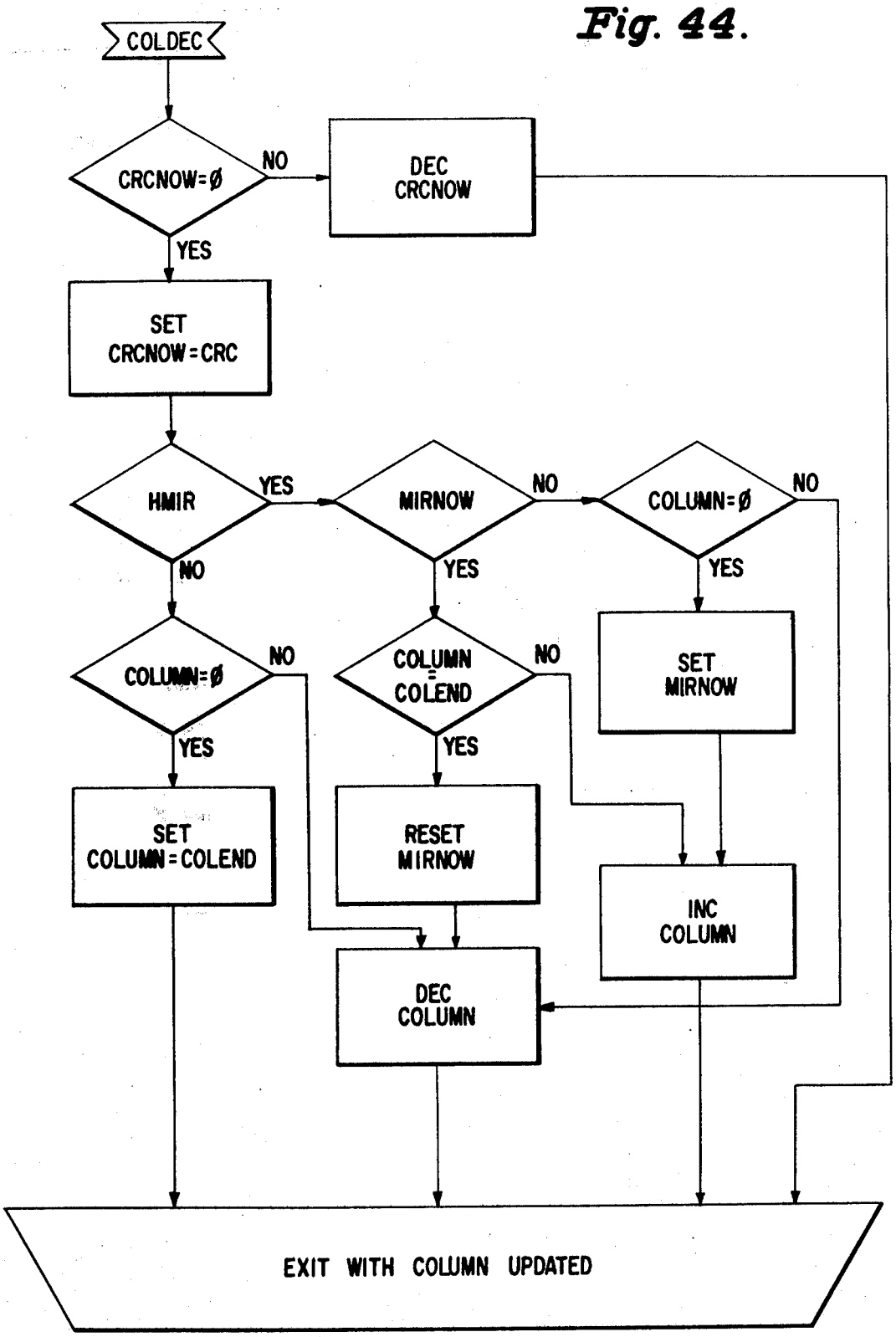
Figure 45:
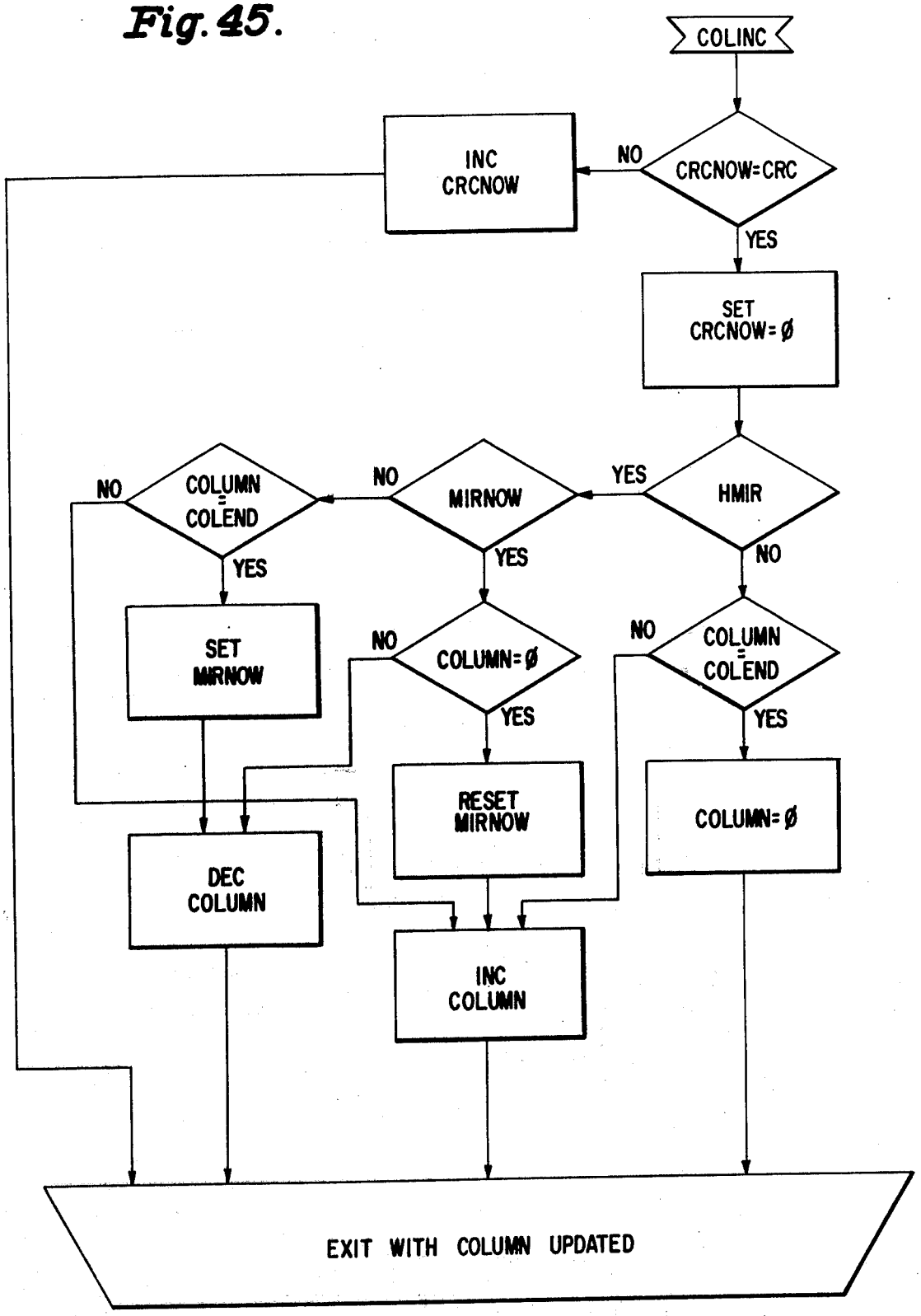
Figure 46:
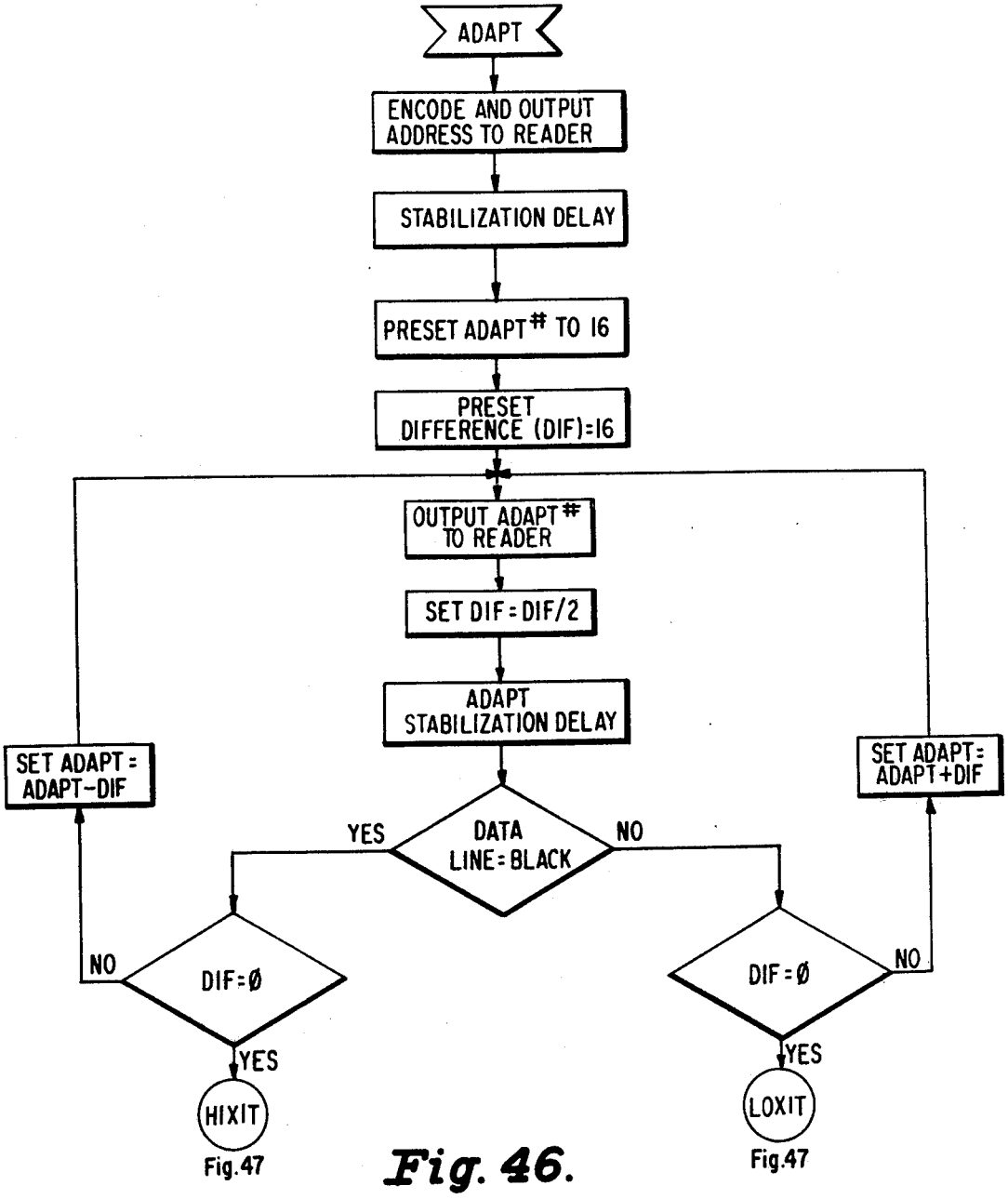
Figure 47:
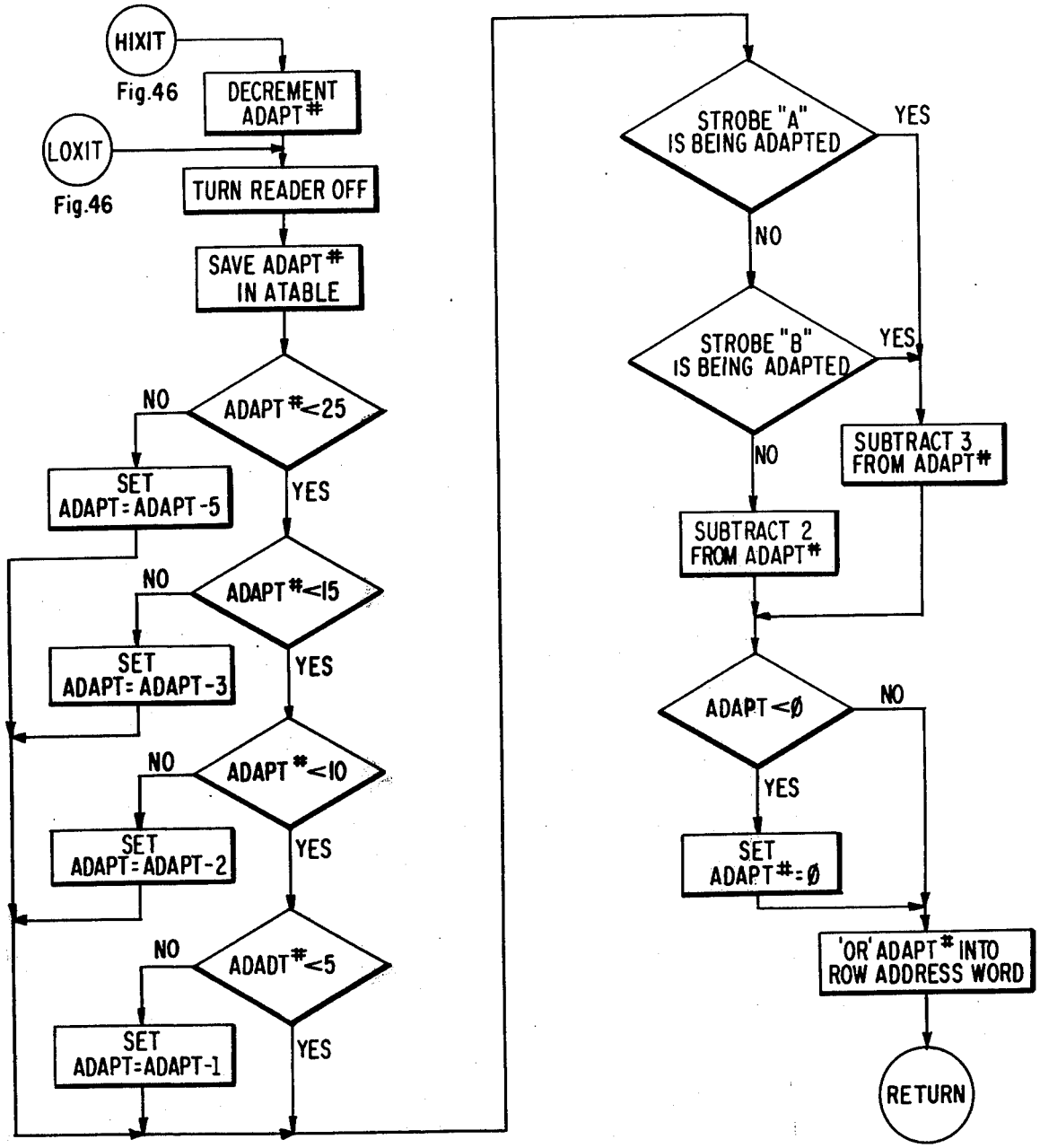

The Initialization sub program shown in the top left portion of FIG. 20 clear the various components of the system when the system is first turned on. For example, this sub program is used to initialize the computer 26 registers, reset the input-output lines, clear all flags, counters and the like.

As previously noted herein, in the Program Mode sub program (FIGS. 20 through 25), a program card 28 can be read, the needle one position selected, a motifing sequence entered by the motifing switch 53 and reversal of the design to be knitted from that shown on the program card. The first two operations are mandatory in that knitting will not occur unless they are accomplished, whereas the latter two operations are optional. Briefly described, the Program Mode subroutine begins by setting CIPOS to two hundred to prevent a needle one position from being achieved by default after which the two channels (zero and twenty) of the card reader 30 used to detect the edge of the program card 28 are adapted to the black background of the card reader 30 platen as described above. If auto design is selected, a preprogrammed design is automatically transferred to the active design memory region of the computer 26 after which checksum is operated and the various design options are decoded and checks made for knit design ambiguities (FIG. 3). If auto design is not selected, various carriage switch positions interrogated to determine whether there have been any changes from their initial positions. The detecting of the program card 28 and reading in of the design information therefrom will then occur as described hereinabove.

An integral part of the Program Mode sub program is the Program Pip Check (FIGS. 12 through 37) subroutine. While in the Program Mode sub program all service requirements present are carried out. However, throughout the program Mode sub program, whenever conditions permit, a complete Program Pip Check sub routine will be carried out the general purpose of which is to monitor the various carriage 12 switch positions and the position of the carriage 12 on the needle bed 10, even while a program card is being read. The Program Pip Check sub routine will determine whether the carriage 12 position on the needle bed has changed, increase or decrease the absolute position count of the carriage 12 on the needle bed, check the current status of the motifing switches 53, the left-right reverse switch 62, the previous needle one position and whether a new needle one position is being selected. The current status of the OPK switch 50 and the row advance and row descent switches 56 and checked and the appropriate display enabled re design mulitplication factor. The check digit switch 63 is monitored and the display 66 enabled, if necessary, and the status of the program card read in is checked.

Also an integral part of the Program Mode sub program is the Read sub routine (FIG. 43) wherein the data from each block of information on the program card is read and stored. Also an integral part of the Program Mode sub program is the Adapt sub routine (FIGS. 46 and 47) wherein the binary numbers are applied to the digital adapter of FIG. 13, to digitize the voltage levels from the card reader 30 information row reading stations as described above. In the main PROGRAM MODE a number is added or subtracted from the digitized number to compensate for background noise and the like. The strobe channels A and B are similarly digitally adapted.

In the Knit Mode sub programs (FIGS. 26 through 31), the design is knitted by controlling the actuators 22 and 24, the display 66 is operated and the various switches on the knitting apparatus are checked. Briefly described, the Knit Mode sub program first checks for errors. For example, if the program card 28 has not been read properly, the E on the display 66 will be illuminated, if conflicting design options have been selected 2E will be illuminated and if needle one has not been selected 1E will be illuminated. If there are no errors the machine will prepare to knit by noting the carriage 12 position on the needle bed 10, configure the display 66 to show the present status and begin to look for the garment edge. The location of the actuators 22 and 24 with respect to the center of the carriage 12 is determined, selvage is calculated, checks are made for jams, the knit algorithums are computed and the actuator 22 or 24 fired, and the salvage zone is checked upon leaving the garment. After leaving the garment, the row advance 56 and row descent 58 switches are checked and the row display 66 is increased or decreased.

Where possible throughout the Knit Mode sub program, a complete Knit Pip check sub routine (FIGS. 38 through 40) is carried out. Briefly described, this sub routine checks the present status of the OPK switch 50, the PIP a and PIP B signals to determine the location of the carriage 12 on the needle bed 10 and correspondingly increases or decreases the position count. The power low or power fail voltage indicating levels are checked and the display operated, if appropriate. The left right reverse switch 62 re selvedge is monitored and the selvedge count is displayed. The check digit is display if the check digit switch 63 is depressed and 1C on the display 66 is illuminated if the carriage is at the needle one position.

Before beginning a new knitting sequence when the new needle position is located to the right or to the left of the old needle position, it must be determined which column of program card 28 information is to be used. Factors which influence the result include the various design options such as multiplication factor, mirroring, inverse and the like. The correct column is determined by the Column Increment, and Column Decrement sub routines shown in FIGS. 44 and 45.

In a like manner, which row of program card 28 information is to be used for the next knitting sequence must also be determined. This is accomplished by the Row Advance Forward sub routine (FIG. 41) when a course is completed and the carriage reverses or when row advance is manually selected, and by Row Advance Reverse subroutine when row reverse is manually selected.

Although the invention has been described in its presently preferred form, it is to be understood that the present disclosure is by way of example only and that numerous changes in consturction and in the combination and arrangement of parts may be resorted to without departing from the spirit and scope of the invention. In particular it should be noted that the Texas Insturment computer 26 shown and described herein is but one example of various general purpose computers that might be used for control purposes in the machine of the invention. It should also be noted that electronic control means in a form different from that of the computer 26 may be utilized to perform the control functions of the computer. If desired, one or more silicon chips adapted to perform all of the control functions of both the computer 26 and the I/0 box 34 may be utilized in the machine.

Having thus set forth the nature of the invention, what we claim herein is:

1. In a programmable knitting machine the combination comprising a needle bed wherein needles are supported in side by side relation, needle selecting means including a carriage movable on the needle bed for causing the needles during each movement thereof in one direction or another to knit a course of fabric, a program card and a card reader for reading rows of instruction marks on the card for a design to be formed in a fabric in courses corresponding to said rows, electronic control means responsive to the reader and operably connected to the needle selecting means for controlling the knitting of fabric pursuant to the instruction marks, switch means operably connect to the electronic means, the switch means being manually operable to modify the operation of the electronic control means and thereby control the order in which design rows are knit into courses on the machine, and a device responsive to the operation of the switch means for visually indicating a knitting order as prescribed by the switch means for the design rows.

2. The combination of claim 1 wherein the switch means includes a switch operable to cause the same design row to be formed in successive courses as fabric is knit.

3. The combination of claim 1 wherein said device operably connects with the electronic control means and the switch means includes a switch movable into one position to cause said device to successively and cyclically indicate the instruction rows and movable from said one position to cause said device to hold the indication display at that time, the electronic control means being effective to cause the row indicated to be formed when knitting is begun after removal of the switch from said one position and as knitting is continued to cause successive rows on the card to be formed in the fabric and indicated on said device.

4. The combination of claim 3 wherein the successive indications of rows on said device after the operation of said switch occurs slowly at first and thereafter more quickly.

5. The combination of claim 3 wherein the switch is effective to change the indication on said device unless the carriage is in mid-course.

6. The combination of claim 3 wherein the display is immediately stepped to the next indication when the switch is operated.

7. The combination of claim 1 wherein said device indicates design rows, the switch means includes a switch momentarily operable and effective whenever so operated to cause a new indication to appear on said device, the electronic control means being effective when knitting is begun after operation of the switch to cause the last row indicated to be knit and as knitting is continued to cause successive rows to be knit and indicated on said device.

8. The combination of claim 7 wherein the switch is effective to change the indication on said device unless the carriage is in mid-course.

9. The combination of claim 7 wherein the display is immediately stepped to the next indication when the switch is operated.

10. The combination of claim 1 wherein the switch means includes one or more switches operable to cause said device to successively and cylically indicate the instruction rows in the order prescribed for knitting or in reverse order at the time of operation and movable after such operation to cause said device to hold the indication displayed at that time, the electronic control means being effective to cause the held row to be formed when knitting is thereafter initiated and as knitting is continued to cause successive rows to be knit and indicated.

11. The combination of claim 1 wherein the switch means includes a switch operable to effect a reversal in the order of knitting design rows.

12. The combination of claim 11 wherein the switch means also includes a switch operable to cause the same design row to be formed in successive courses as fabric is knit.

* * * * *

UNITED STATES PATENT OFFICE

CERTIFICATE OF CORRECTION

Patent No. 4,015,445 Dated April 5, 1977

Inventor(s) William Kahan et al.

It is certified that error appears in the above-identified patent and that said Letters Patent are hereby corrected as shown below:

Column 1, line 18, "85953" should read -- 85853 --.

Column 2, line 49 after "Ser. Nos." insert -- 627,173 --.

Column 3, line 61, after "to" insert -- be --.

Column 6, line 12, "carrige" should read -- carriage --.

Column 6, line 24, "cuase" should read -- cause --.

Column 6, line 30, "Knittig" should read -- Knitting --.

Column 8, line 36, "on" should read -- one --.

Column 9, line 63, "he" should read -- He --.

Column 12, line 46, "with" should read -- when --.

Column 13, line 4, "protions" should read -- portions --.

Column 13, line 66, after "520.2" insert -- 520.3 --.

Column 19, line 27, "Pip" should read -- PIP --.

Column 21, line 34, "On" should read -- One --.

UNITED STATES PATENT OFFICE

CERTIFICATE OF CORRECTION

Patent No. 4,015,445 Dated April 5, 1977

Inventor(s) William Kahan et al.

It is certified that error appears in the above-identified patent and that said Letters Patent are hereby corrected as shown below:

Column 21, line 61, after "gage" delete "672" and insert -- 692 --.

Column 22, line 16, "I/0" should read -- I/O --.

Column 22, line 34, after "the" (first occurrence) delete "Data" and insert -- computer --.

Column 22, line 60, "I/0 should read -- I/O --.

Column 23, line 30, after "number" delete "2" and insert -- "two" --.

Column 23, line 32, after "number" delete "1" and insert -- "one" --.

Column 24, line 33, after "20" delete "clear" and insert -- clears --.

Column 25, line 14, after "and" (first occurrence) insert -- 58 --.

Column 25, line 59, after "PIP" (first occurrence) "a" should read -- A --.

UNITED STATES PATENT OFFICE

CERTIFICATE OF CORRECTION

Patent No. 4,015,445 Dated April 5, 1977

Inventor(s) William Kahan et al.

It is certified that error appears in the above-identified patent and that said Letters Patent are hereby corrected as shown below:

Column 26, line 33 "I/0" should read -- I/O --.

Column 26, line 67, "display" should read -- displayed --.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*

UNITED STATES PATENT OFFICE
CERTIFICATE OF CORRECTION

Patent No. 4,015,445 Dated April 5, 1977

Inventor(s) William Kahan, et al.

It is certified that error appears in the above-identified patent and that said Letters Patent are hereby corrected as shown below:

Column 1, line 18, "85953" should read -- 85853 --.

Column 2, line 49 after "Ser. Nos." insert -- 627,173 --.

Column 3, line 61, after "to" insert -- be --.

Column 6, line 12, "carrige" should read -- carriage --.

Column 6, line 24, "cuase" should read -- cause --.

Column 6, line 30, "Kinttig" should read -- Knitting --.

Column 8, line 36, "on" should read -- one --.

Column 9, line 63, "he" should read -- He --.

Column 12, line 46, "with" should read -- when --.

Column 13, line 4, "protions" should read -- portions --.

Column 13, line 66, after "520.2" insert -- 520.3 --.

Column 19, line 27, "Pip" should read -- PIP --.

Column 21, line 34, "On" should read -- One --.

UNITED STATES PATENT OFFICE
CERTIFICATE OF CORRECTION

Patent No. 4,015,445 Dated April 5, 1977

Inventor(s) William Kahan, et al.

It is certified that error appears in the above-identified patent and that said Letters Patent are hereby corrected as shown below:

Column 21, line 61, after "gage" delete "672" and insert -- 692 --.

Column 22, line 16, "I/0" should read -- I/O --.

Column 22, line 34, after "the" (first occurrence) delete "Data" and insert -- computer --.

Column 22, line 60, "I/0" should read -- I/O --.

Column 23, line 30, after "number" delete "2" and insert -- "two" --.

Column 23, line 32, after "number" delete "1" and insert -- "one" --.

Column 24, line 33, after "20" delete "clear" and insert -- clears --.

Column 25, line 14, after "and" (first occurrence) insert -- 58 --.

Column 25, line 59, after "PIP" (first occurrence) "a" should read -- A --.

UNITED STATES PATENT OFFICE

CERTIFICATE OF CORRECTION

Patent No. 4,015,445 Dated April 5, 1977

Inventor(s) Willaim Kahan, et al.

It is certified that error appears in the above-identified patent and that said Letters Patent are hereby corrected as shown below:

Column 26, line 33, "I/0" should read -- I/0 --.

Column 26, line 67, "display" should read -- displayed --.

The appended computer program, referred to as an appendix in column 24, line 29 is attached (Columns 29 thru 64 )

This certificate supersedes certificate issued August 23, 1977.

Signed and Sealed this

Sixteenth Day of May 1978

[SEAL]

Attest:

RUTH C. MASON
Attesting Officer

LUTRELLE F. PARKER
Acting Commissioner of Patents and Trademarks

APPENDED DETAIL PROGRAM LISTING

```
0400                        AHS     X'400'
0400              KPROG     PSEG
0400                        MODE
0400              REG0      EQU     X'88'
0400              REG1      EQU     X'89'
0400              REG2      EQU     X'8A'
0400              REG3      EQU     X'8B'
0400              REG4      EQU     X'8C'
0400              REG5      EQU     X'8D'
0400              REG6      EQU     X'8E'
0400              REG7      EQU     X'8F'
0400 70810402               XWB     KSTART
0402 44840000     KSTART    LA      4,0
0404 44850400               LA      5,KPROG
0406 44860000               LA      6,0
0408 44870E00               LA      7,X'E00'
040A 0820008C               LDCR    (X'20',0),REG4
040C 34240800               SETB    X'24',1
040E 34250800               SETB    X'25',1
0410 0920008C               LDCR    (X'120',0),REG4
0412 44800F00               LA      0,MOTIF
0414 49840088               ST      4,*REG0
0416 4C800001               AA      0,+1
0418 C080136A               CRA     0,ATLAST
041A E08C0414               BC      12,$-6
041C 3010001C               BRNE    X'10',0,$
041E 448000C8               LA      0,200
0420 48801366               ST      0,C1POS
0422 44800E00               LA      0,RWZERO
0424 74830728               BL      3,ADAPT
0426 44800E00               LA      0,RWZERO
0428 74830434               BL      3,ADD2
042A 44800E21               LA      0,RZREND
042C 74830728               BL      3,ADAPT
042E 44800E21               LA      0,RZREND
0430 74830434               BL      3,ADD2
0432 70820444               B       ADESGO
0434 4C830002     ADD2      AA      3,2
0436 48830443               ST      3,ADDEX+1
0438 45020088               L       2,*REG0
043A 588203FF               NA      2,X'3FF'
043C 45010088               L       1,*REG0
043E 5C01008A               OR      1,REG2
0440 49810088               ST      1,*REG0
0442 70820442     ADDEX     B       $
0444 E4800088     ADESGO    STPS    REG0
0446 58800001               NA      0,1
0448 E088044C               BC      11,PMODE
044A 70820BC2               B       AUTOD
044C 0820408C     PMODE     LDCR    (X'20',4),REG4
044E 34240800               SETB    X'24',1
0450 34250800               SETB    X'25',1
0452 0920008C               LDCR    (X'120',0),REG4
0454 44000E20               L       0,RTMCON
0456 48801334               ST      0,RTIMER
0458 4400135F               L       0,PFIRST
045A E08A046C               BC      10,PMODE1
045C 2D121088               STCR    (X'112',1),REG0
045E 58800001               NA      0,1
0460 48801360               ST      0,CI1
0462 2D151088               STCR    (X'115',1),REG0
0464 58800001               NA      0,1
0466 48801361               ST      0,AR1
0468 44800001               LA      0,1
046A 4880135F               ST      0,PFIRST
046C 74830616     PMODE1    BL      3,PPIPCK
046E 2D121088               STCR    (X'112',1),REG0
0470 58800001               NA      0,1
0472 C0001360               CR      0,CI1
0474 E088047A               BC      11,$+6
0476 4880131E               ST      0,VMIR
0478 48801360               ST      0,CI1
047A 2D151088               STCR    (X'115',1),REG0
```

```
74   047C 58800001          NA    0,1
75   047E C0001361          CR    0,AR1
76   0480 E0880486          BC    11,$+6
77   0482 4880131F          ST    0,HMIH
78   0484 48801361          ST    0,AR1
79   0486 44800E00          LA    0,RWZERO
80   0488 748307A8          BL    3,READ
81   048A E08A046C          BC    10,PMODE1
82   048C 44800E21          LA    0,RZREND
83   048E 748307A8          BL    3,READ
84   0490 E08A046C          BC    10,PMODE1
85   0492 44800E16          LA    0,SA
86   0494 74830728          BL    3,ADAPT
87   0496 44800E16 SACHK    LA    0,SA
88   0498 748307A8          BL    3,READ
89   049A E08A04A0          BC    10,RWZCHK
90   049C 74830616          BL    3,PPIPCK
91   049E 70820496          B     SACHK
92   04A0 44800E00 RWZCHK   LA    0,RWZERO
93   04A2 748307A8          BL    3,READ
94   04A4 E08A046C          BC    10,PMODE1
95   04A6 44800E01          LA    0,R0
96   04A8 74830728          BL    3,ADAPT
97   04AA C0800E15          CRA   0,R0+20
98   04AC E08B04B2          BC    11,$+6
99   04AE 4C800001          AA    0,+1
100  04B0 708204A8          B     $-8
101  04B2 44800E17          LA    0,SB
102  04B4 74830728          BL    3,ADAPT
103  04B6 48841329 KDCARD   ST    4,CARDOK
104  04B8 4884132A          ST    4,N1FLAG
105  04BA 4884132B          ST    4,COLPOS
106  04BC 4884135C          ST    4,SAFLAG
107  04BE 44800079          LA    0,X'79'
108  04C0 4880135D          ST    0,CHKSUM
109  04C2 44800001          LA    0,1
110  04C4 4880132C          ST    0,SALEV
111  04C6 74830616 COLCHK   BL    3,PPIPCK
112  04C8 44800E16          LA    0,SA
113  04CA 748307A8          BL    3,READ
114  04CC C001132C          CR    1,SALEV
115  04CE E08B04C6          BC    11,COLCHK
116  04D0 4881132C          ST    1,SALEV
117  04D2 44800E17          LA    0,SB
118  04D4 748307A8          BL    3,READ
119  04D6 E08B04C6          BC    11,COLCHK
120  04D8 4400132C          L     0,SALEV
121  04DA E08B04E4          BC    11,CARDIN
122  04DC 4400132B          L     0,COLPOS
123  04DE 50800001          SA    0,+1
124  04E0 4880132B          ST    0,COLPOS
125  04E2 708204C6          B     COLCHK
126  04E4 4402132B CARDIN   L     2,COLPOS
127  04E6 E08C044C          BC    12,PMODE
128  04E8 44800E01          LA    0,R0
129  04EA 46220E41          L     2,COLADR,2
130  04EC 748307A8 RNXTRW   BL    3,READ
131  04EE 4981008A          ST    1,*REG2
132  04F0 4C800001          AA    0,+1
133  04F2 4C820001          AA    2,+1
134  04F4 C0800E16          CRA   0,SA
135  04F6 E08B04FA          BC    11,$+4
136  04F8 708204EC          B     RNXTRW
137  04FA 44800E22          LA    0,SAWHT
138  04FC 748307A8          BL    3,READ
139  04FE 44010E16          L     1,SA
140  0500 0920F089          LDCR  (X'120',15),REG1
141  0502 4481000D          LA    1,X'000D'
142  0504 0C1F0504          ARR   -1,$,1
143  0506 2D1C1089          STCR  (X'11C',1),REG1
144  0508 58810001          NA    1,1
145  050A E0880510          BC    11,WHOK
146  050C 44800001          LA    0,1
147  050E 4880135C          ST    0,SAFLAG
148  0510 4400132B WHOK     L     0,COLPOS
```

```
0512 C0800025          CRA   0,37
0514 E08B051C          BC    11,ACR
0516 4C800001          AA    0,+1
0518 48801328          ST    0,COLPOS
051A 708204C6          B     COLCHK
051C 74830616 ACR      BL    3,PPIPCK
051E 44800E00          LA    0,RWZERO
0520 748307A8          BL    3,READ
0522 E08B051C          BC    11,ACR
0524 44800E1E          LA    0,RWZER2
0526 748307A8          BL    3,READ
0528 E08B051C          BC    11,ACR
052A 44800E1F          LA    0,RWZER3
052C 748307A8          BL    3,READ
052E E08B051C          BC    11,ACR
0530 4400135C          L     0,SAFLAG
0532 40800001          XORA  0,1
0534 48801329          ST    0,CARDOK
0536 7082053C          B     $+6
0538 44800001 ACR1     LA    0,+1
053A 48801329          ST    0,CARDOK
053C 48841309          ST    4,COL38
053E 4884130A          ST    4,COL38+1
0540 4884130B          ST    4,COL38+2
0542 44811000          LA    1,COL1
0544 44800000          LA    0,0
0546 45020089 CAGN     L     2,*REG1
0548 E088054C          BC    11,$+4
054A 4C800001          AA    0,1
054C C081131D          CRA   1,COL38+20
054E E0880554          BC    11,$+6
0550 4C810001          AA    1,1
0552 70820546          B     CAGN
0554 4880135E          ST    0,REMNUM
0556 44810001          LA    1,1
0558 44830000          LA    3,0
055A 58800001          NA    0,1
055C E0880560          BC    11,REMA
055E 4C830001          AA    3,1
0560 60010089 REMA     MLA   1,REG1
0562 C081000A          CRA   1,10
0564 E08C0568          BC    12,$+4
0566 5081000A          SA    1,10
0568 6401135E          MRA   1,REMNUM
056A 4400135E          L     0,REMNUM
056C E088057C          BC    11,REMB
056E 58800001          NA    0,1
0570 E0880560          BC    11,REMA
0572 4C030089          A     3,REG1
0574 C083000A          CRA   3,10
0576 E08C0560          BC    12,REMA
0578 5083000A          SA    3,10
057A 70820560          B     REMA
057C 4883135E REMB     ST    3,REMNUM
057E E08A0586          BC    10,$+8
0580 4483003F          LA    3,X'3F'
0582 4883135D          ST    3,CHKSUM
0584 7082058C          B     $+8
0586 50830001          SA    3,1
0588 46330E23          L     3,LCCODE,3
058A 4883135D          ST    3,CHKSUM
058C 44001314          L     0,COL38+11
058E 4880131E          ST    0,VMIR
0590 44001312          L     0,COL38+9
0592 4880131F          ST    0,HMIR
0594 44830000          LA    3,0
0596 48831324          ST    3,SELVC
0598 44800000          LA    0,0
059A 4C800001 SCLOOP   AA    0,1
059C 4601130B          L     1,COL38+2,0
059E E08805A4          BC    11,$+6
05A0 4C830001          AA    3,1
05A2 48801324          ST    0,SELVC
05A4 C0800005          CRA   0,5
05A6 E08C059A          BC    12,SCLOOP
```

```
05A8 C0830002          CRA    3,2
05AA E08C05B2          BC     12,$+8
05AC 44830001          LA     3,1
05AE 48831358          ST     3,DOPTN
05B0 7082044C          B      PMODE
05B2 44800000          LA     0,0
05B4 460112F5          L      1,COL37+1,0
05B6 E08A05C0          BC     10,$+10
05B8 C0800013          CRA    0,19
05BA E08805C0          BC     11,$+6
05BC 4C800001          AA     0,+1
05BE 708205B4          B      $-10
05C0 48801322          ST     0,THOWC
05C2 E08A05C6          BC     10,$+4
05C4 4884131E          ST     4,VMIR
05C6 44800000          LA     0,0
05C8 47010E41          L      1,*COLADR,0
05CA E08A05D4          BC     10,$+10
05CC C0800023          CRA    0,35
05CE E08B05D4          BC     11,$+6
05D0 4C800001          AA     0,+1
05D2 708205C8          B      $-10
05D4 48801320          ST     0,COLEND
05D6 E08A05DA          BC     10,$+4
05D8 4884131F          ST     4,HMIR
05DA 44830000          LA     3,0
05DC 48831323          ST     3,RRC
05DE 44800000          LA     0,0
05E0 4C800001 RRLOOP   AA     0,1
05E2 46011319          L      1,COL38+16,0
05E4 E08B05EA          BC     11,$+6
05E6 4C830001          AA     3,1
05E8 48801323          ST     0,RRC
05EA C0800003          CRA    0,3
05EC E08C05E0          BC     12,RRLOOP
05EE C0830002          CRA    3,2
05F0 E08C05F8          BC     12,$+8
05F2 44830001          LA     3,1
05F4 48831358          ST     3,DOPTN
05F6 7082044C          B      PMODE
05F8 44830000          LA     3,0
05FA 48831321          ST     3,CRC
05FC 44800000          LA     0,0
05FE 4C800001 CRLOOP   AA     0,1
0600 46011315          L      1,COL38+12,0
0602 E08B0608          BC     11,$+6
0604 4C830001          AA     3,1
0606 48801321          ST     0,CRC
0608 C0800003          CRA    0,3
060A E08C05FE          BC     12,CRLOOP
060C C0830002          CRA    3,2
060E E08C044C          BC     12,PMODE
0610 44830001          LA     3,1
0612 48831358          ST     3,DOPTN
0614 7082044C          B      PMODE
0616 4C830002 PPIPCK   AA     3,2
0618 48830727          ST     3,PPEXIT+1
061A 2C111088          STCR   (X'11',1),REG0
061C C000132F          CR     0,ALEVEL
061E E08B065A          BC     11,MOTCK
0620 4880132F          ST     0,ALEVEL
0622 30120A5A          BBNE   X'12',1,MOTCK
0624 4400132A          L      0,N1FLAG
0626 E08B0638          BC     11,CKALVL
0628 44001321          L      0,CRC
062A C0001363          CR     0,CRC00
062C E08B0630          BC     11,$+4
062E 70820636          B      $+8
0630 4400131F          L      0,HMIR
0632 C0001362          CR     0,AR00
0634 E08B0638          BC     11,CKALVL
0636 4884132A          ST     4,N1FLAG
0638 4400132F CKALVL   L      0,ALEVEL
063A E08B064A          BC     11,PRIGHT
063C 48841325          ST     4,DIRNOW
063E 50860001          SA     6,1
0640 588600FF          NA     6,X'FF'
```

```
0642 4400132A          L     0,N1FLAG
0644 E08B0686          BC    11,PMODCK
0646 74830B0C          BL    3,COLDEC
0648 70820686          B     PMODCK
064A 44800001 PRIGHT   LA    0,1
064C 48801325          ST    0,DIRNOW
064E 4C860001          AA    6,1
0650 588600FF          NA    6,X'FF'
0652 4400132A          L     0,N1FLAG
0654 E08B0686          BC    11,PMODCK
0656 74830ACA          BL    3,COLINC
0658 70820686          B     PMODCK
065A 2D182088 MOTCK    STCR  (X'118',2),REG0
065C E08B0662          BC    11,CKN1
065E 58800001          NA    0,1
0660 4AE00F00          ST    0,MOTIF,6
0662 44001329 CKN1     L     0,CARDOK
0664 E0880686          BC    11,PMODCK
0666 2D111088          STCR  (X'111',1),REG0
0668 48801338          ST    0,LRREV
066A C0061366          CR    6,C1POS
066C E08B0670          BC    11,$+4
066E 31140A86          BBNE  X'114',1,PMODCK
0670 4884132D          ST    4,CRCNOW
0672 4884132E          ST    4,COLUMN
0674 48841337          ST    4,CADJR
0676 48841338          ST    4,CADJL
0678 48861366          ST    6,C1POS
067A 44800001          LA    0,1
067C 4880132A          ST    0,N1FLAG
067E 4400131F          L     0,HMIR
0680 48801362          ST    0,AR00
0682 44001321          L     0,CRC
0684 48801363          ST    0,CRC00
0686 31100B86 PMODCK   BBNE  X'110',1,KMODE0
0688 30100000          BBNE  X'10',0,KPROG
068A 4400132E          L     0,COLUMN
068C 4C800001          AA    0,+1
068E E4800089          STPS  REG1
0690 58810400          NA    1,X'0400'
0692 E08B0696          BC    11,$+4
0694 4400008E          L     0,REG6
0696 4080FFFF          XORA  0,X'FFFF'
0698 08268088          LDCR  (X'26',8),REG0
069A 2D162088          STCR  (X'116',2),REG0
069C E0880700          BC    11,MIRXT
069E 58800001          NA    0,1
06A0 E08A06D0          BC    10,CLRPST
06A2 44001323          L     0,RRC
06A4 46000E37          L     0,RRCODE,0
06A6 5C800001          ORA   0,1
06A8 08204088          LDCR  (X'20',4),REG0
06AA 0926A08C          LDCR  (X'126',10),REG4
06AC 2D1F1088          STCR  (X'11F',1),REG0
06AE C0001365          CR    0,LAST82
06B0 E08B0726          BC    11,PPEXIT
06B2 48801365          ST    0,LAST82
06B4 44001334          L     0,RTIMER
06B6 50800001          SA    0,1
06B8 48801334          ST    0,RTIMER
06BA E08A0726          BC    10,PPEXIT
06BC 44001323          L     0,RRC
06BE C0800003          CRA   0,3
06C0 E08C06C6          BC    12,$+6
06C2 44800000          LA    0,0
06C4 708206C8          B     $+4
06C6 4C800001          AA    0,1
06C8 48801323          ST    0,RRC
06CA 44000E20          L     0,RTMCON
06CC 48801334          ST    0,RTIMER
06CE 70820726          B     PPEXIT
06D0 44001321 CLRPST   L     0,CRC
06D2 46000E37          L     0,RRCODE,0
06D4 08204088          LDCR  (X'20',4),REG0
06D6 4400131F          L     0,HMIR
```

```
06D8 E08806DE          BC     11,$+6
06DA 44800209          LA     0,X'209'
06DC 708206E0          B      $+4
06DE 44800009          LA     0,9
06E0 0926A088          LDCR   (X'126',10),REG0
06E2 2D1F1088          STCR   (X'11F',1),REG0
06E4 C0001365          CR     0,LAST82
06E6 E0880726          BC     11,PPEXIT
06E8 48801365          ST     0,LAST82
06EA 44001334          L      0,RTIMER
06EC 50800001          SA     0,1
06EE 48801334          ST     0,RTIMER
06F0 E08A0726          BC     10,PPEXIT
06F2 44001321          L      0,CRC
06F4 C0800003          CRA    0,3
06F6 E08C06FC          BC     12,$+6
06F8 44800000          LA     0,0
06FA 708206FE          B      $+4
06FC 4C800001          AA     0,1
06FE 48801321          ST     0,CRC
0700 44000E20 MIRXT    L      0,RTMCON
0702 48801334          ST     0,RTIMER
0704 2C141088          STCR   (X'014',1),REG0
0706 58800001          NA     0,1
0708 E08A071A          BC     10,CSOUT
070A 44001369          L      0,CSFLAG
070C E08A0710          BC     10,CKACR
070E 70820726          B      PPEXIT
0710 44800000 CKACR    LA     0,0
0712 48801369          ST     0,CSFLAG
0714 44001329          L      0,CARDOK
0716 E08A0726          BC     10,PPEXIT
0718 7082046C          B      PMODE1
071A 44800001 CSOUT    LA     0,1
071C 48801369          ST     0,CSFLAG
071E 44001350          L      0,CHKSUM
0720 0926A088          LDCR   (X'126',10),REG0
0722 0820408C          LDCR   (X'20',4),REG4
0724 7082061A          B      PPIPCK+4
0726 70820726 PPEXIT   B      $
0728 4C830002 ADAPT    AA     3,2
072A 488307A7          ST     3,ADXIT+1
072C 45010088          L      1,*REG0
072E 0920A089          LDCR   (X'120',10),REG1
0730 44020E18          L      2,SELDLY
0732 50020E1D          S      2,ADPTIM
0734 E09C0738          BC     12,$+4
0736 0C2F0736          ARR    -1,$,2
0738 4481000F          LA     1,X'000F'
073A 44820010          LA     2,X'0010'
073C 092A5089 ADLOOP   LDCR   (X'12A',5),REG1
073E 6401008A          MRA    1,REG2
0740 44030E1C          L      3,ADPDLY
0742 0C3F0742          ARR    -1,$,3
0744 311C034E          BRNE   X'11C',0,VALHI
0746 C0820000          CRA    2,0
0748 E0880758          BC     11,LOXIT
074A 5001008A          S      1,REG2
074C 7082073C          B      ADLOOP
074E C0820000 VALHI    CRA    2,0
0750 E0880756          BC     11,HIXIT
0752 4C01008A          A      1,REG2
0754 7082073C          B      ADLOOP
0756 4C810001 HIXIT    AA     1,1
0758 4081001F LOXIT    XORA   1,X'001F'
075A 4483001F          LA     3,X'001F'
075C 0920A08B          LDCR   (X'120',10),REG3
075E 44020088          L      2,REG0
0760 50820E01          SA     2,R0
0762 4AA11344          ST     1,ATABLE,2
0764 C0810019          CRA    1,25
0766 E09C076C          BC     12,$+6
0768 50810005          SA     1,5
076A 70820782          B      SABCK
076C C081000F          CRA    1,15
```

```
076E E08C0774          BC     12,$+6
0770 50810003          SA     1,3
0772 70820782          B      SABCK
0774 C081000A          CRA    1,10
0776 E08C077C          BC     12,$+6
0778 50810002          SA     1,2
077A 70820782          B      SABCK
077C C0810005          CRA    1,5
077E E08C0782          BC     12,$+4
0780 50810001          SA     1,1
0782 C0800E16 SABCK    CRA    0,SA
0784 E08B078E          BC     11,$+10
0786 C0800E17          CRA    0,SB
0788 E08B0792          BC     11,$+10
078A 50810002          SA     1,2
078C 70820794          B      $+8
078E 50810003          SA     1,3
0790 70820794          B      $+4
0792 50810003          SA     1,3
0794 E08C079B          BC     12,$+4
0796 7082079A          B      $+4
0798 44810000          LA     1,0
079A 4081001F          XORA   1,X'1F'
079C 45020088          L      2,*REG0
079E 588203FF          NA     2,X'3FF'
07A0 68060089          MRR    6,REG1
07A2 5C01008A          OR     1,REG2
07A4 49810088          ST     1,*REG0
07A6 708207A6 ADXIT    B      $
07A8 45010088 READ     L      1,*REG0
07AA 0920F089          LDCR   (X'120',15),REG1
07AC 44010E1B          L      1,SELDLY
07AE 0C1F07AE          ARR    -1,$,1
07B0 2D1C1089          STCR   (X'11C',1),REG1
07B2 58810001          NA     1,1
07B4 72820002          B      +2,3
07B6 70070000 KMODE0   NOP
07B8 44001321 CMPCRC   L      0,CRC
07BA C0001363          CR     0,CRC00
07BC E08B07C2          BC     11,CMPHMR
07BE 4884132A          ST     4,N1FLAG
07C0 708207CC          B      KMODE
07C2 4400131F CMPHMR   L      0,HMIR
07C4 C0001362          CR     0,AR00
07C6 E08B07CC          BC     11,KMODE
07C8 4884132A          ST     4,N1FLAG
07CA 708207CC          B      KMODE
07CC 4884135F KMODE    ST     4,PFIRST
07CE 44001329 KMODE2   L      0,CARDOK
07D0 E08A07D6          BC     10,K2D
07D2 44800079          LA     0,X'79'
07D4 708207E4          B      STDBUF
07D6 4400135B K2D      L      0,DOPTN
07D8 E08B07DE          BC     11,N1F
07DA 44800179          LA     0,X'179'
07DC 708207E4          B      STDBUF
07DE 4400132A N1F      L      0,N1FLAG
07E0 E08A07EC          BC     10,PRESET
07E2 448000F9          LA     0,X'F9'
07E4 48801335 STDBUF   ST     0,DBUF1
07E6 48841336          ST     4,DBUF2
07E8 748309E8          BL     3,KPIPCK
07EA 708207E8          B      $-2
07EC 48841332 PRESET   ST     4,CROWN
07EE 48841331          ST     4,RRCNOW
07F0 4400131E          L      0,VMIR
07F2 58800001          NA     0,1
07F4 40800001          XORA   0,1
07F6 48801330          ST     0,AHROW
07F8 44001338 ADJ      L      0,CADJL
07FA E08B0804          BC     11,$+10
07FC 44020E67          L      2,ROFFST
07FE 74830ACA          BL     3,COLINC
0800 0C2107FE          ARR    +1,$-2,2
0802 48841338          ST     4,CADJL
```

```
0804 44001337          L     0,CADJR
0806 E08B0810          BC    11,DBUF12
0808 44020E68          L     2,LOFFST
080A 74830B0C          BL    3,COLDEC
080C 0C21080A          ARR   +1,$-2,2
080E 48841337          ST    4,CADJR
0810 44001332 DBUF12   L     0,CROWN
0812 46000E23          L     0,LCCODE,0
0814 48801335          ST    0,DBUF1
0816 44001330          L     0,ARROW
0818 48801336          ST    0,DBUF2
081A E08B082A          BC    11,SETDWN
081C 44001323 SETRRC   L     0,RRC
081E E08B0832          BC    11,AWAIT
0820 44001331          L     0,RRCNOW
0822 46000E37          L     0,RRCODE,0
0824 5C001336          OR    0,DBUF2
0826 48801336          ST    0,DBUF2
0828 70820832          B     AWAIT
082A 44001335 SETDWN   L     0,DBUF1
082C 5C800200          ORA   0,X'200'
082E 48801335          ST    0,DBUF1
0830 7082081C          B     SETRRC
0832 748309E8 AWAIT    BL    3,KPIPCK
0834 44001340          L     0,NEWPOS
0836 E08B0848          BC    11,RADVCK
0838 48841340          ST    4,NEWPOS
083A 44001325          L     0,DIRNOW
083C E08B0844          BC    11,LFBUT
083E 2D1A1088          STCR  (X'11A',1),REG0
0840 E08C0892          BC    12,SOR
0842 70820848          B     RADVCK
0844 2D1B1088 LFBUT    STCR  (X'11B',1),REG0
0846 E08C0892          BC    12,SOR
0848 2D162088 RADVCK   STCR  (X'116',2),REG0
084A E08B088E          BC    11,RA50
084C 44001368          L     0,UDBUSY
084E E08B0880          BC    11,RA40
0850 2D1F1088          STCR  (X'11F',1),REG0
0852 C000133A          CR    0,LAST81
0854 E08B0832          BC    11,AWAIT
0856 4880133A          ST    0,LAST81
085B 44001339          L     0,MTIMER
085A 50800001          SA    0,+1
085C 48801339          ST    0,MTIMER
085E E08A0832          BC    10,AWAIT
0860 44001367          L     0,SLOWC
0862 E08B087C          BC    11,RA30
0864 50800001          SA    0,+1
0866 48801367          ST    0,SLOWC
0868 44000E6C          L     0,SLOWN
086A 48801339 RA10     ST    0,MTIMER
086C 2D171088          STCR  (X'117',1),REG0
086E E08B0874          BC    11,RA20
0870 74830B48          BL    3,RADVF
0872 70820810          B     DBUF12
0874 2D161088 RA20     STCR  (X'116',1),REG0
0876 E08B0832          BC    11,AWAIT
0878 74830B84          BL    3,RADVR
087A 70820810          B     DBUF12
087C 44000E6D RA30     L     0,FASTN
087E 7082086A          B     RA10
0880 44800001 RA40     LA    0,1
0882 48801368          ST    0,UDBUSY
0884 44800002          LA    0,2
0886 48801339          ST    0,MTIMER
0888 44800003          LA    0,3
088A 48801367          ST    0,SLOWC
088C 70820832          B     AWAIT
088E 48841368 RA50     ST    4,UDBUSY
0890 70820832          B     AWAIT
0892 44001325 SOR      L     0,DIRNOW
0894 48801326          ST    0,DIRFIX
0896 E08B08A4          BC    11,$+14
0898 44020E67          L     2,ROFFST
```

```
089A 74830ACA          BL    3,COLINC
089C 0C21089A          ARR   +1,$-2,2
089E 44800001          LA    0,1
08A0 48801337          ST    0,CADJR
08A2 708208AE          B     $+12
08A4 44020E68          L     2,LOFFST
08A6 74830B0C          BL    3,COLDEC
08A8 0C2108A6          ARR   +1,$-2,2
08AA 44800001          LA    0,1
08AC 48801338          ST    0,CADJL
08AE 48841330          ST    4,JAMCHK
08B0 48841330          ST    4,OFF3F
08B2 44B0FFFD          LA    0,-3
08B4 48801330          ST    0,OFF3C
08B6 44800001          LA    0,1
08B8 48801330          ST    0,ENBACT
08BA 44001324          L     0,SELVC
08BC 44810000          LA    1,0
08BE C0800000          CRA   0,0
08C0 E08B08CA          BC    11,$+10
08C2 60010089          MLA   1,REG1
08C4 5CB10020          ORA   1,X'0020'
08C6 50800001          SA    0,+1
08C8 708208BE          B     $-10
08CA 48811341          ST    1,SELVZ
08CC 748309E8 KNXT     BL    3,KPIPCK
08CE 44001340          L     0,NEWPOS
08D0 E08B08CC          BC    11,$-4
08D2 48841340 KNEWPS   ST    4,NEWPOS
08D4 44001325          L     0,DIRNOW
08D6 C0001326          CR    0,DIRFIX
08D8 E08B08E6          BC    11,GOKNIT
08DA 44001330          L     0,JAMCHK
08DC E08B08E0          BC    11,$+4
08DE 708207F8          B     ADJ
08E0 44800001          LA    0,1
08E2 48801330          ST    0,JAMCHK
08E4 708208CC          B     KNXT
08E6 44001330 GOKNIT   L     0,JAMCHK
08E8 E08B08EE          BC    11,$+6
08EA 48841330          ST    4,JAMCHK
08EC 708208CC          B     KNXT
08EE 44001341          L     0,SELVZ
08F0 64011341          MRA   1,SELVZ
08F2 58800002          NA    0,2
08F4 E0880904          BC    11,KNITP
08F6 20131089          STCR  (X'113',1),REG1
08F8 E08B08FE          BC    11,$+6
08FA 48841342          ST    4,KBIT
08FC 70820954          B     ADRPA
08FE 44800001          LA    0,1
0900 48801342          ST    0,KBIT
0902 70820954          B     ADRPA
0904 44001338 KNITP    L     0,LRREV
0906 E088090E          BC    11,KNITP1
0908 44001320          L     0,COLEND
090A 5000132E          S     0,COLUMN
090C 70820910          B     KNITP2
090E 4400132E KNITP1   L     0,COLUMN
0910 46000E41 KNITP2   L     0,COLADR,0
0912 4C001332          A     0,CROWN
0914 4CB00001          AA    0,+1
0916 45000088          L     0,*REG0
0918 48801342          ST    0,KBIT
091A 44800001          LA    0,1
091C 488009E6          ST    0,FINCLR
091E 20182088          STCR  (X'118',2),REG0
0920 E088094A          BC    11,CLIN
0922 E08A0930          BC    10,MTFCK
0924 20121089          STCR  (X'112',1),REG1
0926 E0880930          BC    11,MTFCK
0928 44001342          L     0,KBIT
092A 40800001          XORA  0,1
092C 48801342          ST    0,KBIT
092E 488409E6          ST    4,FINCLR
```

```
0930 44001326 MTFCK    L      0,DIRFIX
0932 F0880938          BC     11,$+6
0934 44000E69          L      0,RMFST
0936 7082093A          B      $+4
0938 44000E6A          L      0,LMFST
093A 4C00008E          A      0,REG6
093C 588000FF          NA     0,X'FF'
093E 46000F00          L      0,MOTIF,0
0940 40800001          XORA   0,1
0942 58001342          N      0,KBIT
0944 48801342          ST     0,KBIT
0946 440109E6          L      1,FINCLR
0948 E08B0954          BC     11,ADRPA
094A 2D121089 CLIN     STCR   (X'112',1),REG1
094C E08B0954          BC     11,$+8
094E 44001342          L      0,KBIT
0950 40800001          XORA   0,1
0952 48801342          ST     0,KBIT
0954 2C121088 ADRPA    STCR   (X'12',1),REG0
0956 E08B0960          BC     11,ACKF
0958 748309E8 BLOW     BL     3,KPIPCK
095A 44001340          L      0,NEWPOS
095C E08B0954          BC     11,ADRPA
095E 708208D2          B      KNEWPS
0960 2C111088 ACKF     STCR   (X'11',1),REG0
0962 58800001          NA     0,1
0964 C0001326          CR     0,DIRFIX
0966 E08B096A          BC     11,$+4
0968 70820958          B      BLOW
096A 4400133E          L      0,ENBACT
096C E08B0982          BC     11,ACOFF
096E 44001342          L      0,KBIT
0970 F08B0982          BC     11,ACOFF
0972 44001326          L      0,DIRFIX
0974 E08B097C          BC     11,FIRLFT
0976 34250800          SETB   X'25',1
0978 34240000          SETB   X'24',0
097A 70820986          B      OFF3CK
097C 34240800 FIRLFT   SETB   X'24',1
097E 34250000          SETB   X'25',0
0980 70820986          B      OFF3CK
0982 34240800 ACOFF    SETB   X'24',1
0984 34250800          SETB   X'25',1
0986 4400133F OFF3CK   L      0,OFF3F
0988 E08B0982          BC     11,NOTOFF
098A 4400133C          L      0,OFF3C
098C 4C800001          AA     0,+1
098E 4880133C          ST     0,OFF3C
0990 C0800006          CRA    0,6
0992 E08C08CC          BC     12,KNXT
0994 4884133E          ST     4,ENBACT
0996 C0000E6B          CR     0,CARSIZ
0998 E08C08CC          BC     12,KNXT
099A 748309E8 AUTOCK   BL     3,KPIPCK
099C 44001325          L      0,DIRNOW
099E C0001326          CR     0,DIRFIX
09A0 E08B09AC          BC     11,INRASW
09A2 2D151088          STCR   (X'115',1),REG0
09A4 E08B09A8          BC     11,$+4
09A6 708207F8          B      ADJ
09A8 74830848          BL     3,RADVF
09AA 708207F8          B      ADJ
09AC 2D162088 INRASW   STCR   (X'116',2),REG0
09AE E08B099A          BC     11,AUTOCK
09B0 708207F8          B      ADJ
09B2 44001326 NOTOFF   L      0,DIRFIX
09B4 E08B098C          BC     11,$+8
09B6 2D1A1088          STCR   (X'11A',1),REG0
09B8 E08B09C6          BC     11,OFFONE
09BA 708209C0          B      $+6
09BC 2D181088          STCR   (X'11B',1),REG0
09BE E08B09C6          BC     11,OFFONE
09C0 4480FFFD          LA     0,-3
09C2 4880133C          ST     0,OFF3C
09C4 708208CC          B      KNXT
```

```
09C6 4400133C OFFONE   L     0,OFF3C
09C8 4C800001          AA    0,+1
09CA 4880133C          ST    0,OFF3C
09CC E08C08CC          BC    12,KNXT
09CE 44001324          L     0,SELVC
09D0 44810000          LA    1,0
09D2 C0800000          CRA   0,0
09D4 E08809DE          BC    11,$+10
09D6 64010089          MRA   1,REG1
09D8 5C810004          ORA   1,X'0004'
09DA 50800001          SA    0,+1
09DC 708209D2          B     $-10
09DF 48811341          ST    1,SELVZ
09E0 44800001          LA    0,1
09E2 4880133F          ST    0,OFF3F
09E4 708208CC          B     KNXT
09E6           FINCLR  RES   2
09E8 4C830002 KPIPCK   AA    3,+2
09EA 48830A11          ST    3,KPEXIT+1
09EC 2D10108B          STCR  (X'110',1),REG3
09EE E08809F2          BC    11,KP10
09F0 7082044C          B     PMODE
09F2 2C111088 KP10     STCR  (X'11',1),REG0
09F4 C000132F          CR    0,ALEVEL
09F6 E0880A20          BC    11,PWRCK
09F8 4880132F          ST    0,ALEVEL
09FA 2C12108B          STCR  (X'12',1),REG3
09FC E0880A20          BC    11,PWRCK
09FE 4400132F          L     0,ALEVEL
0A00 E0880A12          BC    11,KRIGHT
0A02 48841325          ST    4,DIRNOW
0A04 34240800          SETH  X'24',1
0A06 50860001          SA    6,1
0A08 588600FF          NA    6,X'FF'
0A0A 74830B0C          BL    3,COLDEC
0A0C 44800001 NEW      LA    0,1
0A0E 48801340          ST    0,NEWPOS
0A10 70820A10 KPEXIT   B     $
0A12 44800001 KRIGHT   LA    0,1
0A14 48801325          ST    0,DIRNOW
0A16 34250800          SETB  X'25',1
0A18 4C860001          AA    6,+1
0A1A 588600FF          NA    6,X'FF'
0A1C 74830ACA          BL    3,COLINC
0A1E 70820A0C          B     NEW
0A20 2D1E108B PWRCK    STCR  (X'11E',1),REG3
0A22 E08A0A26          BC    10,$+4
0A24 70820A5E          B     TURNON+4
0A26 2D1D108B          STCR  (X'11D',1),REG3
0A28 E0880A38          BC    11,PWRLOW
0A2A 4480003F          LA    0,X'3F'
0A2C 0926A088          LDCR  (X'126',10),REG0
0A2E 44800000          LA    0,0
0A30 08204088          LDCR  (X'20',4),REG0
0A32 2C101088          STCR  (X'10',1),REG3
0A34 E0880A32          BC    11,$-2
0A36 70820400          B     KPROG
0A38 2D1F1088 PWRLOW   STCR  (X'11F',1),REG0
0A3A C0001328          CR    0,LAST80
0A3C E0880A10          BC    11,KPEXIT
0A3E 48801328          ST    0,LAST80
0A40 44001333          L     0,FTIMER
0A42 4C800001          AA    0,+1
0A44 C0800050          CRA   0,X'50'
0A46 E08A0A4C          BC    10,FLASH
0A48 48801333          ST    0,FTIMER
0A4A 70820A10          B     KPEXIT
0A4C 48841333 FLASH    ST    4,FTIMER
0A4E 44001327          L     0,DONFLG
0A50 E08B0A5A          BC    11,TURNON
0A52 48841327          ST    4,DONFLG
0A54 0820408C          LDCR  (X'20',4),REG4
0A56 0926A08C          LDCR  (X'126',10),REG4
0A58 70820A10          B     KPEXIT
0A5A 44800001 TURNON   LA    0,1
```

```
826  0A5C 48801327          ST    0,DONFLG
827  0A5E 44001329 LRSELV   L     0,CARDOK
828  0A60 E08B0A9E          BC    11,LR4
829  0A62 2D1110B8          STCR  (X'111',1),REG0
830  0A64 C000133B          CR    0,LRREV
831  0A66 E08B0A9E          BC    11,LR4
832  0A68 44001337          L     0,CADJR
833  0A6A 5C001338          OR    0,CADJL
834  0A6C E08A0A9E          BC    10,LR4
835  0A6E 2D1F1088          STCR  (X'11F',1),REG0
836  0A70 C0001365          CR    0,LAST82
837  0A72 E08B0A92          BC    11,LR3
838  0A74 48801365          ST    0,LAST82
839  0A76 44001364          L     0,STIMER
840  0A78 4C800001          AA    0,+1
841  0A7A C0000E20          CR    0,RTMCON
842  0A7C E08A0A82          BC    10,LR1
843  0A7E 48801364          ST    0,STIMER
844  0A80 70820A92          B     LR3
845  0A82 48841364 LR1      ST    4,STIMER
846  0A84 44001324          L     0,SELVC
847  0A86 4C800001          AA    0,+1
848  0A88 C0800006          CRA   0,6
849  0A8A E08C0A90          BC    12,LR2
850  0A8C 48841324          ST    4,SELVC
851  0A8E 70820A92          B     LR3
852  0A90 48801324 LR2      ST    0,SELVC
853  0A92 44001324 LR3      L     0,SELVC
854  0A94 46010E3B          L     1,SELBUF,0
855  0A96 0926A089          LDCR  (X'126',10),REG1
856  0A98 44810001          LA    1,1
857  0A9A 08204089          LDCR  (X'20',4),REG1
858  0A9C 70820AC8          B     LEDCK
859  0A9E 48841364 LR4      ST    4,STIMER
860  0AA0 2C141088          STCR  (X'014',1),REG0
861  0AA2 E08B0AAC          BC    11,CHKE
862  0AA4 4400135D          L     0,CHKSUM
863  0AA6 0926A088          LDCR  (X'126',10),REG0
864  0AA8 0820408C          LDCR  (X'20',4),REG4
865  0AAA 70820AC8          B     LEDCK
866  0AAC 44001335 CHKE     L     0,DBUF1
867  0AAE C0800079          CRA   0,X'0079'
868  0AB0 E08B0AC2          BC    11,DSPBF1+2
869  0AB2 C0061366          CR    6,C1POS
870  0AB4 E08B0AB8          BC    11,$+4
871  0AB6 70820AC0          B     DSPBF1
872  0AB8 448000B9          LA    0,X'00B9'
873  0ABA 0926A088          LDCR  (X'126',10),REG0
874  0ABC 0820408C          LDCR  (X'20',4),REG4
875  0ABE 70820AC8          B     LEDCK
876  0AC0 44001335 DSPBF1   L     0,DBUF1
877  0AC2 0926A088          LDCR  (X'126',10),REG0
878  0AC4 44001336          L     0,DBUF2
879  0AC6 08204088          LDCR  (X'20',4),REG0
880  0AC8 70820A10 LEDCK    B     KPEXIT
881  0ACA 4400132D COLINC   L     0,CRCNOW
882  0ACC C0001321          CR    0,CRC
883  0ACE E08B0AD6          BC    11,$+8
884  0AD0 4C800001          AA    0,1
885  0AD2 4880132D          ST    0,CRCNOW
886  0AD4 72820002          B     +2,3
887  0AD6 4884132D          ST    4,CRCNOW
888  0AD8 4400131F          L     0,HMIR
889  0ADA E08B0B00          BC    11,INC3
890  0ADC 44001343          L     0,MIRNOW
891  0ADE E08B0AF0          BC    11,INC1
892  0AE0 4400132E          L     0,COLUMN
893  0AE2 E08B0AE8          BC    11,$+6
894  0AE4 50800001          SA    0,+1
895  0AE6 70820AEC          B     $+6
896  0AE8 48841343          ST    4,MIRNOW
897  0AEA 4C800001 INC2     AA    0,+1
898  0AEC 4880132E          ST    0,COLUMN
899  0AEE 72820002          B     +2,3
900  0AF0 4400132E INC1     L     0,COLUMN
```

```
0AF2 C0001320          CR    0,COLEND
0AF4 E0880AF8          BC    11,$+4
0AF6 70820AEA          B     INC2
0AF8 44810001          LA    1,1
0AFA 48811343          ST    1,MIRNOW
0AFC 50800001          SA    0,1
0AFE 70820AEC          B     INC2+2
0B00 4400132E INC3     L     0,COLUMN
0B02 C0001320          CR    0,COLEND
0B04 E0880B08          BC    11,$+4
0B06 70820AEA          B     INC2
0B08 4884132E          ST    4,COLUMN
0B0A 72820002          B     +2,3
0B0C 4400132D COLDEC   L     0,CRCNOW
0B0E E0880B16          BC    11,$+8
0B10 50800001          SA    0,+1
0B12 48801320          ST    0,CRCNOW
0B14 72820002          B     +2,3
0B16 44001321          L     0,CRC
0B18 48801320          ST    0,CRCNOW
0B1A 4400131F          L     0,HMIR
0B1C E0880B40          BC    11,DEC4
0B1E 44001343          L     0,MIRNOW
0B20 E0880B34          BC    11,DEC2
0B22 4400132E          L     0,COLUMN
0B24 C0001320          CR    0,COLEND
0B26 E0880B2E          BC    11,$+8
0B28 4C800001          AA    0,+1
0B2A 4880132E DEC1     ST    0,COLUMN
0B2C 72820002          B     +2,3
0B2E 48841343          ST    4,MIRNOW
0B30 50800001 DEC3     SA    0,+1
0B32 70820B2A          B     DEC1
0B34 4400132E DEC2     L     0,COLUMN
0B36 E0880B3A          BC    11,$+4
0B38 70820B30          B     DEC3
0B3A 44810001          LA    1,1
0B3C 48811343          ST    1,MIRNOW
0B3E 70820B28          B     DEC1-2
0B40 4400132E DEC4     L     0,COLUMN
0B42 E08A0B30          BC    10,DEC3
0B44 44001320          L     0,COLEND
0B46 70820B2A          B     DEC1
0B48 44001331 RADVF    L     0,RRCNOW
0B4A C0001323          CR    0,RRC
0B4C E0880B54          BC    11,$+8
0B4E 4C800001          AA    0,+1
0B50 48801331          ST    0,RRCNOW
0B52 72820002          B     +2,3
0B54 48841331          ST    4,RRCNOW
0B56 44001322          L     0,TROWC
0B58 E2880002          BC    11,2,3
0B5A 44001332          L     0,CROWN
0B5C E0880B66          BC    11,RADVF1
0B5E C0001322          CR    0,TROWC
0B60 E0880B72          BC    11,RADVF2
0B62 44001330          L     0,ARROW
0B64 E0880B78          BC    11,RADVF2+6
0B66 44001332 RADVF1   L     0,CROWN
0B68 4C800001          AA    0,+1
0B6A 48801332          ST    0,CROWN
0B6C 44800001          LA    0,+1
0B6E 48801330          ST    0,ARROW
0B70 72820002          B     +2,3
0B72 4400131E RADVF2   L     0,VMIR
0B74 E0880B80          BC    11,RADVF3
0B76 48841330          ST    4,ARROW
0B78 44001332          L     0,CROWN
0B7A 50800001          SA    0,+1
0B7C 48801332          ST    0,CROWN
0B7E 72820002          B     +2,3
0B80 48841332 RADVF3   ST    4,CROWN
0B82 72820002          B     +2,3
0B84 44001331 RADVR    L     0,RRCNOW
0B86 E0880B8E          BC    11,$+8
```

```
976   0B88 50800001          SA     0,+1
977   0B8A 48801331          ST     0,RRCNOW
978   0B8C 72820002          B      +2,3
979   0B8E 44001323          L      0,RRC
980   0B90 48801331          ST     0,RRCNOW
981   0B92 44001322          L      0,TROWC
982   0B94 F2880002          BC     11,+2,3
983   0B96 44001330          L      0,ARROW
984   0B98 E0880B82          BC     11,RADVR2
985   0B9A 44001332          L      0,CROWN
986   0B9C E0880BAC          BC     11,RADVR1
987   0B9E 50800001          SA     0,+1
988   0BA0 48801332          ST     0,CROWN
989   0BA2 E2BA0002          BC     10,2,3
990   0BA4 4400131E          L      0,VMIR
991   0BA6 40800001          XORA   0,1
992   0BA8 48801330          ST     0,ARROW
993   0BAA 72820002          B      +2,3
994   0BAC 44001322 RADVR1   L      0,TROWC
995   0BAE 48801332          ST     0,CROWN
996   0BB0 72820002          B      +2,3
997   0BB2 44001332 RADVR2   L      0,CROWN
998   0BB4 4C800001          AA     0,+1
999   0BB6 48801332          ST     0,CROWN
1000  0BB8 C0001322          CR     0,TROWC
1001  0BBA E2BC0002          BC     12,+2,3
1002  0BBC 44800001          LA     0,+1
1003  0BBE 48801330          ST     0,ARROW
1004  0BC0 72820002          B      +2,3
1005  0BC2 44800BD2 AUTOD    LA     0,DBSTAD
1006  0BC4 44810001          LA     1,1
1007  0BC6 45020088          L      2,*REG0
1008  0BC8 4981008A          ST     1,*REG2
1009  0BCA C0800C2C          CRA    0,DBENDA
1010  0BCC E0880538          BC     11,ACR1
1011  0BCE 4C800001          AA     0,+1
1012  0BD0 70820BC6          B      AUTOD+4
1013  0BD2 120F     DBSTAD   DATA   COL36
1014  0BD3 1005              DATA   X'1005'
1015  0BD4 1006              DATA   X'1006'
1016  0BD5 1007              DATA   X'1007'
1017  0BD6 1019              DATA   X'1019'
1018  0BD7 101A              DATA   X'101A'
1019  0BD8 101B              DATA   X'101B'
1020  0BD9 102C              DATA   X'102C'
1021  0BDA 102D              DATA   X'102D'
1022  0BDB 102E              DATA   X'102E'
1023  0BDC 102F              DATA   X'102F'
1024  0BDD 1040              DATA   X'1040'
1025  0BDE 1041              DATA   X'1041'
1026  0BDF 1042              DATA   X'1042'
1027  0BE0 1043              DATA   X'1043'
1028  0BE1 1044              DATA   X'1044'
1029  0BE2 1055              DATA   X'1055'
1030  0BE3 1056              DATA   X'1056'
1031  0BE4 1057              DATA   X'1057'
1032  0BE5 1058              DATA   X'1058'
1033  0BE6 1059              DATA   X'1059'
1034  0BE7 105A              DATA   X'105A'
1035  0BE8 106A              DATA   X'106A'
1036  0BE9 106B              DATA   X'106B'
1037  0BEA 106C              DATA   X'106C'
1038  0BEB 106D              DATA   X'106D'
1039  0BEC 106E              DATA   X'106E'
1040  0BED 106F              DATA   X'106F'
1041  0BEE 107F              DATA   X'107F'
1042  0BEF 1080              DATA   X'1080'
1043  0BF0 1081              DATA   X'1081'
1044  0BF1 1082              DATA   X'1082'
1045  0BF2 1083              DATA   X'1083'
1046  0BF3 1084              DATA   X'1084'
1047  0BF4 1094              DATA   X'1094'
1048  0BF5 1095              DATA   X'1095'
1049  0BF6 1096              DATA   X'1096'
1050  0BF7 1097              DATA   X'1097'
```

```
1051  0BF8 1098          DATA  X'1098'
1052  0BF9 10A9          DATA  X'10A9'
1053  0BFA 10AA          DATA  X'10AA'
1054  0BFB 10AB          DATA  X'10AB'
1055  0BFC 10AC          DATA  X'10AC'
1056  0BFD 10AD          DATA  X'10AD'
1057  0BFE 10BE          DATA  X'10BE'
1058  0BFF 10BF          DATA  X'10BF'
1059  0C00 10C0          DATA  X'10C0'
1060  0C01 10C1          DATA  X'10C1'
1061  0C02 10C2          DATA  X'10C2'
1062  0C03 10C2          DATA  X'10C2'
1063  0C04 10C3          DATA  X'10C3'
1064  0C05 10C4          DATA  X'10C4'
1065  0C06 10C5          DATA  X'10C5'
1066  0C07 10D3          DATA  X'10D3'
1067  0C08 10D4          DATA  X'10D4'
1068  0C09 10D5          DATA  X'10D5'
1069  0C0A 10D6          DATA  X'10D6'
1070  0C0B 10D7          DATA  X'10D7'
1071  0C0C 10D8          DATA  X'10D8'
1072  0C0D 10D9          DATA  X'10D9'
1073  0C0E 10DA          DATA  X'10DA'
1074  0C0F 10DB          DATA  X'10DB'
1075  0C10 10E8          DATA  X'10E8'
1076  0C11 10E9          DATA  X'10E9'
1077  0C12 10EA          DATA  X'10EA'
1078  0C13 10EB          DATA  X'10EB'
1079  0C14 10EC          DATA  X'10EC'
1080  0C15 10ED          DATA  X'10ED'
1081  0C16 10EE          DATA  X'10EE'
1082  0C17 10EF          DATA  X'10EF'
1083  0C18 10F0          DATA  X'10F0'
1084  0C19 10F1          DATA  X'10F1'
1085  0C1A 10FD          DATA  X'10FD'
1086  0C1B 10FE          DATA  X'10FE'
1087  0C1C 10FF          DATA  X'10FF'
1088  0C1D 1100          DATA  X'1100'
1089  0C1E 1101          DATA  X'1101'
1090  0C1F 1102          DATA  X'1102'
1091  0C20 1103          DATA  X'1103'
1092  0C21 1104          DATA  X'1104'
1093  0C22 1105          DATA  X'1105'
1094  0C23 1113          DATA  X'1113'
1095  0C24 1114          DATA  X'1114'
1096  0C25 1115          DATA  X'1115'
1097  0C26 1117          DATA  X'1117'
1098  0C27 1118          DATA  X'1118'
1099  0C28 1119          DATA  X'1119'
1100  0C29 1120          DATA  X'1120'
1101  0C2A 1142          DATA  X'1142'
1102  0C2B 1150          DATA  X'1150'
1103  0C2C 12FF   DBENDA DATA  X'12FF'
1104  0C2D               END
1105  0E00               ABS   X'E00'
1106  0E00        CON    DSFG
1107  0E00 561D   RWZERO DATA  X'561D'
1108  0E01 021D   RO     DATA  X'021D'
1109  0E02 021B          DATA  X'021B'
1110  0E03 0217          DATA  X'0217'
1111  0E04 020F          DATA  X'020F'
1112  0E05 011E          DATA  X'011E'
1113  0E06 011D          DATA  X'011D'
1114  0E07 011B          DATA  X'011B'
1115  0E08 0117          DATA  X'0117'
1116  0E09 010F          DATA  X'010F'
1117  0E0A 009E          DATA  X'009E'
1118  0E0B 009D          DATA  X'009D'
1119  0E0C 009B          DATA  X'009B'
1120  0E0D 0097          DATA  X'0097'
1121  0E0E 008F          DATA  X'008F'
1122  0E0F 005E          DATA  X'005E'
1123  0E10 005D          DATA  X'005D'
1124  0E11 005B          DATA  X'005B'
1125  0E12 0057          DATA  X'0057'
```

```
1126  0E13 004F          DATA  X'004F'
1127  0E14 003E          DATA  X'003E'
1128  0E15 003D          DATA  X'003D'
1129  0E16 021E   SA     DATA  X'021E'
1130  0E17 003B   SB     DATA  X'003B'
1131  0E18 0037   PIPA   DATA  X'0037'
1132  0E19 002F   PIPB   DATA  X'002F'
1133  0E1A 0050   PIPDLY DATA  X'0050'
1134  0E1B 0100   SELDLY DATA  X'0100'
1135  0E1C 000B   ADPDLY DATA  X'000B'
1136  0E1D 0054   ADPTIM DATA  X'0054'
1137  0E1E 5E17   RWZER2 DATA  X'5E17'
1138  0E1F 4C5B   RWZER3 DATA  X'4C5B'
1139  0E20 0100   RTMCON DATA  X'0100'
1140  0E21 543D   RZREND DATA  X'543D'
1141  0E22 7F1E   SAWHT  DATA  X'7E1E'
1142  0E23 0006   LCCODE DATA  X'06'
1143  0E24 005B          DATA  X'5B'
1144  0E25 004F          DATA  X'4F'
1145  0E26 0066          DATA  X'66'
1146  0E27 006D          DATA  X'6D'
1147  0E28 007D          DATA  X'7D'
1148  0E29 0027          DATA  X'27'
1149  0E2A 007F          DATA  X'7F'
1150  0E2B 006F          DATA  X'6F'
1151  0E2C 00BF          DATA  X'BF'
1152  0E2D 0086          DATA  X'86'
1153  0E2E 00DB          DATA  X'DB'
1154  0E2F 00CF          DATA  X'CF'
1155  0E30 00E6          DATA  X'E6'
1156  0E31 00ED          DATA  X'ED'
1157  0E32 00FD          DATA  X'FD'
1158  0E33 00A7          DATA  X'A7'
1159  0E34 00FF          DATA  X'FF'
1160  0E35 00EF          DATA  X'EF'
1161  0E36 013F          DATA  X'13F'
1162  0E37 0002   RRCODE DATA  2
1163  0E38 0004          DATA  4
1164  0E39 0006          DATA  6
1165  0E3A 000E          DATA  X'E'
1166  0E3B 023F   SELRUF DATA  X'23F'
1167  0E3C 0206          DATA  X'206'
1168  0E3D 025B          DATA  X'25B'
1169  0E3E 024F          DATA  X'24F'
1170  0E3F 0266          DATA  X'266'
1171  0E40 026D          DATA  X'26D'
1172  0E41 1000   COLADR DATA  COL1
1173  0E42 1015          DATA  COL2
1174  0E43 102A          DATA  COL3
1175  0E44 103F          DATA  COL4
1176  0E45 1054          DATA  COL5
1177  0E46 1069          DATA  COL6
1178  0E47 107E          DATA  COL7
1179  0E48 1093          DATA  COL8
1180  0E49 10A8          DATA  COL9
1181  0E4A 10BD          DATA  COL10
1182  0E4B 10D2          DATA  COL11
1183  0E4C 10E7          DATA  COL12
1184  0E4D 10FC          DATA  COL13
1185  0E4E 1111          DATA  COL14
1186  0E4F 1126          DATA  COL15
1187  0E50 113B          DATA  COL16
1188  0E51 1150          DATA  COL17
1189  0E52 1165          DATA  COL18
1190  0E53 117A          DATA  COL19
1191  0E54 118F          DATA  COL20
1192  0E55 11A4          DATA  COL21
1193  0E56 11B9          DATA  COL22
1194  0E57 11CE          DATA  COL23
1195  0E58 11E3          DATA  COL24
1196  0E59 11F8          DATA  COL25
1197  0E5A 120D          DATA  COL26
1198  0E5B 1222          DATA  COL27
1199  0E5C 1237          DATA  COL28
1200  0E5D 124C          DATA  COL29
```

```
0E5E 1261                DATA  COL30
0E5F 1276                DATA  COL31
0E60 128B                DATA  COL32
0E61 12A0                DATA  COL33
0E62 12B5                DATA  COL34
0E63 12CA                DATA  COL35
0E64 12DF                DATA  COL36
0E65 12F4                DATA  COL37
0E66 1309                DATA  COL38
0E67 FFE5      ROFFST    DATA  -27
0E68 FFE5      LOFFST    DATA  -27
0E69 001B      RMFST     DATA  +27
0E6A FFE5      LMFST     DATA  -27
0E6B 0042      CARSIZ    DATA  66
0E6C 00C0      SLOWN     DATA  X'00C0'
0E6D 0050      FASTN     DATA  X'0050'
0E6E                     END
0F00                     ARS   X'F00'
0F00           VAR       DSEG
0F00           MOTIF     RES   256
1000           COL1      RES   21
1015           COL2      RES   21
102A           COL3      RES   21
103F           COL4      RES   21
1054           COL5      RES   21
1069           COL6      RES   21
107E           COL7      RES   21
1093           COL8      RES   21
10A8           COL9      RES   21
10BD           COL10     RES   21
10D2           COL11     RES   21
10E7           COL12     RES   21
10FC           COL13     RES   21
1111           COL14     RES   21
1126           COL15     RES   21
113B           COL16     RES   21
1150           COL17     RES   21
1165           COL18     RES   21
117A           COL19     RES   21
118F           COL20     RES   21
11A4           COL21     RES   21
11B9           COL22     RES   21
11CE           COL23     RES   21
11E3           COL24     RES   21
11F8           COL25     RES   21
120D           COL26     RES   21
1222           COL27     RES   21
1237           COL28     RES   21
124C           COL29     RES   21
1261           COL30     RES   21
1276           COL31     RES   21
128B           COL32     RES   21
12A0           COL33     RES   21
12B5           COL34     RES   21
12CA           COL35     RES   21
12DF           COL36     RES   21
12F4           COL37     RES   21
1309           COL38     RES   21
131E           VMIR      RES   1
131F           HMIR      RES   1
1320           COLEND    RES   1
1321           CRC       RES   1
1322           TROWC     RES   1
1323           RRC       RES   1
1324           SELVC     RES   1
1325           DIRNOW    RES   1
1326           DIRFIX    RES   1
1327           DONFLG    RES   1
1328           LAST80    RES   1
1329           CARDOK    RES   1
132A           N1FLAG    RES   1
132B           COLPOS    RES   1
132C           SALEV     RES   1
132D           CRCNOW    RES   1
132E           COLUMN    RES   1
```

| | | | | |
|---|---|---|---|---|
| 1276 | 132F | ALFVEL | RES | 1 |
| 1277 | 1330 | AKROW | RES | 1 |
| 1278 | 1331 | KKCNOW | RES | 1 |
| 1279 | 1332 | CKOWN | RES | 1 |
| 1280 | 1333 | FTIMER | RES | 1 |
| 1281 | 1334 | RTIMER | RES | 1 |
| 1282 | 1335 | DBUF1 | RES | 1 |
| 1283 | 1336 | DBUF2 | RES | 1 |
| 1284 | 1337 | CADJK | RES | 1 |
| 1285 | 1338 | CADJL | RES | 1 |
| 1286 | 1339 | MTIMER | RES | 1 |
| 1287 | 133A | LAST81 | RES | 1 |
| 1288 | 133B | LKRFV | RES | 1 |
| 1289 | 133C | OFF3C | RES | 1 |
| 1290 | 133D | JAMCHK | RES | 1 |
| 1291 | 133E | ENRACT | RES | 1 |
| 1292 | 133F | OFF3F | RES | 1 |
| 1293 | 1340 | NEWPOS | RES | 1 |
| 1294 | 1341 | SELVZ | RES | 1 |
| 1295 | 1342 | KBIT | RES | 1 |
| 1296 | 1343 | MIRNOW | RES | 1 |
| 1297 | 1344 | ATABLE | RES | 23 |
| 1298 | 135B | DOPTN | RES | 1 |
| 1299 | 135C | SAFLAG | RES | 1 |
| 1300 | 135D | CHKSUM | RES | 1 |
| 1301 | 135E | REMNUM | RES | 1 |
| 1302 | 135F | PFIRST | RES | 1 |
| 1303 | 1360 | C11 | RES | 1 |
| 1304 | 1361 | AR1 | RES | 1 |
| 1305 | 1362 | AR00 | RES | 1 |
| 1306 | 1363 | CKC00 | RES | 1 |
| 1307 | 1364 | STIMER | RES | 1 |
| 1308 | 1365 | LAST82 | RES | 1 |
| 1309 | 1366 | C1POS | RES | 1 |
| 1310 | 1367 | SLOWC | RES | 1 |
| 1311 | 1368 | DDBUSY | RES | 1 |
| 1312 | 1369 | CSFLAG | RES | 1 |
| 1313 | 136A | ATLAST | RES | 1 |
| 1314 | 136B | | END | |